US006806862B1

(12) United States Patent
Zhang et al.

(10) Patent No.: US 6,806,862 B1
(45) Date of Patent: Oct. 19, 2004

(54) LIQUID CRYSTAL DISPLAY DEVICE

(75) Inventors: Hongyong Zhang, Kawasaki (JP); Hirokazu Miwa, Kawasaki (JP); Michiya Oura, Kawasaki (JP); Hiroshi Murakami, Kawasaki (JP); Kazuhiro Takahara, Kawasaki (JP)

(73) Assignee: Fujitsu Display Technologies Corporation, Kawasaki (JP)

( * ) Notice: Subject to any disclaimer, the term of this patent is extended or adjusted under 35 U.S.C. 154(b) by 0 days.

(21) Appl. No.: 09/288,741

(22) Filed: Apr. 8, 1999

(30) Foreign Application Priority Data

Oct. 27, 1998 (JP) ..... 10-305890
Oct. 27, 1998 (JP) ..... 10-306151
Jan. 21, 1999 (JP) ..... 11-013431

(51) Int. Cl.[7] ..... G09G 3/36

(52) U.S. Cl. ..... 345/103; 345/87; 345/89; 345/90; 345/92; 345/98; 345/100; 345/102; 345/104

(58) Field of Search ..... 345/103, 104, 345/100, 98, 89, 92, 90, 102, 87

(56) References Cited

U.S. PATENT DOCUMENTS

| | | | | |
|---|---|---|---|---|
| 4,870,399 A | | 9/1989 | Carlson | |
| 4,890,101 A | | 12/1989 | Carlson | |
| 5,574,475 A | | 11/1996 | Callahan, Jr. et al. | 345/100 |
| 5,598,178 A | | 1/1997 | Kawamori | 345/93 |
| 5,739,805 A | | 4/1998 | Dingwall | 345/100 |
| 5,745,093 A | | 4/1998 | Tsuzuki et al. | 345/103 |
| 5,856,816 A | | 1/1999 | Youn | 345/98 |
| 5,929,832 A | * | 7/1999 | Furukawa et al. | 345/98 |
| 6,014,193 A | * | 1/2000 | Taira et al. | 349/73 |
| 6,040,812 A | * | 3/2000 | Lewis | 345/89 |
| 6,067,066 A | * | 5/2000 | Kubota et al. | 345/98 |

FOREIGN PATENT DOCUMENTS

| | | |
|---|---|---|
| JP | 61-156187 | 7/1986 |
| JP | 62-40493 | 2/1987 |
| JP | 64-089773 | 4/1989 |
| JP | 5-210361 | 8/1993 |
| JP | 6-102837 | 4/1994 |
| JP | 6-167952 | 6/1994 |
| JP | 7-199874 | 8/1995 |
| JP | 08-292417 | 11/1996 |
| JP | 10-010572 | 1/1998 |
| JP | 10-143115 | 5/1998 |
| JP | 10-161612 | 6/1998 |
| JP | 10-307567 | 11/1998 |

* cited by examiner

*Primary Examiner*—Richard Hjerpe
*Assistant Examiner*—Jean Lesperance
(74) *Attorney, Agent, or Firm*—Greer, Burns & Crain, Ltd.

(57) ABSTRACT

A liquid crystal display device including a display part having pixels arranged in a matrix formation; signal lines and scan lines connected to the pixels; a data driver which supplies display signals to the signal lines; and a reset circuit which resets the potentials of the signal lines to a predetermined potential with a given period. In one embodiment, the reset circuit includes a first reset circuit connected to the signal lines, and a second reset circuit connected to an output part of the driver.

9 Claims, 53 Drawing Sheets

LIQUID CRYSTAL DISPLAY DEVICE

BACKGROUND OF THE INVENTION

1. Field of the Invention

The present invention generally relates to liquid crystal display devices, and more particularly to a liquid crystal display apparatus integrated with a driver circuit formed on a glass substrate.

A liquid crystal display device is compact, light and low power consumption, as compared to a display device with a CRT (Cathode-Ray Tube), and is widely used as a display device of a portable computer or the like. Generally, the liquid crystal display device has a structure in which two transparent substrates sandwich liquid crystal. Opposing electrodes, a color filter and an alignment film are provided on one of two opposed surfaces of the respective transparent substrates, and thin-film transistors (TFTs), pixel electrodes and an alignment film are provided on the other opposed surface. Polarization plates are respectively provided to the surfaces of the transparent substrates opposite to the respective opposed surfaces. The two polarization plates are arranged so that the opposed axes thereof are orthogonal to each other. In this arrangement, light is allowed to pass through the polarization plates without an electric field applied, and is shielded with an electric field applied. This is called normally-white mode. When the polarization axes of the two polarization plates are parallel to each other, a normally-black mode is obtained. Hereinafter, the transparent substrate with the TFTs and the pixel electrodes formed thereon may be referred to as a TFT substrate, and the other transparent substrate with the opposed electrodes formed thereon may be referred to as an opposed substrate.

2. Description of the Related Art

Recently, a polysilicon TFT has been attractive because a liquid crystal display part and a peripheral circuit part can be integrally formed. The electron field effect mobility of a polysilicon TFT is approximately equal to tens of $cm^2/Vs$ to 200 $cm^2/Vs$ is thus 1/10–1/4 of that of a single-crystal silicon MOSFET. Hence, it is difficult to form a high-speed circuit which operates at tens of MHz by using polysilicon TFTs in the liquid crystal display device. Further, it is also difficult to form a complex circuit in the liquid crystal display device using polysilicon TFTs due to a limitation on a relative large design rule (generally 3–5 $\mu$m) applied to a glass substrate used in the liquid crystal display device.

For the above reasons, the conventional liquid crystal display device using the polysilicon TFTs employs a divided dot-sequential drive method in order to display an image on a display part. A control circuit is provided outside of the display part and is used to divide display data from a data driver into parts in order to reduce the frequency of the display data. This is because the data driver formed of polysilicon TFTs do not operate at tens of MHz. The display data is written into data signal lines to which analog switches are connected, and are then supplied to polysilicon TFTs which are on via the analog switches which are also on. Hence, the liquid crystal layers on the pixel electrodes are operated so that an image can be displayed.

Also, the conventional liquid crystal display device has another disadvantage in that the analog switches are required to have a comparatively wide channel width in order to complete write data into the pixels for a short time. Thus, it is required to provide a large area on the glass substrate for forming the analog switches.

Further, the conventional liquid crystal display device uses the control circuit provided outside thereof in order to divide the display data into parts to thus reduce the frequency of the display signal. Hence, it is required to divide each of the R, G and B signals which are respectively a one-channel signal into a plurality of channels based on the number of divisions. For example, if the display data is divided into 16 parts, each of the R, G and B signals is divided into 16 parts, so that the display data is divided into 48 channels in total. Furthermore, the liquid crystal display device using the polysilicon transistors is required to have the function of converting the display signal in digital formation into an analog signal which actually drives the liquid crystal display part and to thus have a specific IC chip for controlling the polysilicon TFTs. This increases the cost. Moreover, the control circuit provided outside of the display part consumes a certain amount of power and is not suitable for a digitized interface.

The polysilicon TFT can be formed by a low-temperature process (lower than a process temperature of 600° C.),. When such a polysilicon TFT thus produced is applied to the liquid crystal display device, a display failure may occur. Examples of a display failure is a scan stripe, a warp streak, a ghost display and an unevenness between horizontal display and vertical display. The display failure results from a periodic performance change of the low-temperature polysilicon TFTs, deviations of the performance of the analog switch TFTs and delays of time of signals caused in a shift register and a buffer circuit, which circuits form the data driver.

The periodic performance change of the low-temperature polysilicon TFTs results from a factor of instability of an eximer laser oscillator. An energy error $\Delta E$ (=Emax−Emin) always exists between pulses of the eximer laser, and is greater than 10% of Emax if the frequency of the laser pulse falls within the range of 50 to 300 Hz where Emax denotes the maximum energy value of the eximer layer and Emin denotes the minimum energy value thereof. On the other hand, the range of the projection energy within which the crystallization of the polysilicon TFTs can be ensured is approximately equal to ±3–5% of an optimal projection energy Eop. As described above, sine the maximum and minimum energy values Emax and Emin of the eximer laser is located outside of the projection energy range of the laser pulse within which the crystallization of the polysilicon transistors is ensured. Hence, the low-temperature polysilicon TFTs have a dispersion of the performance.

There is also a dispersion of the crystallization of the low-temperature polysilicon TFTs. This is because the crystallized state of polysilicon is changed at an interface portion in which the laser beams overlaps each other when scanning the glass substrate. Hence, the performance of the polysilicon TFTs, such as the electron field effect mobility or the threshold voltage thereof will be-changed.

The delays of the signals caused in the shift register of the driver circuit result from an arrangement in which the data driver operates at a high frequency in the divided dot-sequential drive method and the shift register has a large number of stages.

SUMMARY OF THE INVENTION

It is a general object of the present invention to provide a liquid crystal display device in which the above disadvantages are eliminated.

A more specific object of the present invention is to provide a liquid crystal display device of an improved display quality.

The above objects of the present invention are achieved by a liquid crystal display device comprising: a display part divided into blocks; a gate driver which sequentially drives scan lines arranged in the display part one by one; and a data driver which supplies, over common signal lines, display signals to pixels connected to one of the scan lines driven by the gate driver and located in one of the blocks which are sequentially selected in accordance with a block control signal.

BRIEF DESCRIPTION OF THE DRAWINGS

Other objects, features and advantages of the-present invention will become more apparent from the following detailed description when read in conjunction with the accompanying drawings, in which.

DESCRIPTION OF THE PREFERRED EMBODIMENTS

A description will now be given of a first embodiment of the present invention.

Figure 1:
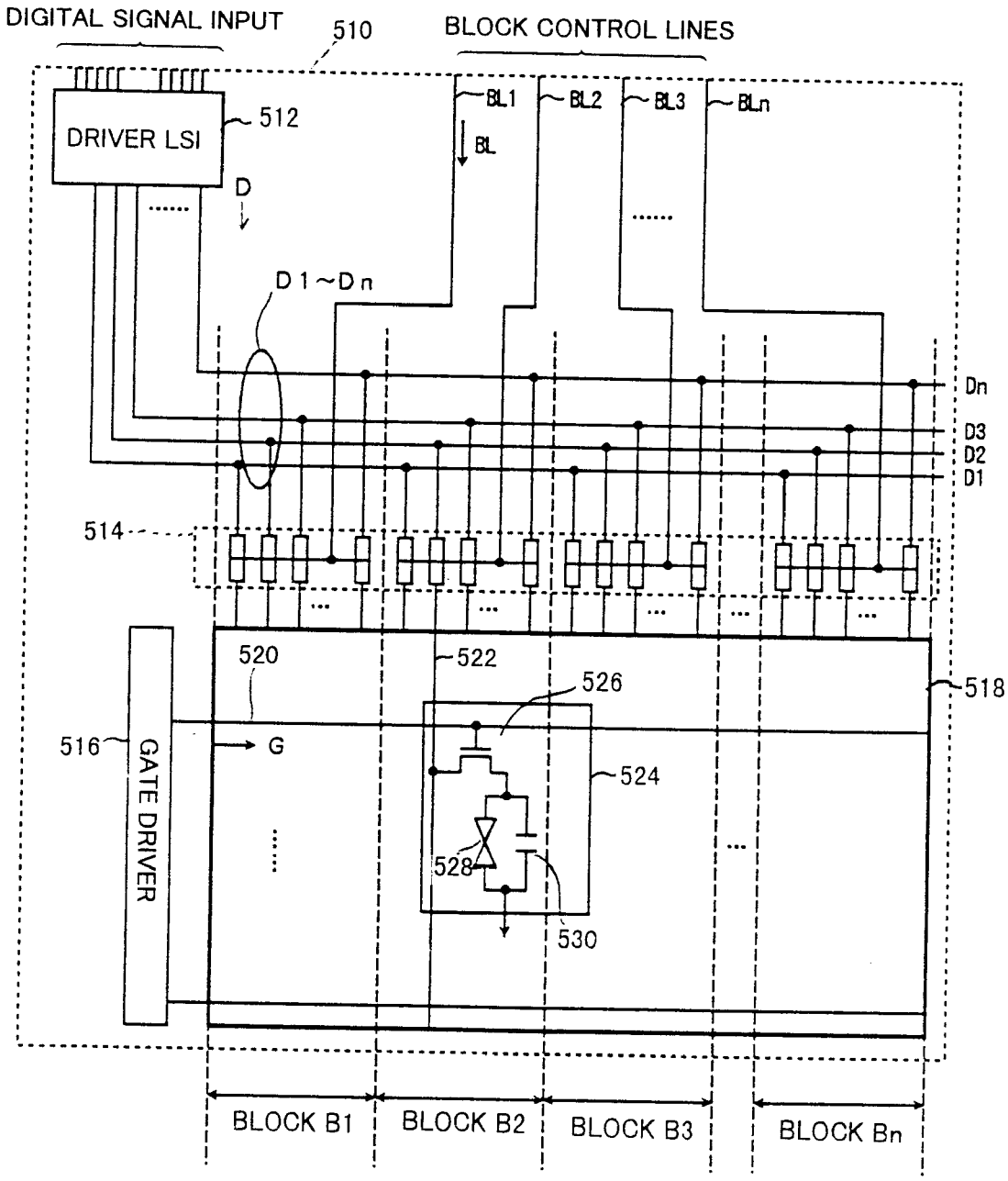
FIG. 1 is a block diagram of a liquid crystal display device according to a first embodiment of the present invention.

FIG. 1 is a block diagram of a liquid crystal display device according to the first embodiment of the present invention. As shown in FIG. 1, a liquid crystal display device 510 includes a line-sequential driver IC chip 512, common signal lines D1–Dn, analog switches 514 formed of TFTs, block control lines BL1–BLn, a gate driver circuit 516, and a liquid crystal display part 518. The display part 518 is divided into n blocks B1–Bn, on each of which blocks scan lines 520 and signal lines 522 are arranged in a matrix formation. Cells 524 are respectively provided at respective cross points at which the scan lines 520 and the signal lines 522 cross each other. Each of the cells 524 is made up of a pixel TFT 526, a liquid crystal layer 528 and a storage capacitor 530. The gate electrode of the pixel TFT 526 of a p channel is connected to the scan line 520, and the drain electrode thereof is connected to the signal line 522. The source electrode of the TFT 526 is connected to the liquid crystal layer 528 and the storage capacitor 530.

Each of the blocks B1–Bn is provided with n analog switches 514. The common signal lines D1–Dn are connected to the signal lines 522 of the display part 518 via the analog switches 514 of the blocks B1–Bn.

The line-sequential driver IC chip 512 includes first through fifth parts. The first part receives a serial digital signal from an IC or IC chip (not shown) externally connected to the device 512. The second part converts the serial digital signal into a parallel digital signal. The third part is a D/A converter which converts the parallel digital signal into an analog signal. The fourth part generates liquid crystal display signals D (including information on a level adjustment, a gradation generation and a polarity inversion). The fifth part outputs the display signals D.

The IC driver 512 applies the display signals D to the common signal lines D1–Dn on the block basis in a time-division formation. The analog switches 514 are activated on the block basis by applying a block control signal BL to one of the block control lines BL1–BLn.

At the time of driving the liquid crystal display device 510, a gate scan signal G is applied to the scan line 520 from the gate driver circuit 516. The gate scan signal G is input to the gates of the pixel TFTs 526, which are thus turned on. The signal lines 522 are supplied with the display signals D transferred over the common signal lines D1–Dn via the analog switches 514which are turned on by the block control signal BL. The display signals D pass through the pixel TFTs 526 which conduct.

Figure 2:
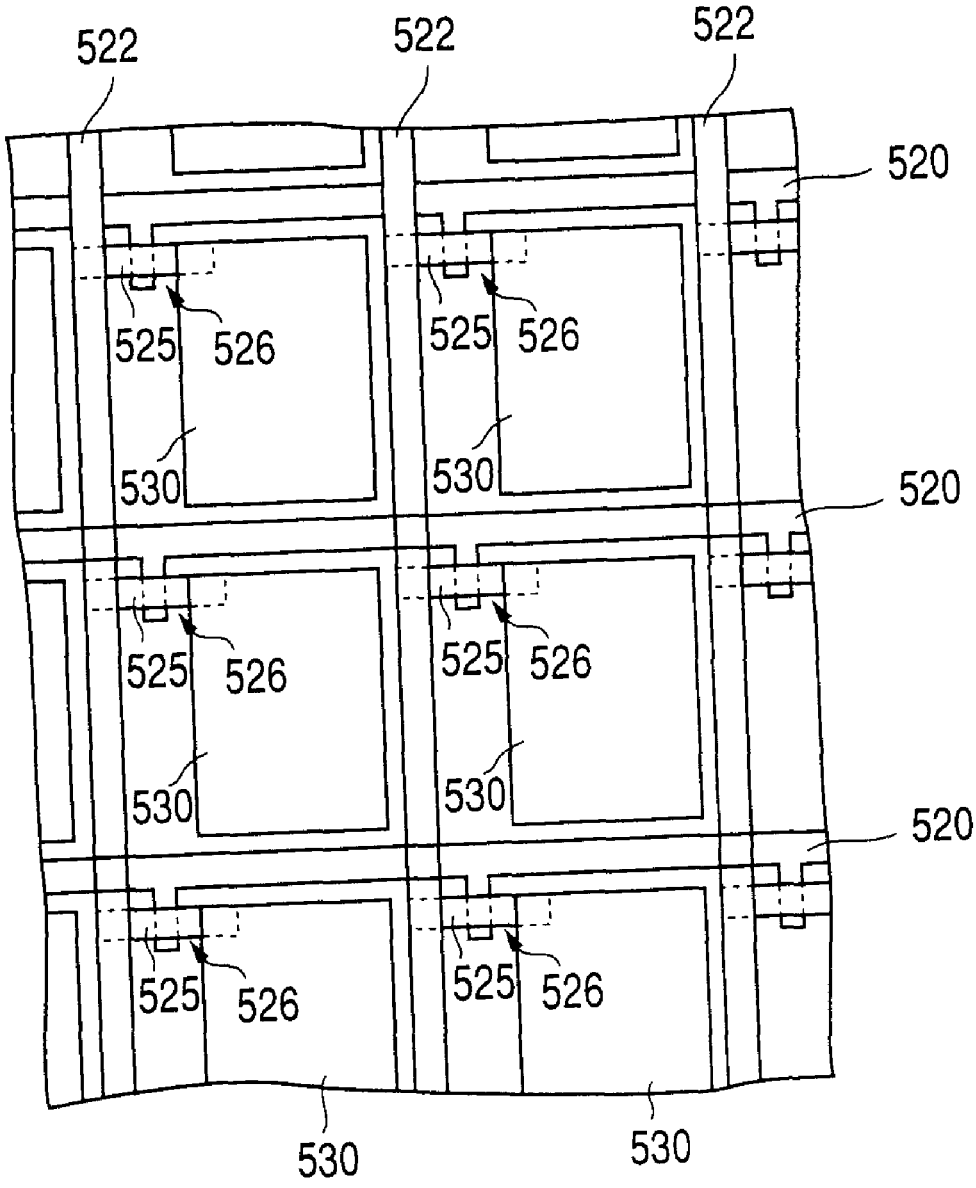
FIG. 2 is a plan view of the liquid crystal display panel used in the panel shown in FIG. 1.

FIG. 2 is a plan view of the display part 518. The display part 518 is an area in which a plurality of pixels for displaying an image are arranged in a matrix formation. As shown in FIG. 2, signal (data bus) lines 522, scan (gate bus) lines 520, pixel electrodes 530 and TFTs 526 are provided in the display part 518. The signal lines 522 and the scan lines 520 are arranged so as to be orthogonal to each other, and are electrically isolated from each other through an insulating film formed therebetween. A rectangular area defined by one signal line 522 and one scan line 520 is a pixel area, in which one TFT 524 and one pixel electrode 530 are arranged. The TFT 524 is formed of a protruding portion (gate) of the scan line 520 and a polysilicon film 525 selectively formed on the insulating film on the scan lines 520. In each pixel, the source of the TFT 524 is connected to the pixel electrode 530 via a contact hole (not shown), and the drain thereof is connected to the corresponding signal line 522 via a contact hole (not shown).

Figure 3:
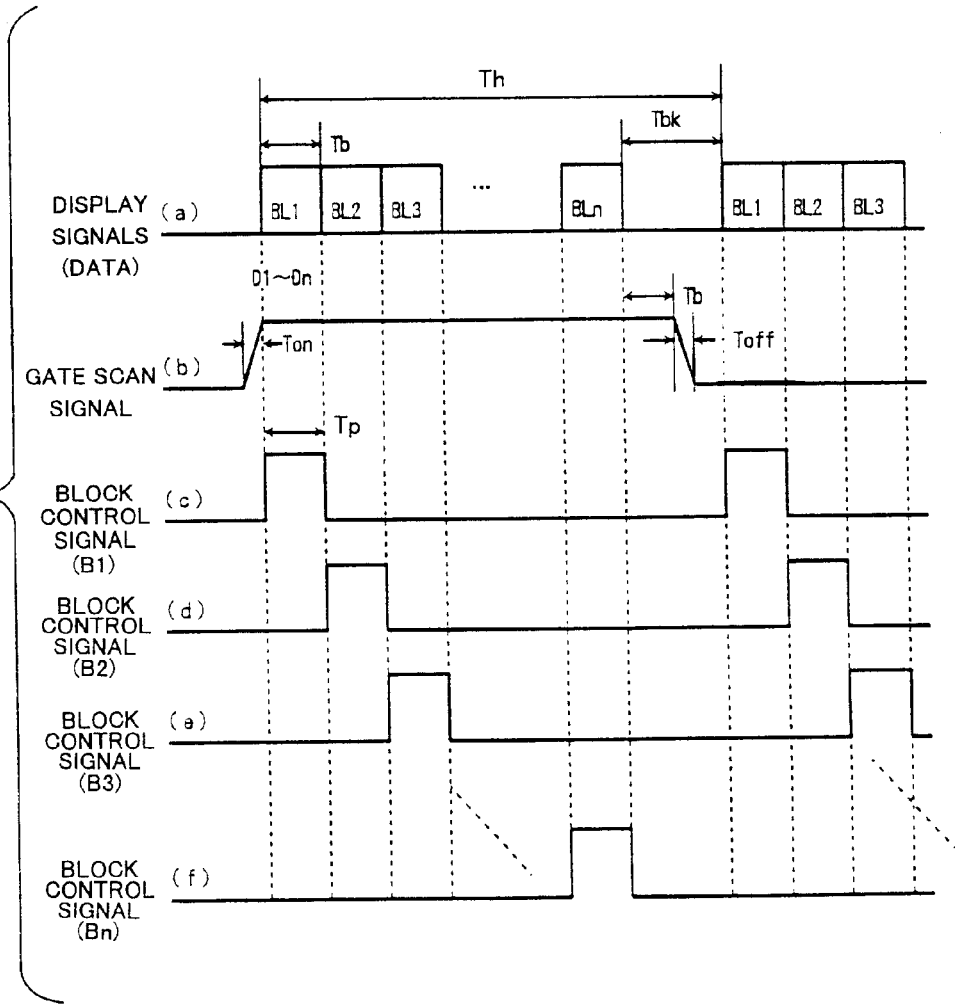
FIG. 3 is a timing chart of an operation of the liquid crystal display device shown in FIG. 1.

FIG. 3 is a timing chart of the display signals D, the gate scan signal G and the block control signals BL applied to the blocks B1–Bn of the liquid crystal display device 510.

As shown in parts (a)–(f) of FIG. 3, the gate driver circuit 516 switches the gate scan signal G to the high level, and applies the high-level gate scan signal G to the display part 518. The block control signal BL which is maintained at the high level for one block control period Tb is applied to the analog switches 514, which are thus turned on. At this time, the display signals D are respectively applied to the block B1 via the common signal lines D1–Dn for the block control period Tb. It is assumed that the block control period Tb and the time constant Ts of the signal lines 522 has a relationship of Tb>Ts.

After the display signals D are applied to the block B1, the block control signal BL which is high for the period Tb is applied to the analog switches 514 of the block B2, which switches are turned on. At this time, the display signals D are applied to the block B2 via the common signal lines D1–Dn for the period Tb. The above operation is repeated, and the display signals D are finally applied to the block Bn. Then, a blanking period Tbk comes. When the block control period Tb elapses after the blanking period Tbk starts, the gate scan signal G applied to the display part 518 is switched to the low level. When the blanking period Tbk ends, one horizontal scan period Th ends. Then, the display signals D are applied to the blocks B1–Bn starting from the block B1, so that the next scan operation is carried out.

In FIG. 3, Ton and Toff respectively denote the rising time and falling time of the gate scan signal G. The blanking period Tbk is sufficiently loner than the block control period Tb, and satisfies a condition Tbk>Tb+Ton+Toff.

The block control signal BL may be applied to the analog switches 514 so that all the analog switches 514 of the blocks B1–Bn are simultaneously turned on during the horizontal scan period Th.

As described above, the blocks B1–Bn are sequentially selected and activated one by one. A data write time Tb per block in the liquid crystal display device 510 which performs the above-mentioned block-sequential drive operation is equal to (Th−Tbk)/n. Hence, as a smaller number n of blocks is provided in the liquid crystal display device 510, the data write data Tb can be set to be longer. As the data write time Tb per block becomes longer, the data write time Tb is less affected by variations in the rising time Ton and the falling time Toff of the gate scan signal G due to dispersion of the characteristics of the pixel TFTs 526. Hence, it is possible to sufficiently ensure the data write time Tb for each block and to prevent occurrence of a display failure such as a laser scan stripe or a warp streak.

The dispersion of the characteristic of the pixel TFTs is caused by a fact in which the maximum and minimum energies of an eximer laser are located outside of the range of the eximer laser pulse projection energy in which the crystallization of p-channel polysilicon TFTs are ensured.

Figure 4:
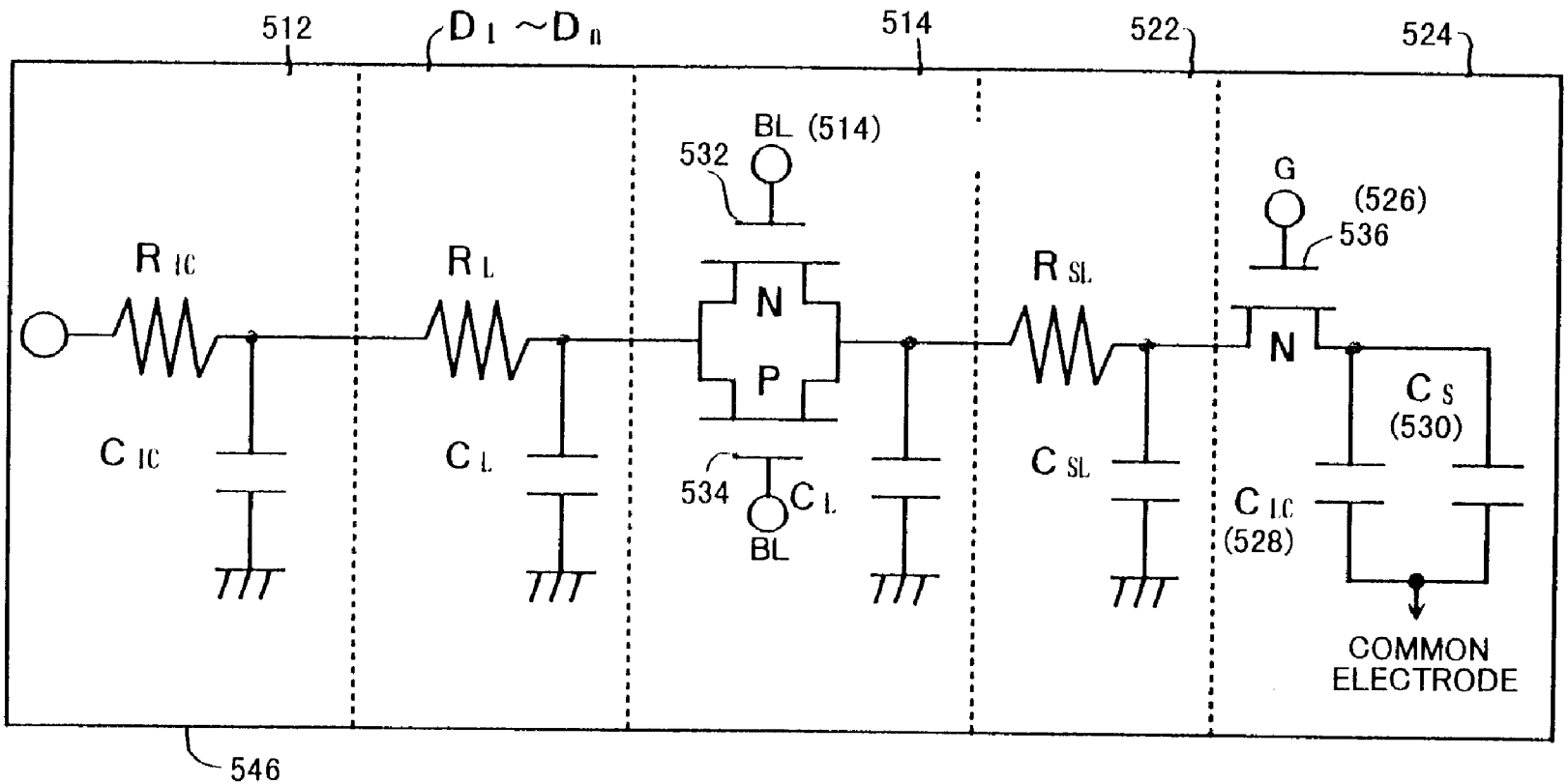
FIG. 4 shows an equivalent circuit of the liquid crystal display device shown in FIG. 1.

FIG. 4 shows an equivalent circuit 546 of the liquid crystal display device 510. Referring to FIG. 4, output resistance RIC and a capacitance CIC correspond to the line-sequential driver IC chip 512. A resistance RL and a capacitance CL correspond to the common signal lines C1–Dn. A capacitance CL, an n-channel transistor 532 and a p-channel transistor 534 correspond to one analog switch 514. A resistance RSL and a capacitance CSL correspond to one signal line 522. An n-channel transistor 536 corresponds to one pixel TFT 526, and capacitance CLC corresponds to the liquid crystal layer 528. The capacitance CS corresponds to the storage capacitance 530.

Figure 5:
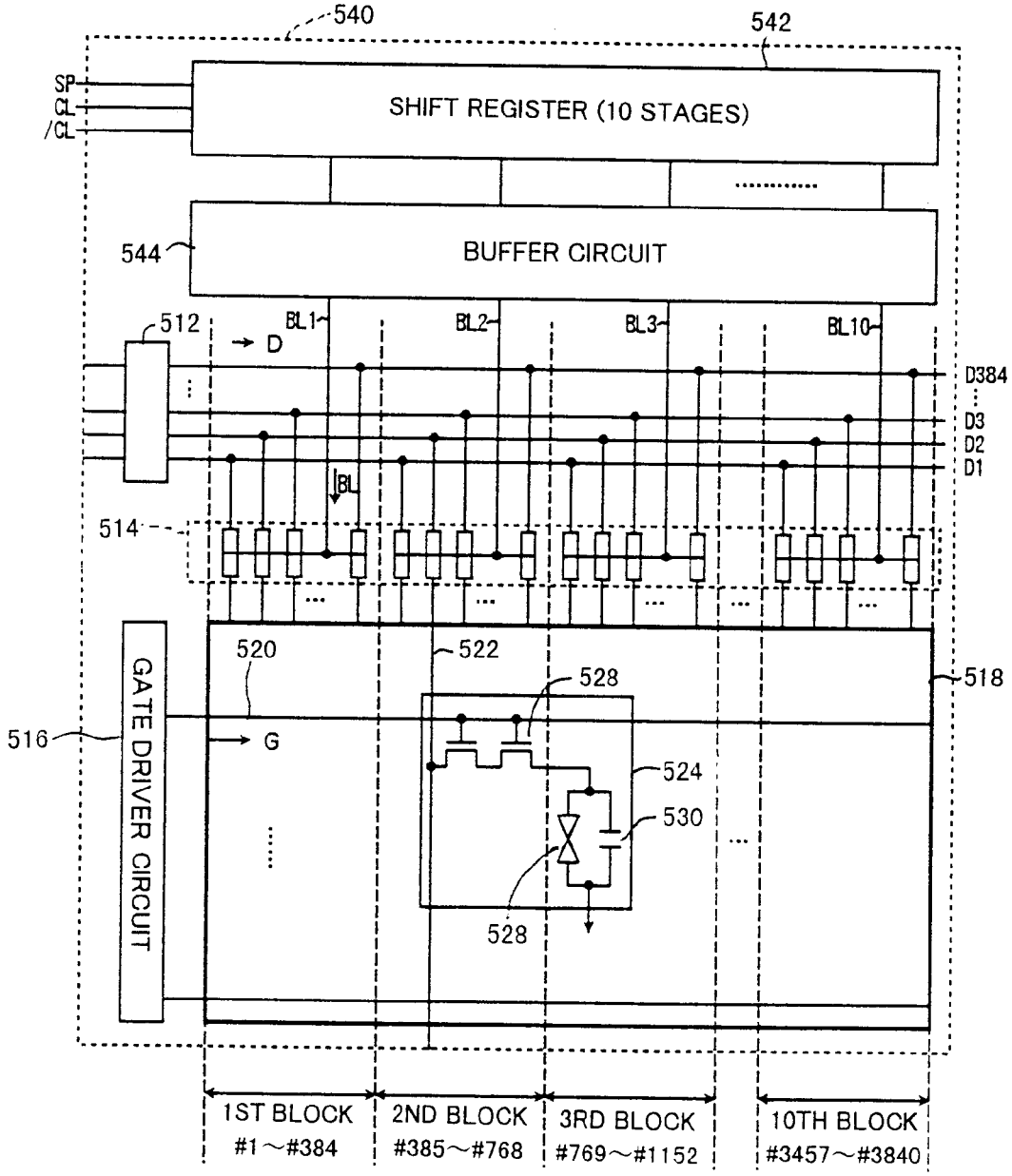
FIG. 5 shows a liquid crystal display device based on the structure shown in FIG. 1 according to the first embodiment of the present invention.

FIG. 5 shows a liquid crystal display device 540 based on the structure shown in FIG. 1 according to the first embodiment of the present invention. The device 540 shown in FIG. 5 is an SXGA liquid crystal display device integrated with peripheral circuits, and employs low-temperature polysilicon TFTs. In FIG. 5, parts that are the same as those shown in FIG. 1 are given the same reference numbers.

The liquid crystal display device 540 includes the line-sequential driver IC chip 512, common signal lines D1–D384, CMOS-type TFT analog switches 514, block control lines BL1–BL10, the gate driver circuit 516, the display part 518, a shift register circuit 542, and a buffer circuit 544. The shift register circuit 542 and the buffer circuit 544 form a circuit which generates the block signal BL. The shift register circuit 542 is supplied with a start pulse SP and clock signals CL and/CL. The operation frequency of the shift register circuit 542 is, for example, 0.5 MHz.

The display part 518 is divided into 10 blocks B1–B10, each of which blocks has 1204 scan lines 520 and 3840 signal lines (=1280×RGB) 522. Each cell 524 is made up of the pixel TFT 526, the liquid crystal layer 528, and the storage capacitor 530. The gate of the pixel TFT 526 formed of a p-channel polysilicon TFT is connected to the corresponding scan line 520, and the drain thereof is connected to the signal line 522. The source of the pixel TFT 526 is connected to the liquid crystal layer 528 and the storage capacitor 530.

Each of the blocks B1–B10 has 384 analog switches 514. The common signal lines D1–D384 are connectable to the signal lines 522 via the analog switches 514 provided in the respective blocks B1–B10.

The line-sequential driver IC chip 512 includes the aforementioned first through fifth parts. Also, the driver IC chip 512 has an input port having a function of selecting a six-bit input or an eight-bit input, and an output port having 384 output terminals with buffer amplifier buffers. Hence, the device 512 has a capability of a handling a block width of 384 bits at maximum. Further, the device 512 is designed to have, in operation, a maximum output resistance equal to or less than about 5 kΩ in order to make it possible to drive a display block having a wide data width, namely, long common signal lines. Hence, the device 512 can improve the time constant Ts of the signal lines 522 arranged in the display part 518.

The line-sequential driver IC chip 512 applies the display signals D generated therein to the analog switches 514 via the common signal lines D1–D384. The shift register 542 has ten stages. The combination of the shift register 542 and the buffer circuit 544 generates the block control signals BL, which are transferred to the block control lines BL1–BL10 and turn on the analog switches 514.

When the liquid crystal display device 540 is driven, the gate scan signal G is applied to the scan line 520 from the gate driver circuit 516. The gate scan signal G is applied to the gates of the corresponding pixel TFTs 526, which are turned on. The display signals D transferred over the common signal lines D1–D384 are applied to the signal lines 522 via the analog switches 514 which are turned on by the block control signal BL. Then, the display signals D are applied to the pixel TFTs 526, which form an image.

Each of the analog switches 514 may be formed of only an n-channel transistor or a p-channel transistor. The pixel TFTs 526 may be formed of only an n-channel transistor or a p-channel transistor.

Figure 6:
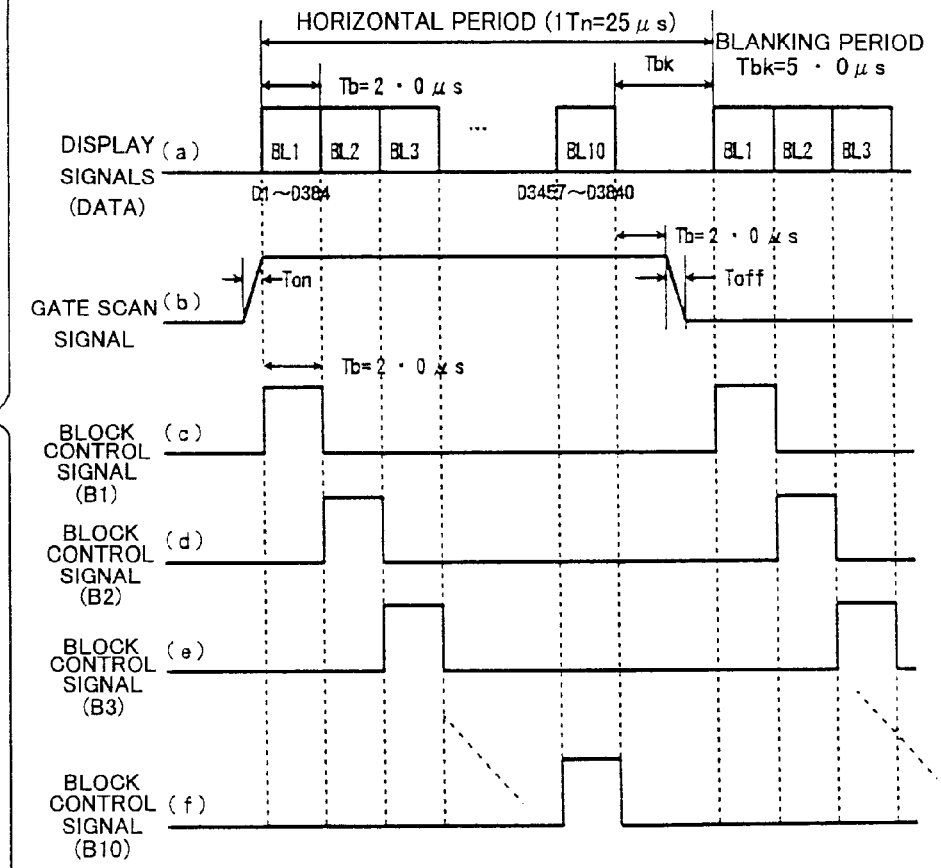
FIG. 6 is a timing chart of an operation of the liquid crystal display device shown in FIG. 5.

FIG. 6 is a timing chart of the display signals D, the gate scan signal G and the block control signals BL applied to the blocks B1–B10. Referring to FIG. 6, the high-level gate scan signal G is applied to the display part 518 from the gate driver circuit 516. Then, the block control signal BL which is maintained at the high level for only the period Tb (equal to 2.0 μS) is applied to the analog switches 514 of the block B1. Then, the analog switches 514 are turned on. At this time, the display signals D are applied to the block B1 via the common signal lines D1–D384 for only the period Tb, and data are written into the corresponding cells 520.

Then, the high-level block signal BL that is high for only the period Tb is applied to the analog switches 514 of the block B2. Hence, the analog switches 514 of the block B2 are turned on. At this time, the display signals D are applied to the block B2 via the common signal lines D1–D384 for only the period Tb, and are written into the corresponding cells 520.

The above operation is repeatedly carried out, and the display signals D are applied to the block B10 and are written into the corresponding cells 520. Then, the blanking period Tbk, which is, for example, 5.0 μS, comes.

When the period Tb elapses after the blanking period Tbk starts, the gate scan signal G switches to the low level. When the blanking period Tbk ends, one horizontal scan period Th ends. The length of one horizontal scan period Th is, for example, 25 μS (equal to 2.0 μS×10 blocks+5.0 μS). Then, the display signals D are sequentially applied to the blocks B1–B10 starting from the block B1, while the next scan line is driven. In FIG. 6, Ton and Toff respectively denote the rising time and falling time of the gate scan signal G.

As described above, the liquid crystal display device 540 is operated in the block-sequential driving method. The display part 18 is divided into 10 blocks, and the data write time Tb per block can be set longer than that in the divided dot-sequential driving method. Hence, the data write time Tb is less affected by variations in the rising time Ton and the falling time Toff of the gate scan signal G due to dispersion of the characteristics of the pixel TFTs 526. Hence, it is possible to sufficiently ensure the data write time Tb for each block and to prevent occurrence of a display failure such as a laser scan stripe or a warp streak.

Further, since the data write time Tb per block can be set longer than that in the divided dot-sequential driving method, it is possible to drastically reduce the frequencies of the display signals D and the block control signal BL. Hence, the performance of the pixel TFTs 526 is not required to be as high as that in the prior art. As a result, it is possible to greatly improve the production margin and yield of the liquid crystal display device 540.

The shift register circuit 542 has 10 stages, which are not as many as those of the shift register circuit employed in the liquid crystal display device of the divided dot-sequential driving method. In addition, the operation frequency of the shift register circuit 42 is lower than that in the conventional device. Hence, it is possible to prevent occurrence of a display failure due to a propagation delay of signals.

Further, the liquid crystal display device 540 includes the line-sequential driver IC chip 512 which converts the digital signal into the corresponding analog signal and transfers the resultant display signals D to the blocks in the time-division formation. Hence, it is not necessary to provide an IC chip and an associated external control circuit specifically designed to control polysilicon TFTs used in the conventional liquid crystal display device employing polysilicon TFTs. Hence, the cost of producing the liquid crystal display device 540 can be reduced and the power consumed therein can be reduced.

If the line-sequential driver IC chip 512 is a standardized driver IC chip capable of handling both a polysilicon panel and amorphous silicon panel, it is possible to further improve the performance, precision and cost reduction of the liquid crystal display device.

The inventors analyzed the time constants of parts of the equivalent circuit 546 shown in FIG. 4 and found that it is not possible to reduce the differences in performance between the individual pixel TFTs 526 caused during a laser-sued crystallization process unless the block control period Tb is made larger than the time constant Ts (CSL× RSL) of the signal lines 522 in the display part 518. Further, it is generally required that the number of bits handled in one block be greater than the number of blocks. Furthermore, it is required that the number of bits of one block is greater than the root of the number of horizontal pixels of the display part 518. When the above requirement is applied to the SXGA panel, the number of bits in one block is greater than $3840^{1/2}$ (which is approximately equal to 62). The block control period Tb can be obtained from the above condition as follows. The minimum block control period Tbmin is approximately equal to 1/62 of the horizontal period of 25 μS, that is, approximately 0.4 μS. Hence, in the liquid crystal display device 540, the block control period Tb is set equal to 2 μS, and the display part 518 is divided into 10 blocks (384 bits per block). The block control period (data write period) Tb of 2 μS is 12.5 times as long as the data write period Tb (about 160 ns) of the known 16-division dot-sequential drive method.

In order to perform the writing of data into the last block B10 in the same manner as that for the writing of data into the other blocks, the blanking period Tbk is required to be longer than at least the block control period Tb. It is desirable to satisfy a condition Tbk>Tb+Ton+Toff. With the above in mind, the blanking period Tbk is set equal to 5 μS in the present embodiment.

The number of blocks and the block control period Tb may arbitrarily be selected as long as the concept of the present invention is satisfied. For example, the horizontal scan period Th is set equal to 25 μS, but may be changed taking into account the frame frequency. For example, when the frame frequency is 60 Hz, the horizontal scan period Th is approximately 16 μS. As described above, it is possible to select the optimal block period Tb and the optimal number of blocks taking into consideration the performance of the TFTS.

Table 1 shows examples of the block width and the number of blocks which depend on various display formats.

TABLE 1

| display format | number of pixels in horizontal direction | number of pixels in vertical direction | horizontal/ vertical ratio in number of | horizontal period Th | block width (bits) | number of blocks |
|---|---|---|---|---|---|---|
| VGA | 1800 (600 × RGB) | 480 | 5:4 | ~35 μs | 300 | 6 |
| | | | | | 600 | 3 |
| SVGA | 2400 (800 × RGB) | 600 | 4:3 | ~28 μs | 200 | 12 |
| | | | | | 300 | 8 |
| | | | | | 400 | 6 |
| | | | | | 600 | 4 |
| XGA | 3072 (1024 × RGB) | 768 | 4:3 | ~22 μs | 256 | 12 |
| | | | | | 512 | 6 |
| SXGA | 3840 (1280 × RGB) | 1024 | 5:4 | ~16 μs | 384 | 10 |
| | | | | | 768 | 5 |
| UXGA | 4800 (1600 × RGB) | 1200 | 4:3 | ~14 μs | 200 | 24 |
| | | | | | 300 | 16 |
| | | | | | 400 | 12 |
| | | | | | 600 | 8 |
| QXGA | 6144 (2048 × RGB) | 1536 | 4:3 | ~11 μs | 256 | 24 |
| | | | | | 512 | 12 |
| | | | | | 1024 | 6 |
| HD1 | 3840 (1280 × RGB) | 720 | 16:9 | ~23 μs | 384 | 10 |
| | | | | | 768 | 5 |
| HD2 | 5760 (1920 × RGB) | 1080 | 16:9 | ~15 μs | 240 | 24 |
| | | | | | 384 | 15 |
| | | | | | 480 | 12 |
| | | | | | 960 | 6 |

Note: The above values are calculated under conditions of 30 frames/sec and 60 fields/sec.

As shown in Table 1, the numbers of pixels in the horizontal direction in the respective display formats are an integer multiple of any of the respective block (bit) widths, which are 200, 240, 256, 300 or 384 bits. It is desirable that the numbers of blocks in the respective display formats be set to be even numbers in order to facilitate expansion of the block width. Further, it is desirable that the number of blocks is selected in each of the display formats so that the block write time is longer than 1 $\mu$s in order to ensure the block write time.

Figure 7:
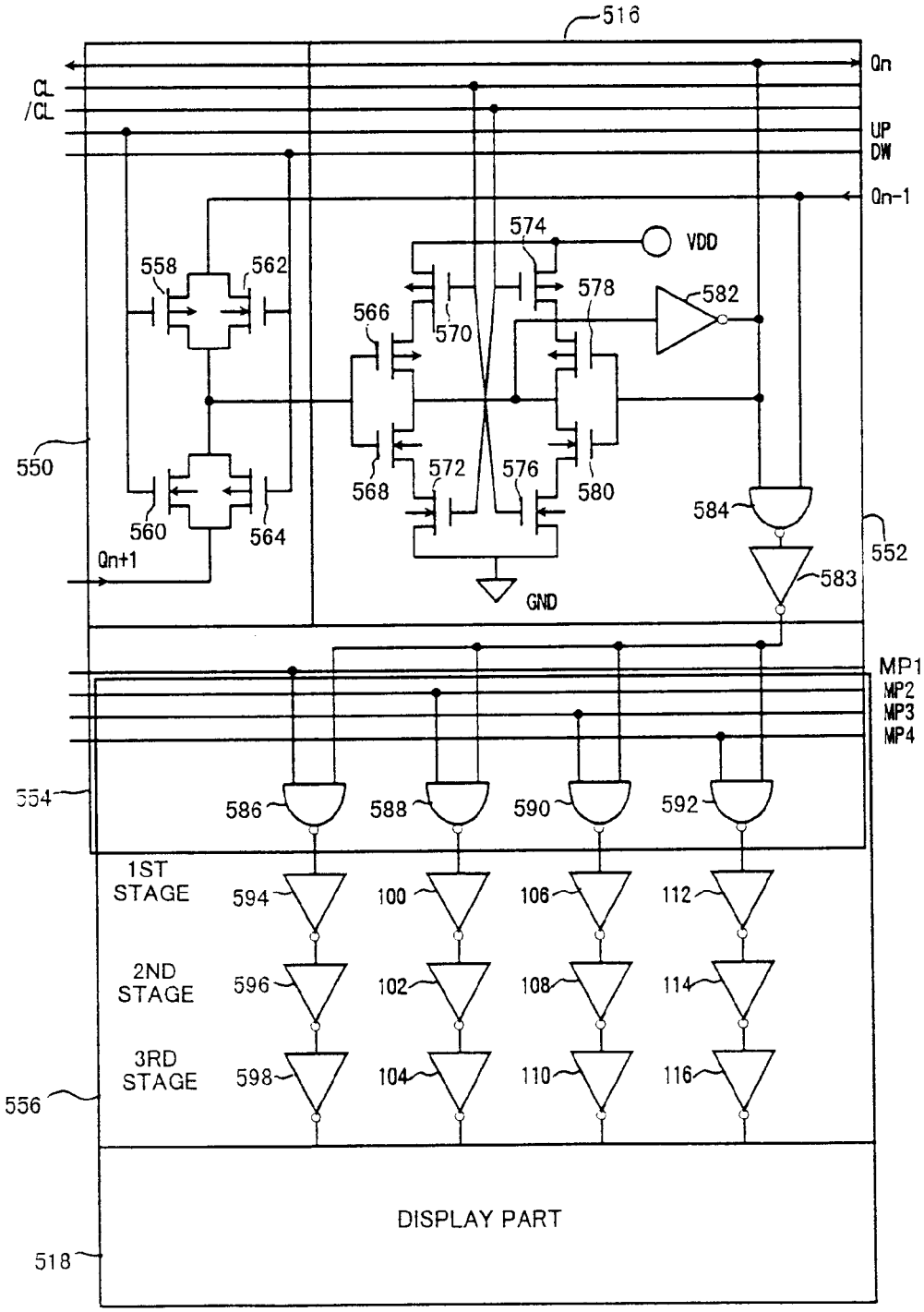
FIG. 7 is a circuit diagram of a gate driver circuit used in the structure shown in FIG. 5.

FIG. 7 is a circuit diagram of the gate driver circuit 516 used in the liquid crystal display device 540.

As shown in FIG. 7, the gate driver circuit 516 includes a two-way switch part 550, a shift register part 552, a multiplexer part 554, and an output buffer part 556.

The two-way switch part 550 includes transistors 558, 560, 562 and 564. The shift register part 552 includes transistors 566, 568, 570, 572, 574, 576, 578 and 580, inverters 582 and 583, and a NAND circuit 584. The multiplexer part 554 includes a four-bit multiplexer formed of four NAND circuits 586, 588, 590 and 592. One ends of the NAND circuits 586, 588, 590 and 592 are connected to the NAND circuit 584 via the inverter 583. The output buffer part 556 includes inverters 594, 596, 598, 100, 102, 104, 106, 108, 110., 112, 114 and 116. The inverters 594, 100, 106 and 112 are connected to the NAND circuits 586, 588, 590 and 592 of the multiplexer part 554. The inverters 598, 104, 110 and 116 are connected to the display part 518.

The gate driver circuit 516 employs the four-bit multiplexer part 554. Thus, the number of stages of the shift register (equal to 256) can be ¼ of that (equal to 1024) used in the prior art. Hence, it is possible to improve the power consumption and the yield.

Figure 8:
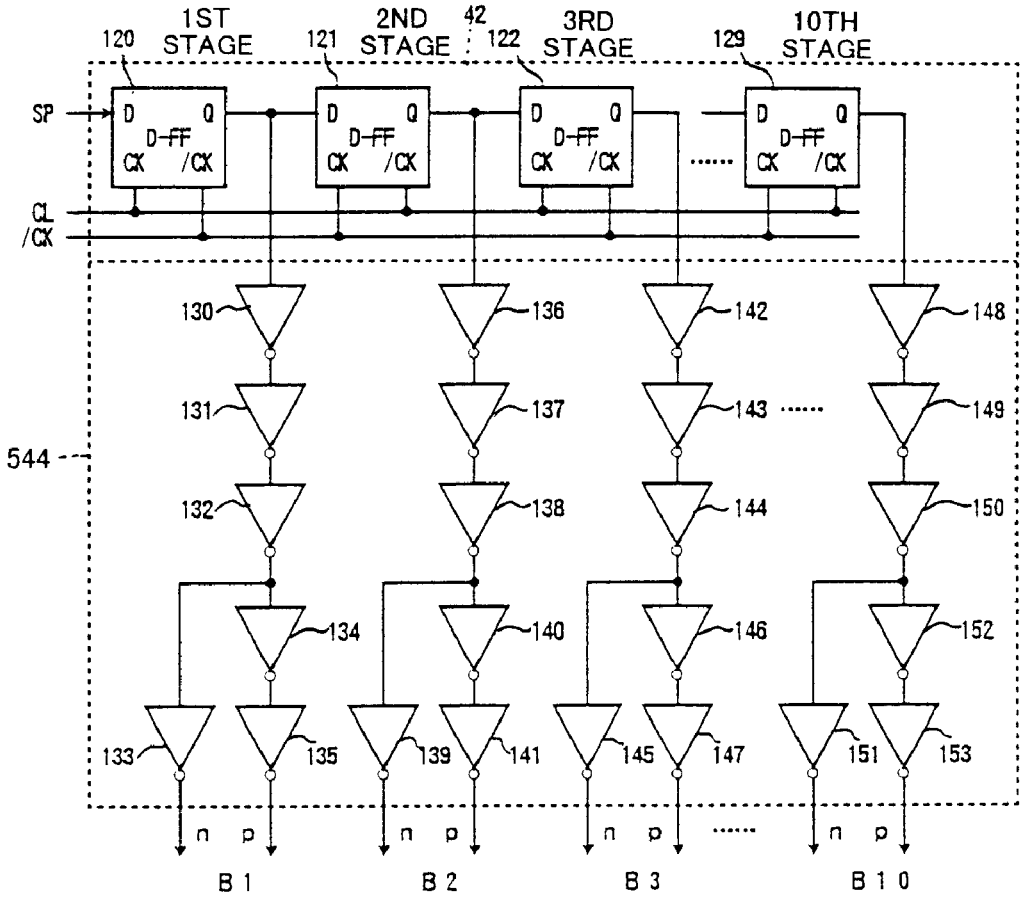
FIG. 8 is a circuit diagram of a shift register circuit and a buffer circuit used in the structure shown in FIG. 5.

FIG. 8 is a circuit diagram of the shift register circuit 542 and the buffer circuit 544 used in the liquid crystal display device 540. As shown in FIG. 8, the shift register 542 is made up of 10 D-type flip-flops (D-FF) 120, 121, . . . , 129, and the buffer circuit 544 is made up of inverters 130, 131, . . . , 153. The flip-flop 120 and the buffers 130, 131, . . . , 135 form a circuit which generates the block control signal BL associated with the block B1 of the display part 518 . The flip-flops 120, 121, . . . , 129 have the same structure as each other.

Figure 9:
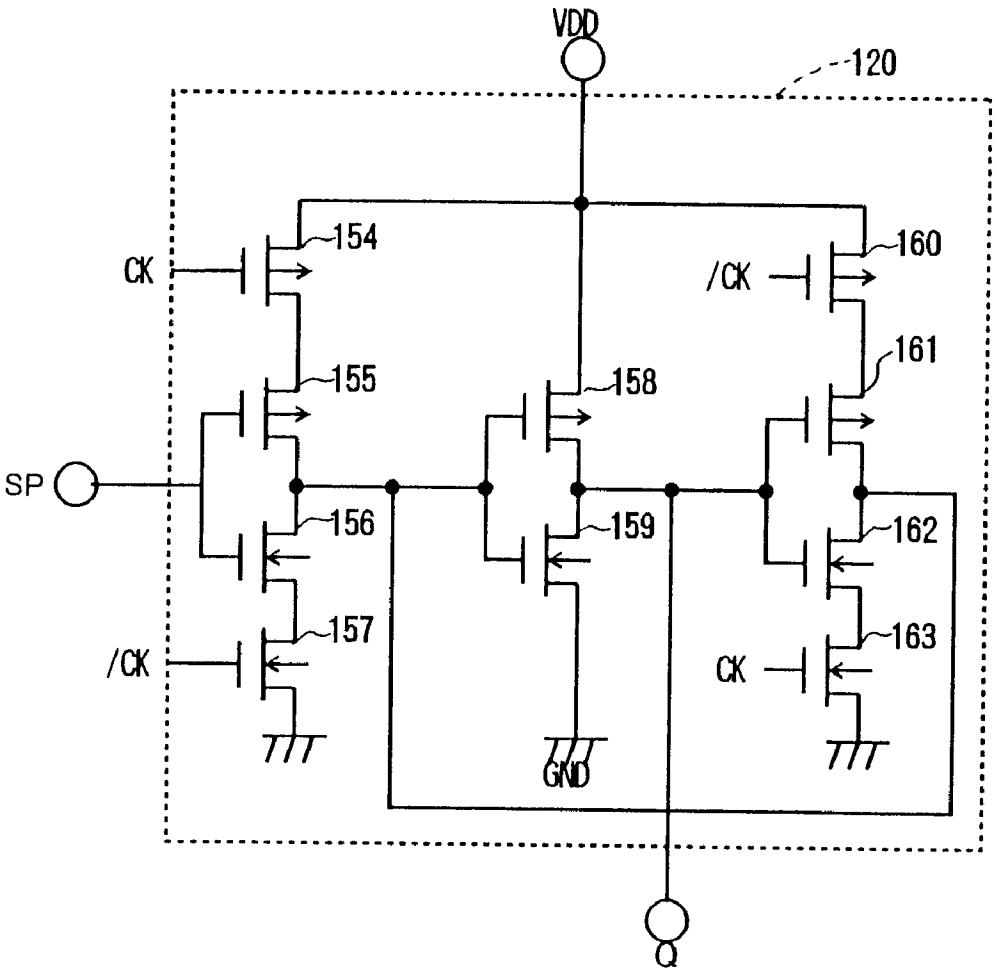
FIG. 9 is a circuit diagram of a D-type flip-flop.
Figure 10:
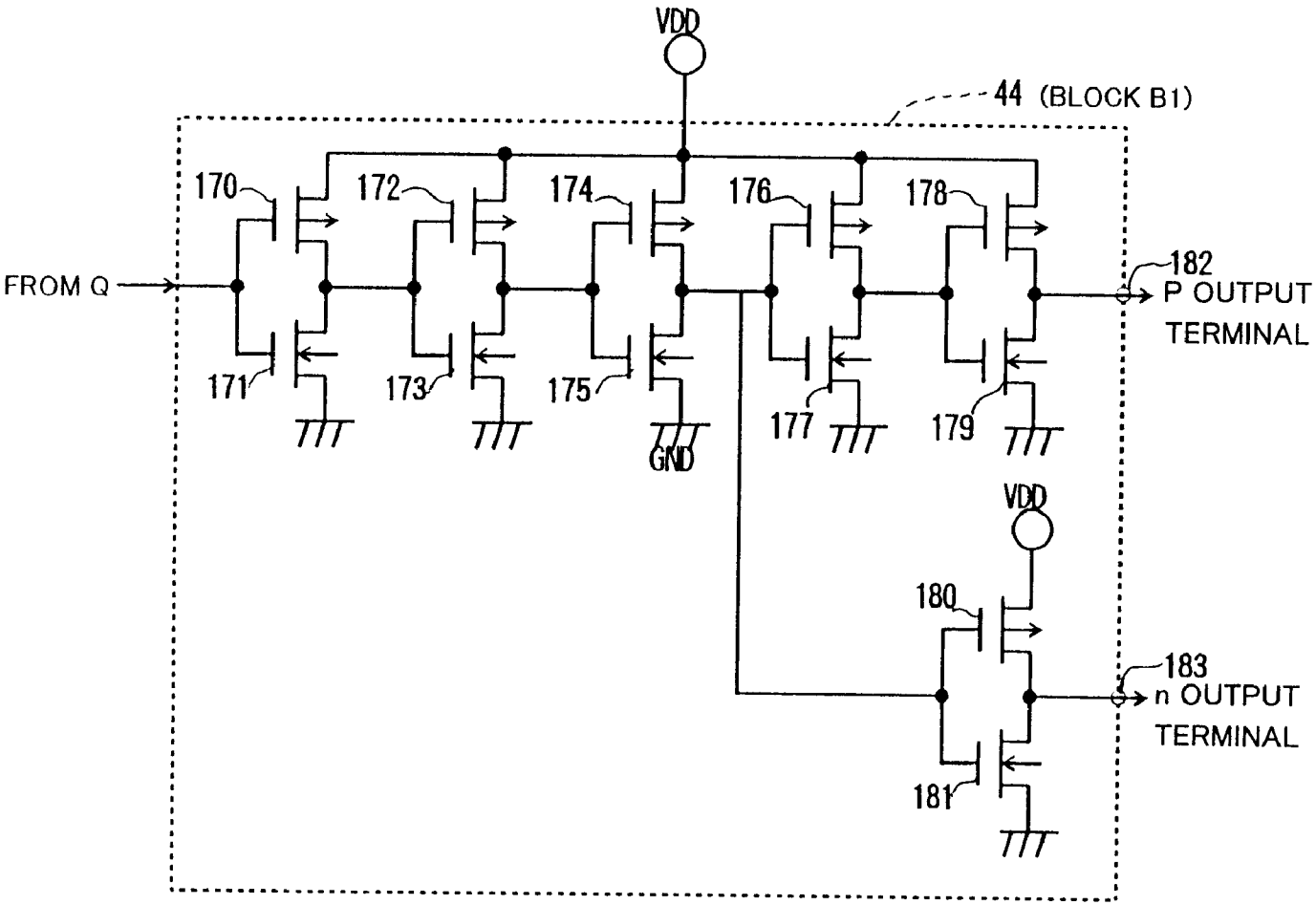
FIG. 10 is a circuit diagram of an inverter in the buffer circuit.

FIG. 9 is a circuit diagram of the D-type flip-flop 120 shown in FIG. 8. FIG. 10 is a circuit diagram of the inverters 130, 131, . . . , 135 of the buffer circuit 544 associated with the block B1.

As shown in FIG. 9, the flip-flop 120 is made up of transistors 154, 155, . . . , 163. As shown in FIG. 10, the inverters 130, 131, . . . , 135 are made up of pairs of transistors 170 and 171, 172 and 173, . . . , and 180 and 181. The start pulse SP is applied to the gates of the transistors 155 and 156 of the flip-flop 120 shown in FIG. 9. The output signal of the flip-flop 120 is applied to the gates of the transistors 170 and 171 forming the buffer circuit 544. The block control signal BL includes complementary signals that are respectively output via a P output terminal 182 and an N output terminal 183 of the buffer circuit 544 shown in FIG. 10, and are applied to the analog switches 514 of the block B1 of the display part 518.

Figure 11:
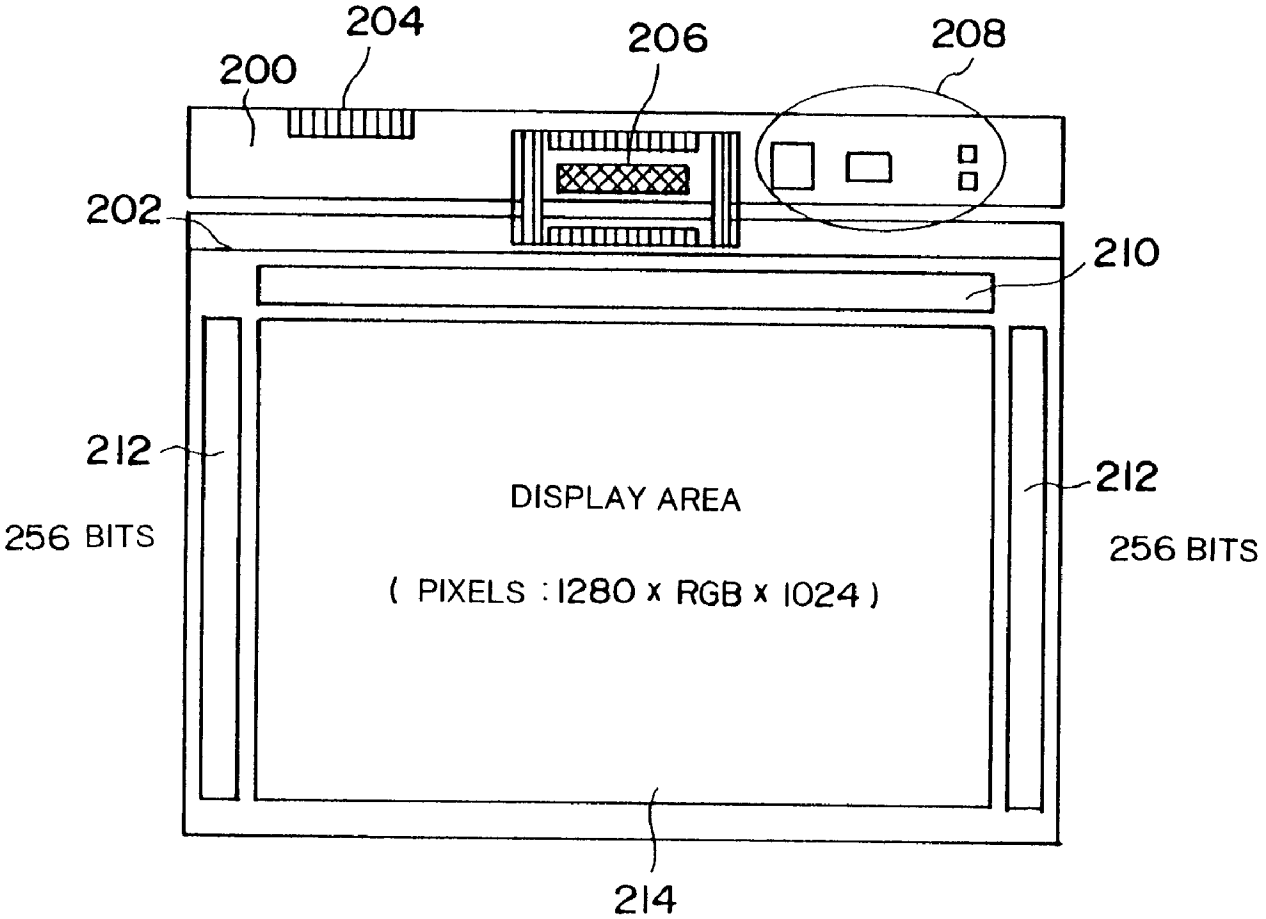
FIG. 11 is a plan view of the liquid crystal display device shown in FIG. 5.

FIG. 11 is a plan view of the liquid crystal display device 540. As shown in FIG. 11, the liquid crystal display device 540 is made up of a printed-circuit board 200, a common board 202, a connector 204, a TAB-IC device 206, a control circuit 208, a data driver 210, two 256-bit gate drivers 212, and a display area 214. The gate drivers 212 are arranged on opposite sides of the device 540.

The TAB-IC device 206 is an IC chip having the function of the line-sequential driver IC 512 shown in FIG. 1. The data driver 210 includes the shift register circuit 542, the buffer circuit 544 and the analog switches 514. The gate driver 212 and the display area 214 respectively correspond to the gate driver circuit 516 and the display part 518.

The control circuit 208 is formed on the printed-circuit board 200. The control circuit 208 includes a gate array, a line memory and a timing circuit, and controls the parts of the liquid crystal display device 540. The printed-circuit board 200 is flush with the display area 214. Hence, the liquid crystal display device 540 can be made thin.

Figure 12:
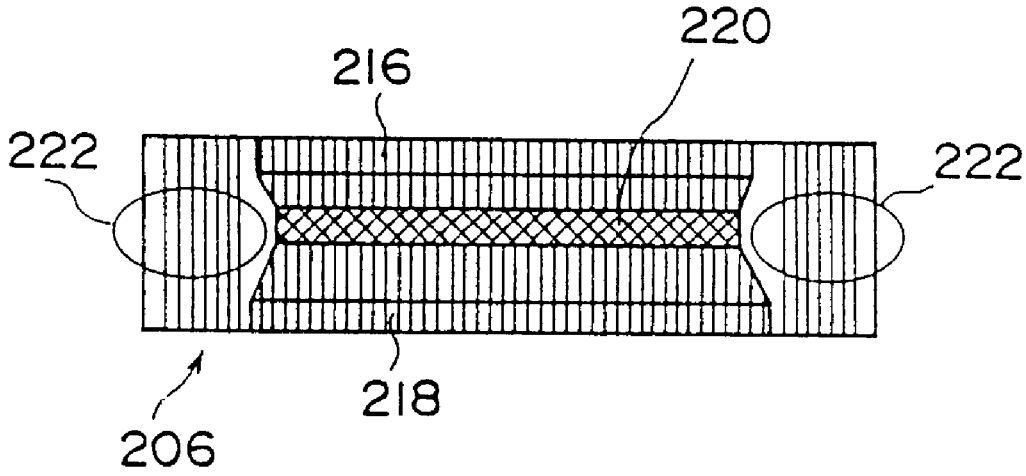
FIG. 12 is an enlarged view of a TAB-IC device.

FIG. 12 is an enlarged diagram of the TAB-IC device 206. AS shown in FIG. 12, the TAB-IC device 206 includes an input terminal part 216, an output terminal part 218, a driver IC chip 220 and through terminal parts 222. The through terminal parts 222 are directly connected to the gate driver 212 shown in FIG. 11 and the other associated parts.

The driver IC chip 220 is mounted on the TAB-IC device 206, but may be mounted in the COG (Chip On Glass) mount formation or TCP so that the chip 220 is directly mounted on the common substrate 202. In order to simply the terminal crimping step, the TAB-IC device 206 has through lines other than the common signal lines such as clock signal lines and control lines on the data and gate sides of the TAB-IC device 206, the above through lines being connected to the printed-circuit board 200. Hence, it is not necessary to provide any component such as a flexible printed-circuit board to the liquid crystal display device 540 in order to separately provide lines corresponding to the above through lines.

The digital signal applied to the line-sequential driver IC device 512 has an input amplitude of 2.5 V–3.8 V, and the analog signal output by the device 512 has an output amplitude of 7.5 V–16 V. Since the device 512 has a large dynamic range of the analog output signal, the device 512 can be applied to not only TN-type liquid crystal but also low-voltage-driven liquid crystal, vertical orientation liquid crystal, or an IPS (In-Plane Switching) panel liquid crystal.

Figure 13:
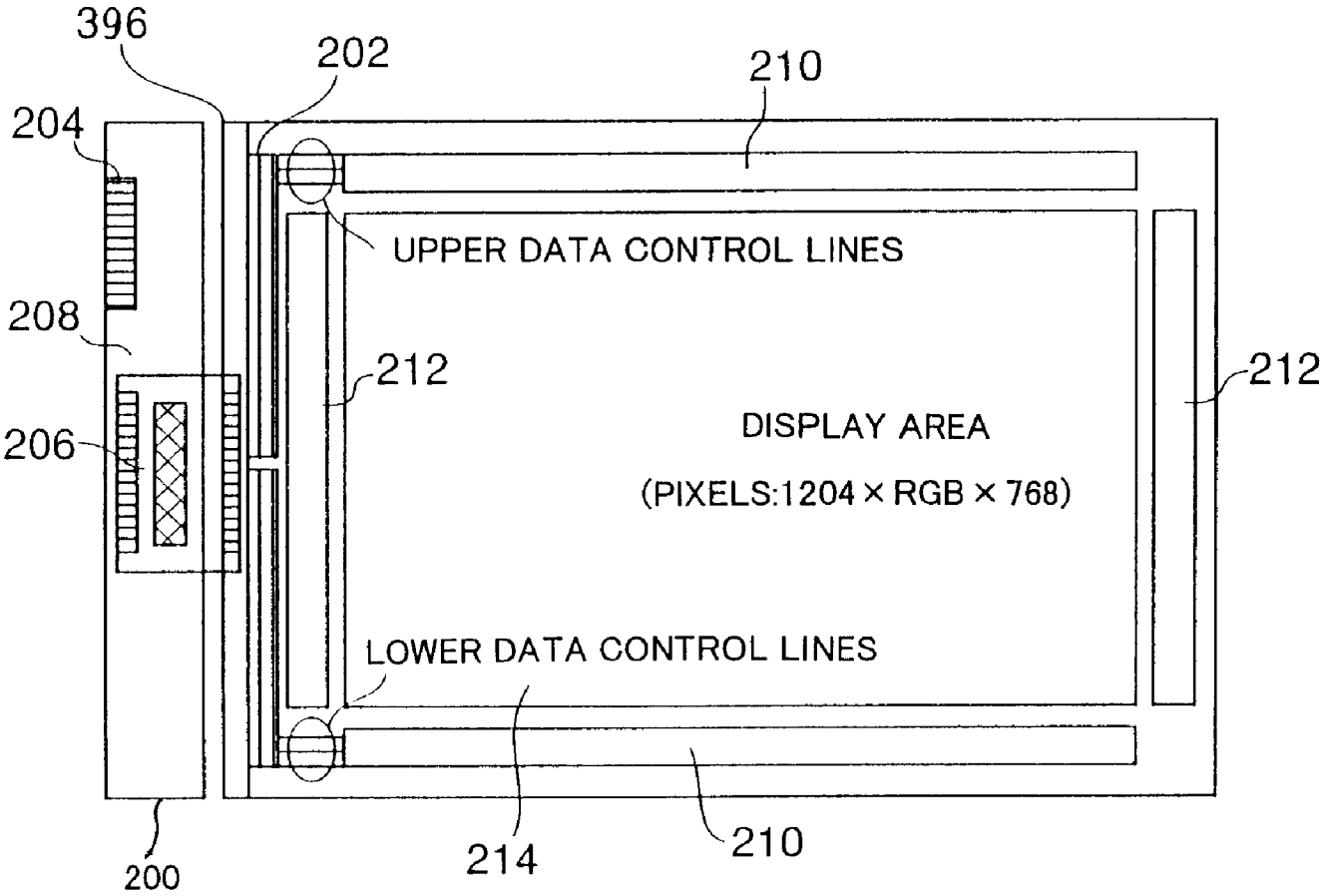
FIG. 13 is a plan view of a mounting arrangement of the liquid crystal display device.
Figure 14:
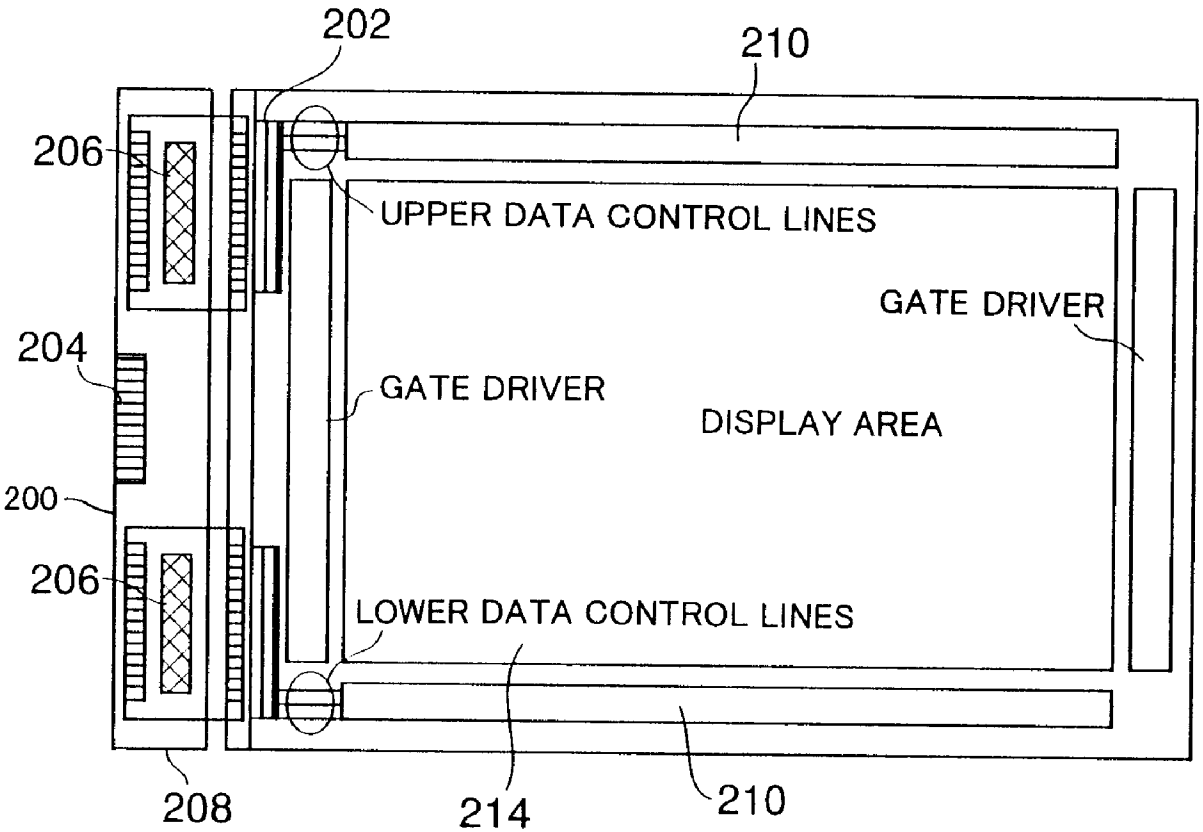
FIG. 14 is a plan view of another mounting arrangement of the liquid crystal display device.
Figure 15:
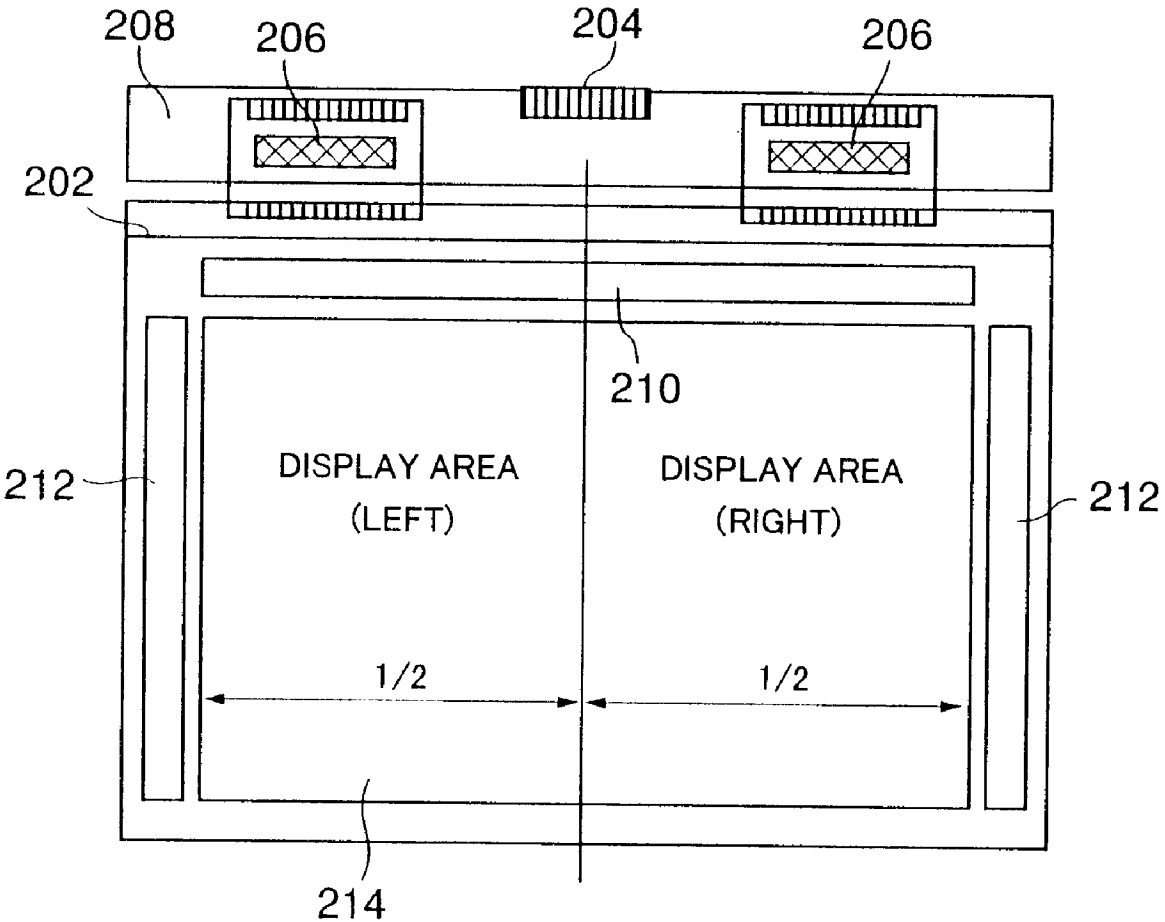
FIG. 15 is a plan view of yet another mounting arrangement of the liquid crystal display device.

FIGS. 13, 14 and 15 show another mounting arrangement of the liquid crystal display device 540, in which parts that are the same as those shown in FIG. 11 are given the same reference numbers.

The liquid crystal display device 540 shown in FIG. 13 employs a facing drive type system, in which the data driver 210 is divided into two parts, which are an upper part and a lower part. Hence, the upper area on a TFT substrate 396 for accommodating the peripheral circuits can be reduced. The printed-circuit board 200 is located on the left side of the device as shown in FIG. 13.

FIGS. 14 and 15 respectively show arrangements in which two TAB-IC devices 206 are used. The arrangements are effective to liquid crystal display devices of a relatively large size. By using two TAB-IC devices 206, each of the devices 206 is not required to have a capability as high as that needed when only one device 206 is used. Further, it is possible to reduce the loads of the common signal lines. Particularly, it is advantageous to use two or more line-sequential driver IC devices 412 to form large-size highly precise panels such as a USGA panel having 1600×1200 pixels and a QXGA panel having 2048×1536 pixels. Hence, the number of bits of each block can be increased to thereby lengthen the data write time, and the time constants of the common signal lines can be reduced. Further, down sizing of the panel can be realized.

Figure 26:
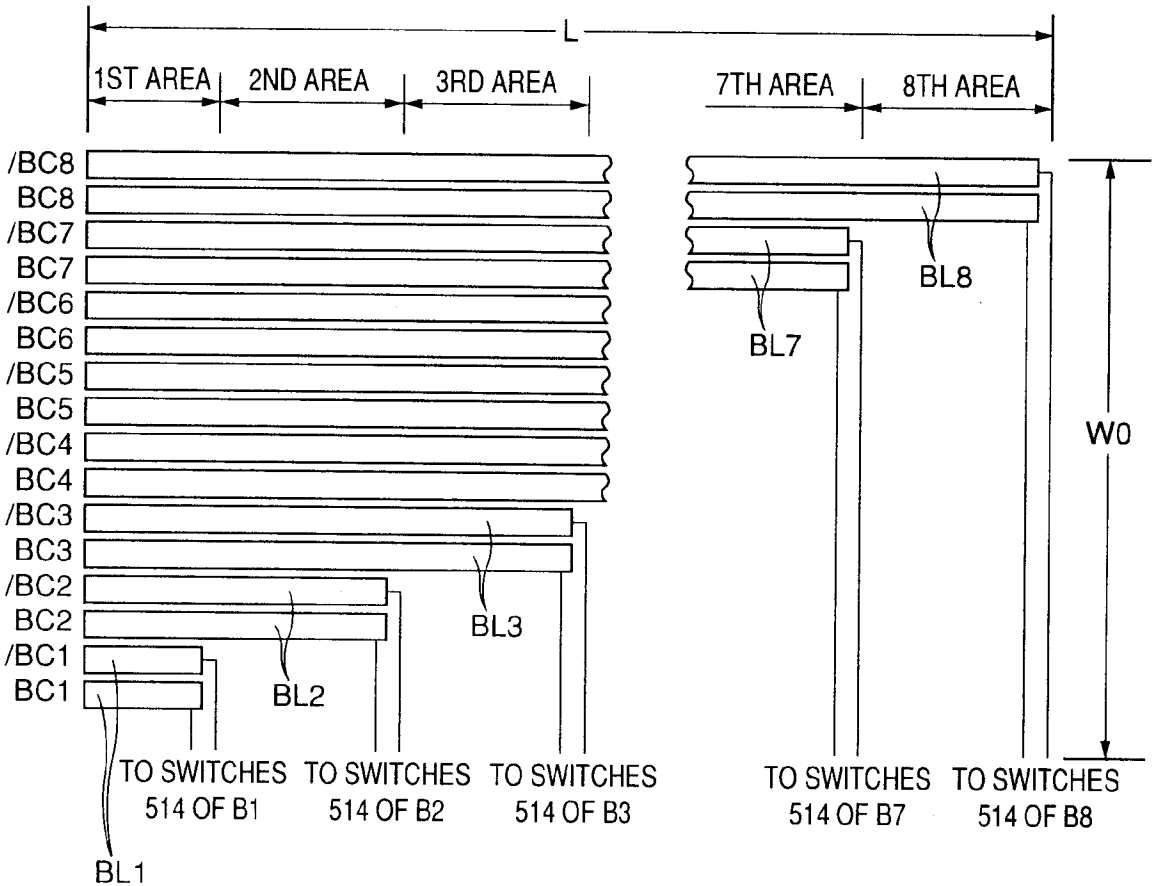
FIG. 26 is a schematic diagram illustrating a wiring pattern of block control lines formed on the panel shown in FIG. 1.
Figure 27:
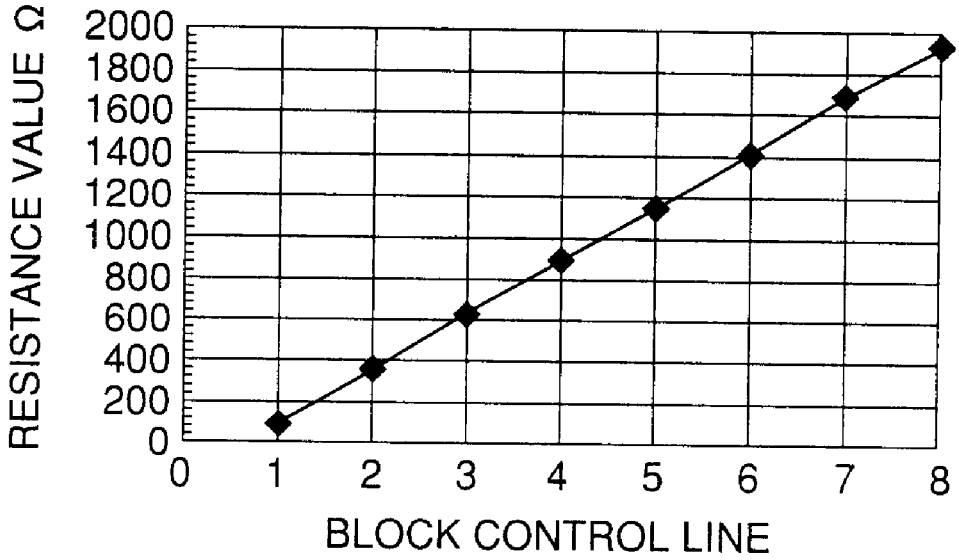
FIG. 27 is a diagram showing resistance values of the block control lines of the conventional liquid crystal display device.

Table 2 shows data applied to the data drivers 210 in the arrangements shown in FIGS. 13, 26 and 27.

TABLE 2

| | upper (left) data driver | lower (right) data driver |
|---|---|---|
| A | odd line data | even line data |
| B | odd pixel RGB data | even pixel RGB data |
| C | data of first half of block | data of second half of block |
| D | arbitrary group 1 | arbitrary group 2 |

It is possible to employ an arrangement in which each of the line-sequential driver IC devices 512 are respectively connected to a respective group of common signal lines. That is, the upper (left) common signal lines are not required to be connected to the lower (right) common signal lines. The analog switches formed of p-channel polysilicon TFTs may be replaced by electronic circuits having a switching function such as operational amplifiers.

By the way, if the liquid crystal display device using the low-temperature p-channel polysilicon TFTs can be modified so that the panel size can be reduced by narrowing the pixel pitch, the liquid crystal display devices can be produced at a reduced cost and a high yield. However, the low-temperature p-channel polysilicon TFTs have a large design rule. This prevents the pixel pitch from being reduced. In addition, it may be difficult to arrange the peripheral circuits in the peripheral areas on the substrate if the pixel pitch is narrow.

With the above in mind, a liquid crystal display device 340 which will be described below employs two-bit analog switches 314 each having a single common input terminal and operates in a block-sequential drive formation. The above structure makes it possible to narrow the pixel pitch.

Figure 16:
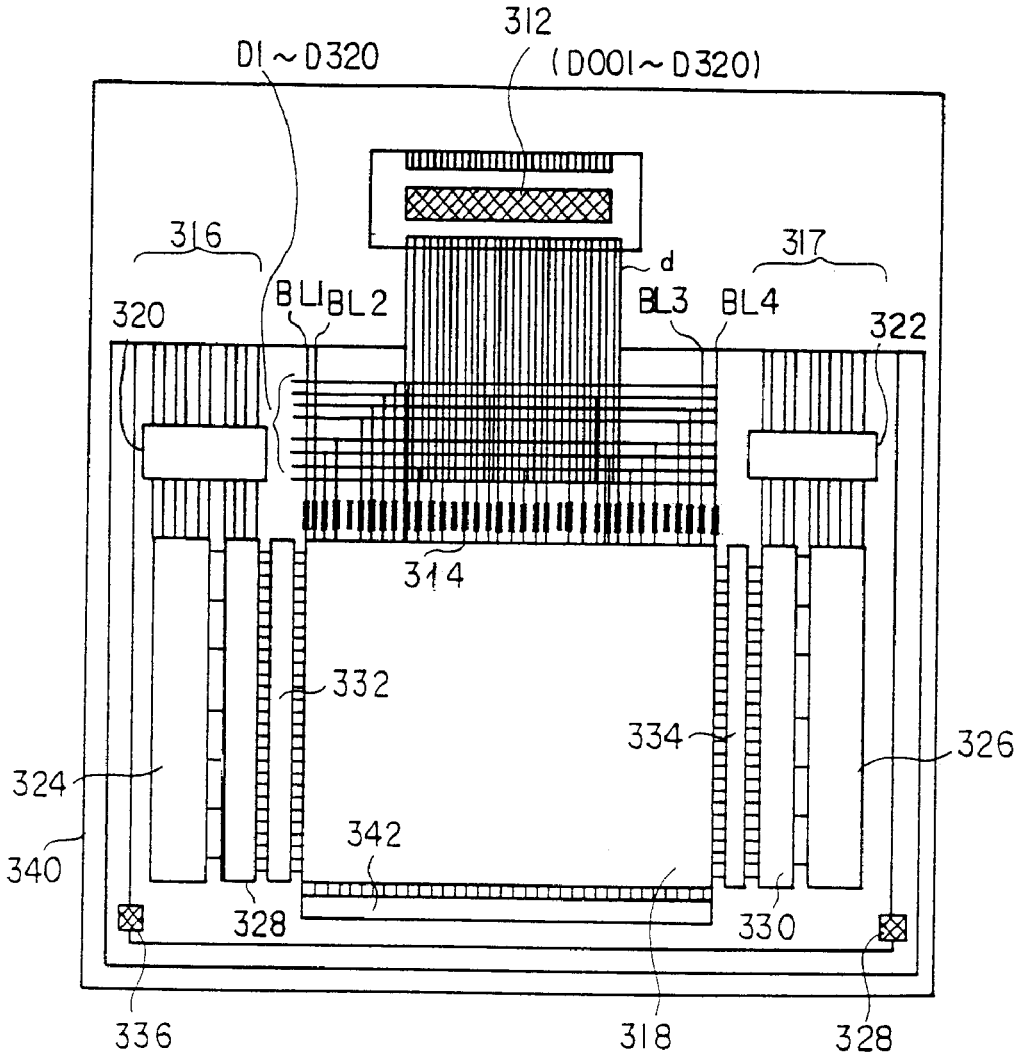
FIG. 16 is a block diagram of a liquid crystal display device according to a second embodiment of the present invention.

FIG. 16 is a block diagram of the liquid crystal display device 340 according to a second embodiment of the present invention. More particularly, the device shown in FIG. 16 is a 1.8-inch-reflection-type projection liquid crystal display device integrated with peripheral circuits.

As shown in FIG. 16, the liquid crystal display device 340 includes a line-sequential driver IC device 312, the analog switches 314, the gate drivers 316 and 317, the display part 318, common electrodes 336 and 338, and an static electricity prevention part 342.

The gate driver 316 located on the left side includes a level shifter 320, a 256-bit shift register 324, a four-bit multiplexer 328, and a buffer 332. The gate driver 317 located on the right side includes a level shifter 322, a 256-bit shift register 326, a four-bit multiplexer 330 and a buffer 334.

The display part 318 has 1024 scan lines and 1280 signal lines. The display part 318 is divided into four blocks B1–B4.

The device shown in FIG. 16 has 1280 analog switches 314, each of which is an n-channel MOS TFT. The 1280 analog switches 314 are grouped into four groups each having 320 analog switches 314. The four groups of the analog switches 314 respectively correspond to the blocks B1–B4.

The 320 analog switches 314 corresponding to the block B1 are respectively connected to odd-numbered signal lines among signal lines #1–#640 arranged on the left half area of the display part 318. The 320 analog switches 314 corresponding to the block B2 are respectively connected to odd-numbered signal lines among signal lines #641–#1280 arranged on the right half area of the display part 318. The 320 analog switches 314 corresponding to the block B3 are respectively connected to even-numbered signal lines among signal lines #1–#640. The 320 analog switches 314 corresponding to the block B4 are respectively connected to even-numbered signal lines among signal lines #641–#1280. The block control lines BL1–BL4 are connected to the corresponding analog switches 314.

The analog switches 314 are controlled by the block control signals BL transferred over the block control lines BL1–BL4 from the block control signal generating circuit (not shown) externally provided. Each of the analog switches 314 may be a p-channel MOS TFT. The block signal generating circuit may be made up of a four-stage shift register circuit and a buffer circuit, which may be provided within the liquid crystal display device 340.

The line-sequential driver IC device 312 of the 320-bit structure is arranged in an end portion of the device 340, and is coupled to the common signal lines D1–D320 via signal lines extending therefrom vertically. The line-sequential driver IC device 312 has an output resistance RIC less than 10 kΩ in order to reduce the rising time and the falling time of the display signals D at the time of wiring data. The common signal lines D1–D320 are connected to the analog switches 314.

Figure 17:
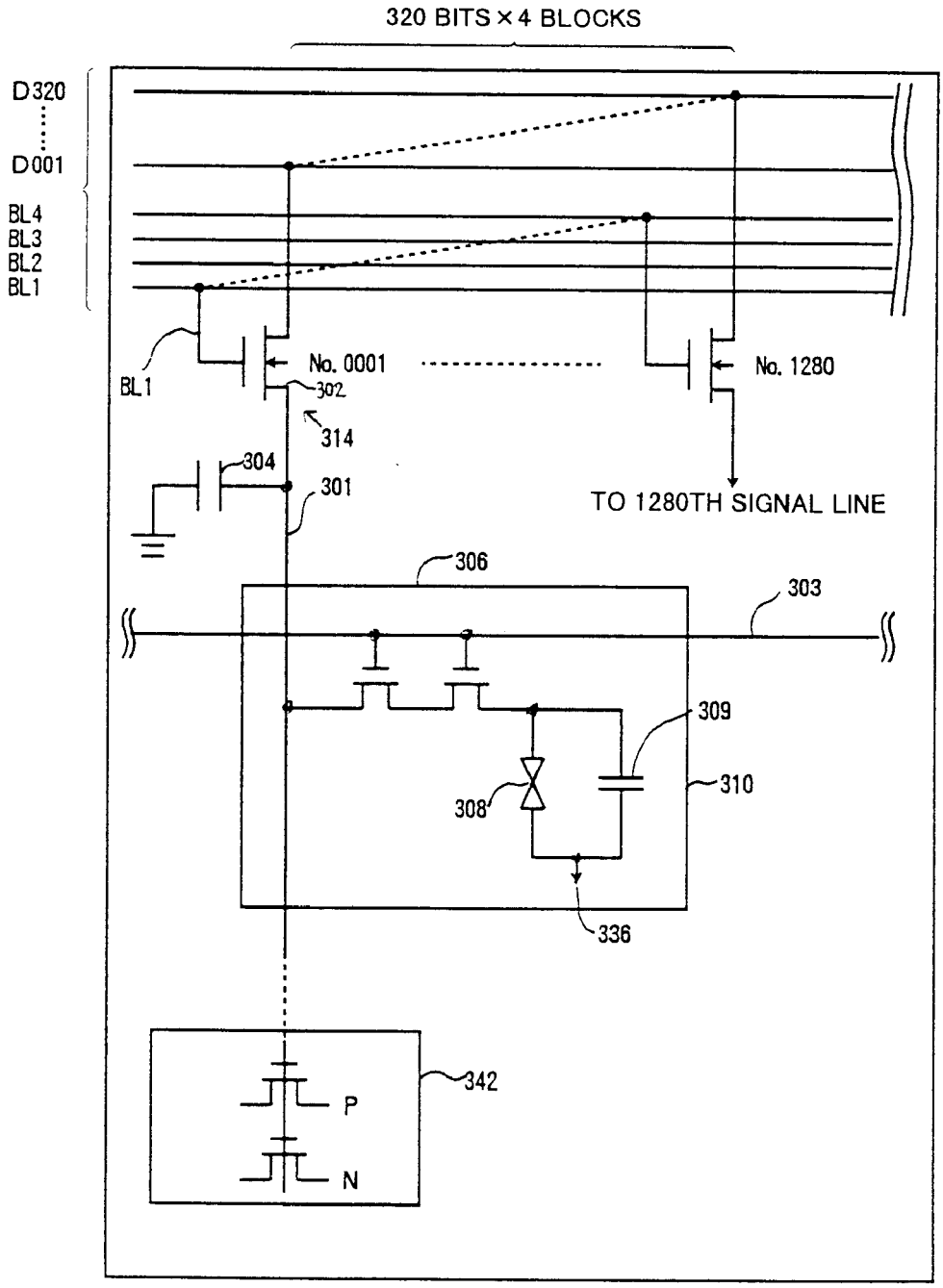
FIG. 17 is an equivalent circuit diagram of analog switches and cells used in the second embodiment of the present invention.

FIG. 17 is an equivalent circuit diagram of the analog switches 314 and one cell 310 provided in the display part 318. The analog switch 314 made up of a transistor 302 and a sampling capacitance 304 is connected to signal line (#1) 301 related to the block B1. The cell 310 and the static electricity prevention part 342 are connected to the signal line 301. The gate of the transistor 302 is supplied with the block control signal BL transferred over the block control line BL1. When the transistor 302 is turned on, the display signal D transferred over the common signal line D1 is applied to the cell 310 via the transistor 302. The cell 310 includes a dual-gate TFT 306 formed of a low-temperature p-channel TFT, a liquid crystal layer 308, and a storage capacitance 309. When the gate scan signal G is applied to the two gate terminals of the dual-gate TFT 306 from the scan line 303, the TFT 306 is turned on and the display signal D is applied to the cell 310 from the signal line 301.

Figure 18:
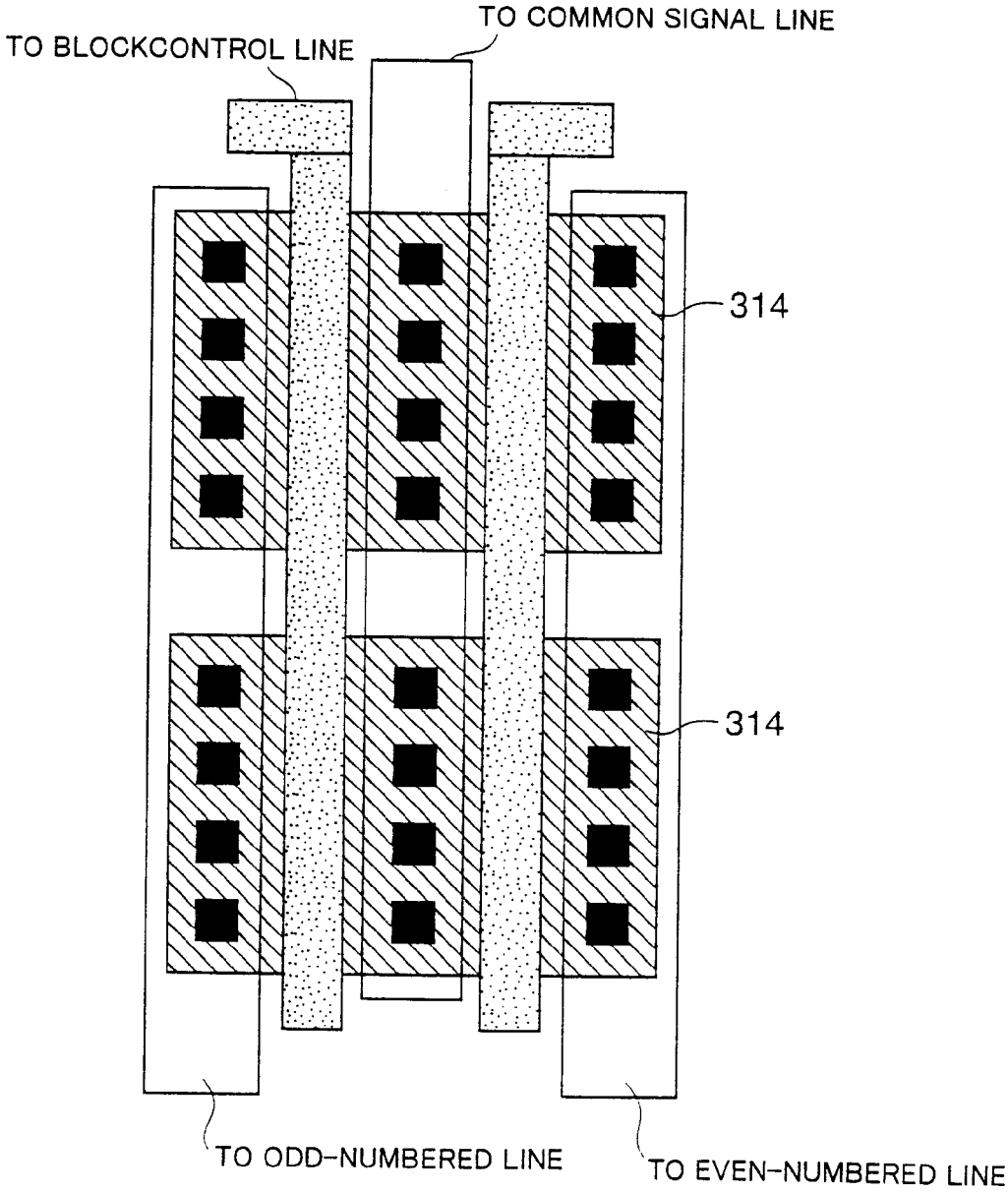
FIG. 18 is an enlarged plan view of a layout of analog switches.

FIG. 18 shows a layout of the analog switches 314 using a 4 μm design rule. As shown in FIG. 18, two neighboring analog switches 314 are paired. The input terminals of the two analog switches 314 are connected to a single common signal line. The output terminals of the two analog switches 314 are respectively connected to the corresponding odd-numbered and even-numbered signal lines. The two analog switches 314 are connected to the block control lines BL1 and BL3 or BL2 and BL4. One of the two analog switches 314 connected to the odd-numbered or even-numbered signal line is selected by the two block control lines. Then, the display data D is applied to the display part 318 via the selected analog switch 314.

As described above, two analog switches 314 are paired and share one display signal input terminal, while having the respective output terminals connected to the signal lines of the display part 318. Hence, the analog switches 314 can be arranged at a narrow pitch of 28 μm. Further, the number of input signal lines connected to the analog switches 314 can be reduced to the half, so that the input signal lines arranged at the different layer levels cross each other at a reduced number of cross points. Hence, a signal delay caused by a parasitic capacitance of the analog switch part 314 can be reduced and the yield can be improved.

Figure 19:
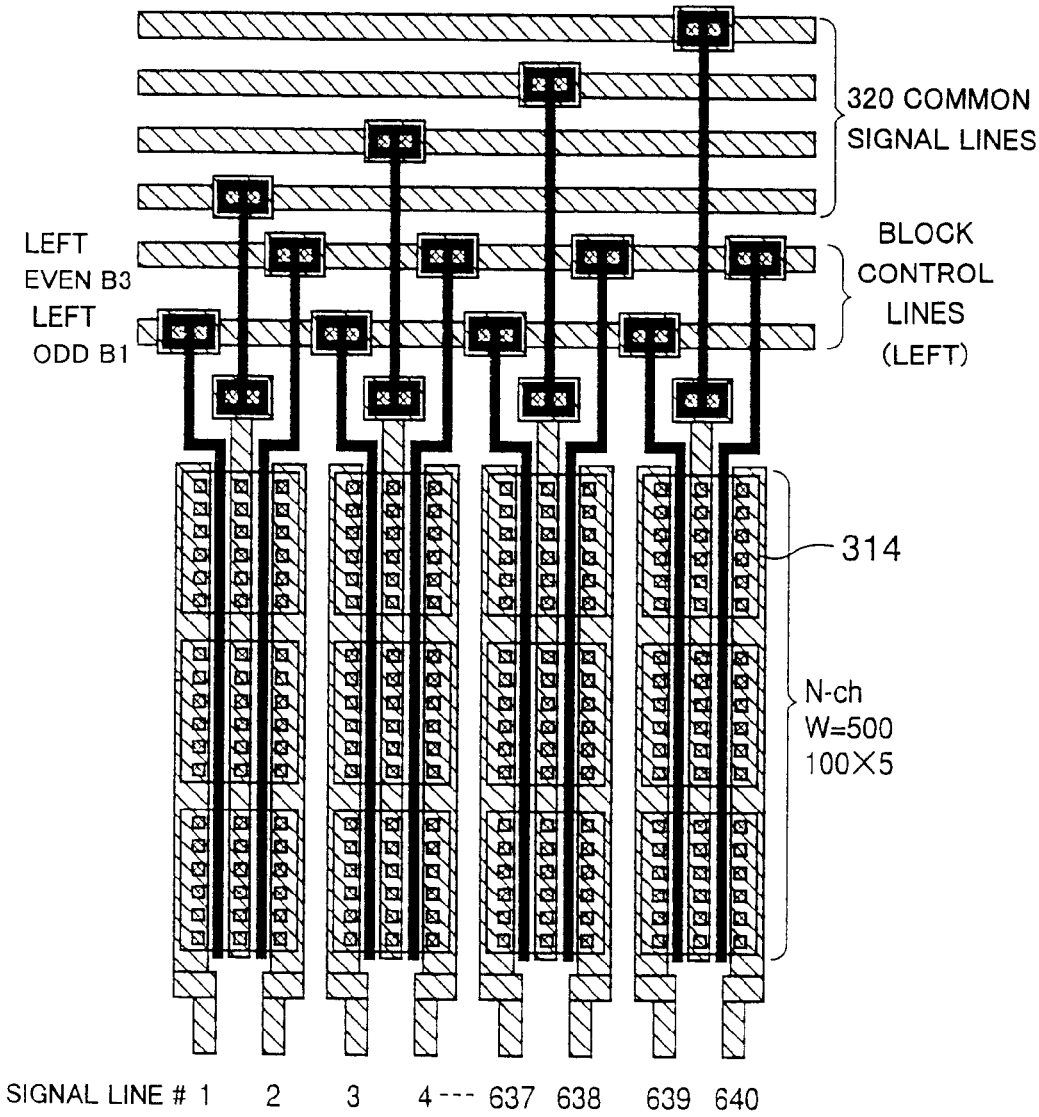
FIG. 19 shows connections made between analog switches located on a left half of a display part and common signal lines.

FIG. 19 illustrates connections between the analog switches 314 equal to 640 bits and arranged on the left half of the display part 318 and the 320 common signal lines.

Figure 20:
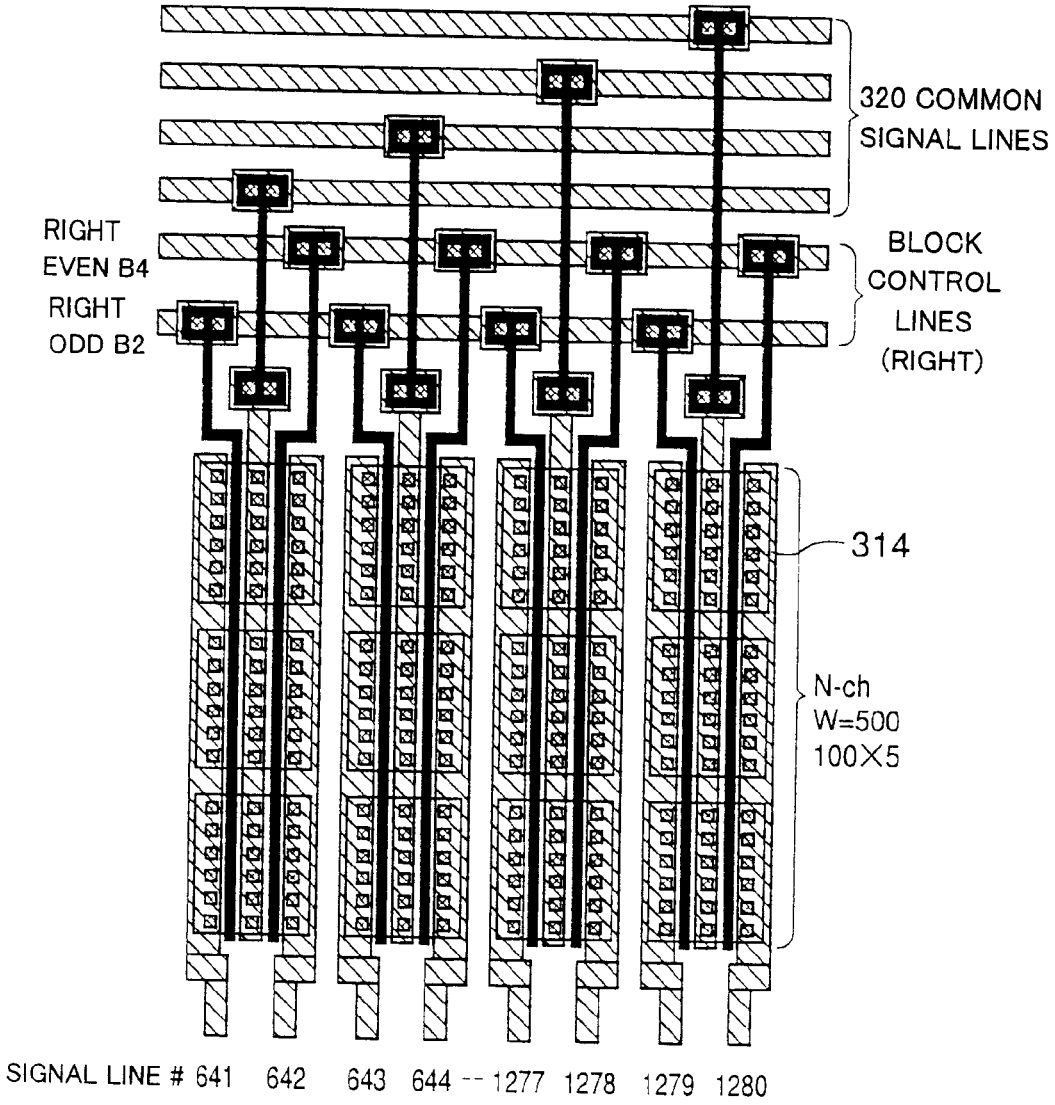
FIG. 20 shows connections made between analog switches located on a right half of a display part and common signal lines.
Figure 21:
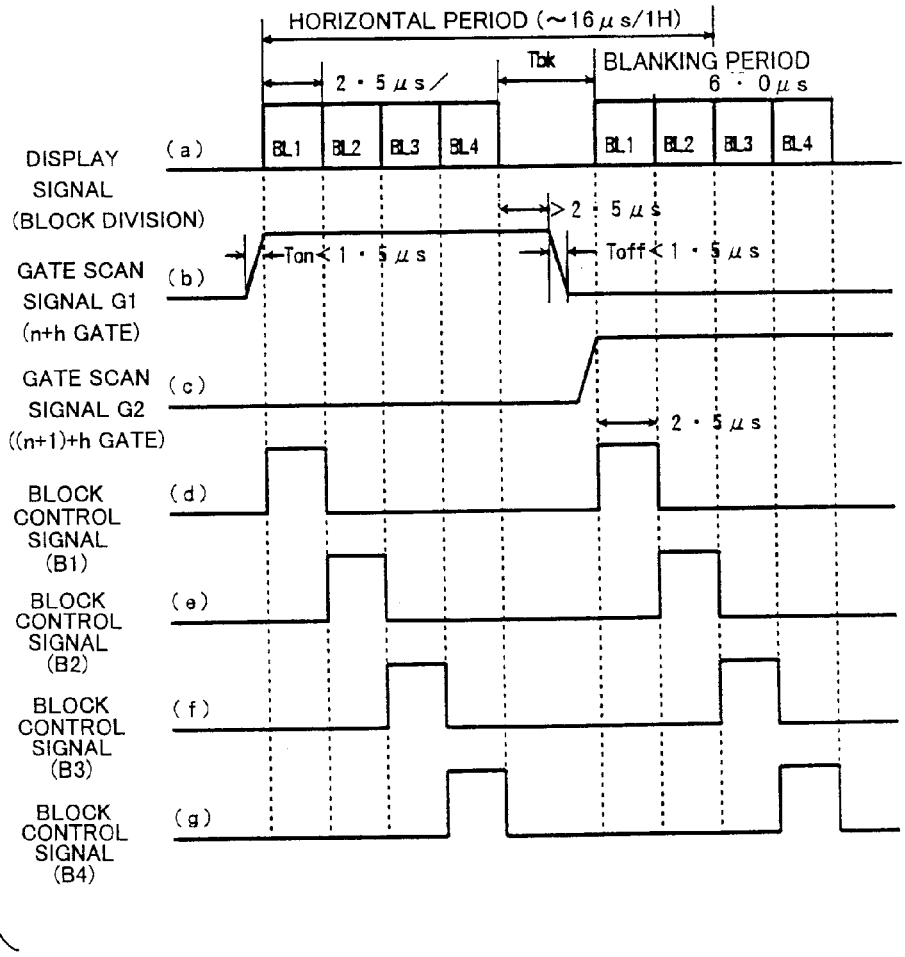
FIG. 21 is a timing chart of an operation of the liquid crystal display device shown in FIG. 16.

FIG. 20 illustrates connections between the analog switches 314 equal to 640 bits and arranged on the right half side and the 320 common signal lines. FIG. 21 is a timing chart of the display signals D, gate scan signals G1 and G2 and the block control signals BL applied to the blocks B1–B4 applied to the liquid crystal display device 340.

As shown in parts (a) through (g) of FIG. 21, the gate scan signal G1 of the high level is applied to the first gate of the display part 318 from the gate driver circuit 316. Then, the block control signal BL, which is maintained at the high level for only the period Tb (for example, 2.5 μs) is applied to the analog switches 314 of the block B1, which switches are turned on. Then, the display signals D transferred over the common signal lines D1–D320 are applied, for only the period Tb, to the cells 310 connected to the odd-numbered signal lines related to the block B1 among signal lines #1–#640 arranged on the left half of the display part 318 via the analog switches 314.

Then, the block control signal BL, which is maintained at the high level for only the period Tb is applied to the analog switches 314 of the block B2, which switches are thus turned on. Then, the display signals D transferred over the common signal lines D1–D320 are applied, for only the period Tb, to the cells 310 connected to the odd-numbered signal lines related to the block B1 among signal lines #641–#1280 arranged on the right half of the display part 318 via the analog switches 314.

Then, the block control signal BL, which is maintained at the high level for only the period Tb is applied to the analog switches 314 of the block B3, which switches are thus turned on. Then, the display signals D transferred over the common signal lines D1–D320 are applied, for only the period Tb, to the cells 310 connected to the even-numbered signal lines related to the block B1 among signal lines #1–#640 arranged on the left half of the display part 318 via the analog switches 314.

Then, the block control signal BL, which is maintained at the high level for only the period Tb is applied to the analog switches 314 of the block B4, which switches are thus turned on. Then, the display signals D transferred over the common signal lines D1–D320 are applied, for only the period Tb, to the cells 310 connected to the even-numbered signal lines related to the block B1 among signal lines #641–#1280 arranged on the right half of the display part 318 via the analog switches 314.

In the above manner, data are written into the cells of the blocks B1–B4.

Then, the operation enters into the blanking period Tbk, which may be 6.0 μs. When a time equal to or longer than 2.5 μs after the blanking period Tbk starts, the gate scan signal G is switched to the low level. When the blanking period Tbk ends, the horizontal scan period Th ends. The length of the horizontal scan period Th is equal to, for example, 16 μs.

Then, the high-level gate scan signal G2 is applied to the second gate of the display part 318 from the gate driver circuit 316, and the display signals D are applied in the same manner as described above. The rising time Ton and the falling time Toff of the gate scan signal is shorter than 1.5 μs.

In the general line-sequential drive method, the number of all bits of the driver IC device is equal to the number of pixels arranged in the horizontal direction. Hence, the output terminals of the driver IC device are arranged at the same pitch as the pitch at which the pixels are arranged in the horizontal direction. Due to a limitation on the pitch of the arrangement of the output terminals of the driver IC device, it is very difficult to realize a narrow pixel pitch equal to 20–30 μm.

In contrast, the liquid crystal display device 340 is configured so that the single line-sequential drive IC device 312 selects the combinations of the common signal lines and the block control lines BL1–BL4 in the time division formation and the display signals D thus controlled are applied to the display part 318. Hence, it is possible to reduce the space for mounting the IC driver 312 to a reciprocal of the number of blocks. Hence, the pixel pitch of the display part 318 can be reduced. Further, as shown in FIGS. 16 and 17, the data drive circuit can be simplified, so that the liquid crystal display device 340 has improved reliability and can be produced at a low cost.

The block control period Tb is not limited to the above-mentioned length, but may be selected as long as the concept of the invention is satisfied.

Figure 22:
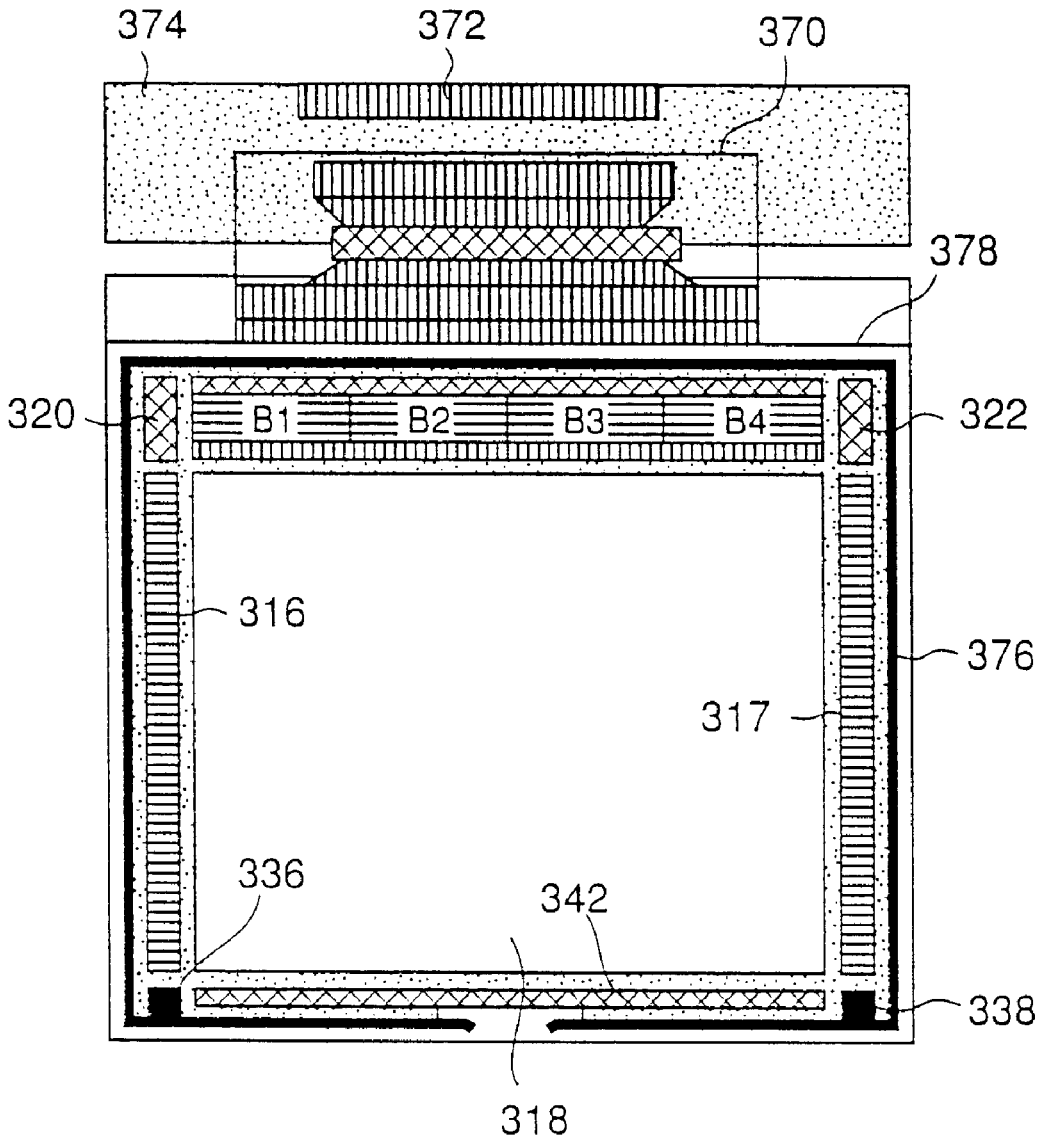
FIG. 22 is a plan view of a mounting arrangement of the device according to the second embodiment of the present invention.
Figure 23:
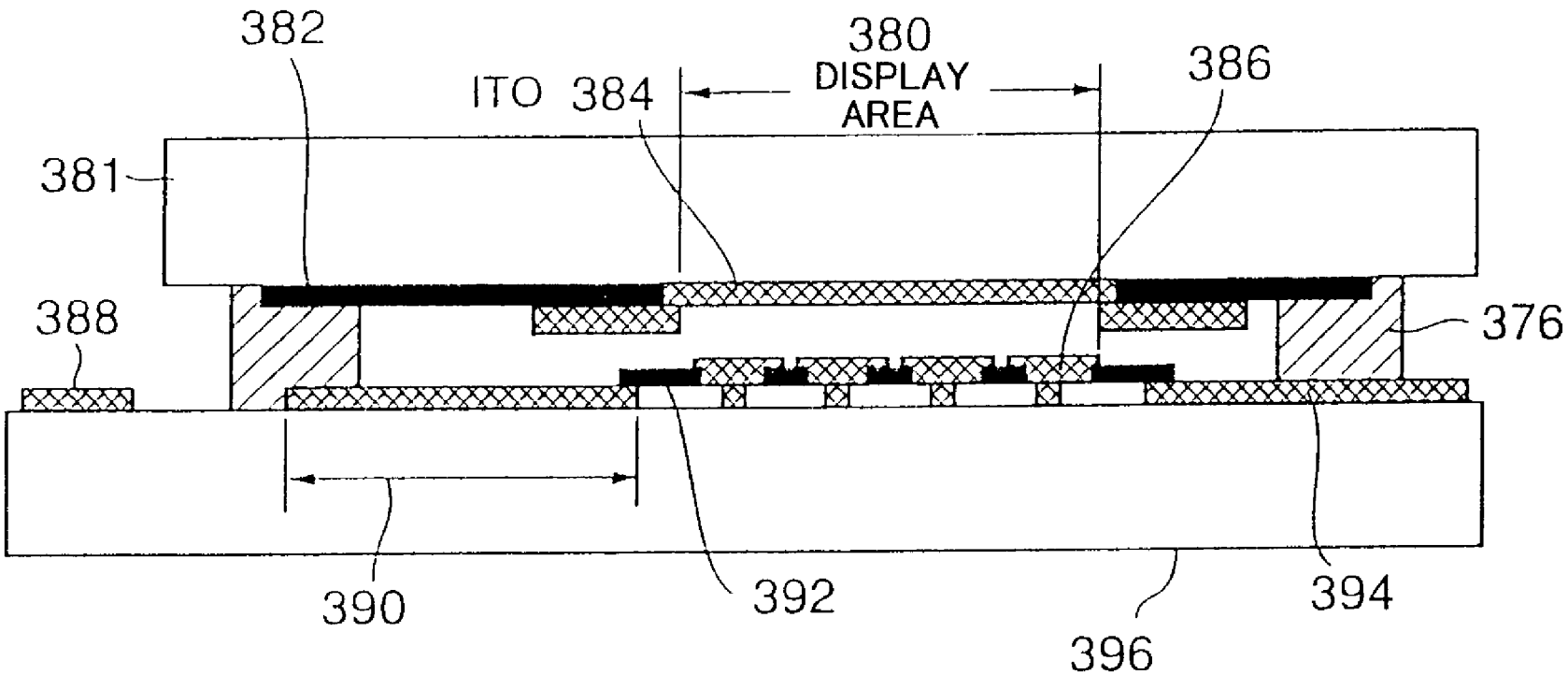
FIG. 23 is a cross-sectional view of the structure shown in FIG. 22.

FIGS. 22 and 23 are respectively a plan view and cross-sectional view of a practical structure of the liquid crystal display device 340. As shown in FIG. 22, the liquid crystal display device 340 includes the level shifters 320 and 322, the gate drivers 316 and 317, the common electrodes 336 and 338, the static electricity prevention part 342, a TAB-IC device 370, a connector 372, a printed-circuit board 374, a seal member 376, a common substrate 378, and a display area 380. As shown in FIG. 23, the cross-section of the liquid crystal display device 340 includes a display area 380, a terminal 388, an opposed light shutting part 382, an ITO (Indium Tin Oxide) film 384, a reflection electrode 386, a terminal 388, a peripheral circuit part 390, a TFT-side light shutting film 392, a short-circuit ring 394, and an TFT substrate 396.

The TAB-IC device 370 is an IC chip which corresponds to the line-sequential driver IC device 312 shown in FIG. 16. The display area 380 corresponds to the display part 318 shown in FIG. 16. All the lead lines extending from the panel such as those from the gate drivers 316 and 317 and the common electrodes 336 and 338 are provided on the TAB-IC device 370. The input terminals of the TAB-IC device 370 are connected to the printed-circuit board 374.

Figure 24:
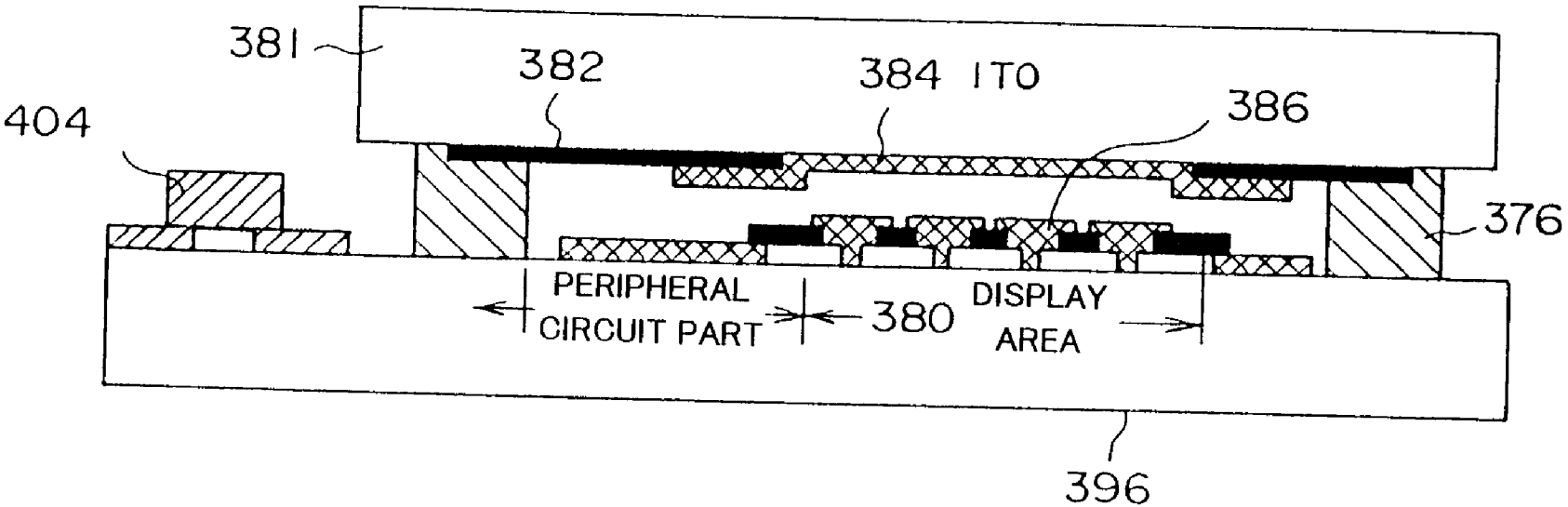
FIG. 24 is a cross-sectional view of another mounting arrangement of the device according to the second embodiment of the present invention.

FIG. 24 is a cross-sectional view of the liquid crystal display device 340 which employs the COG mounting method. As shown in FIG. 24, an IC chip 404 which is the line-sequential driver IC device is directly attached to the TFT substrate 396 in a crimp fashion. Hence, the projection panel of the device 340 can be miniaturized.

Figure 25:
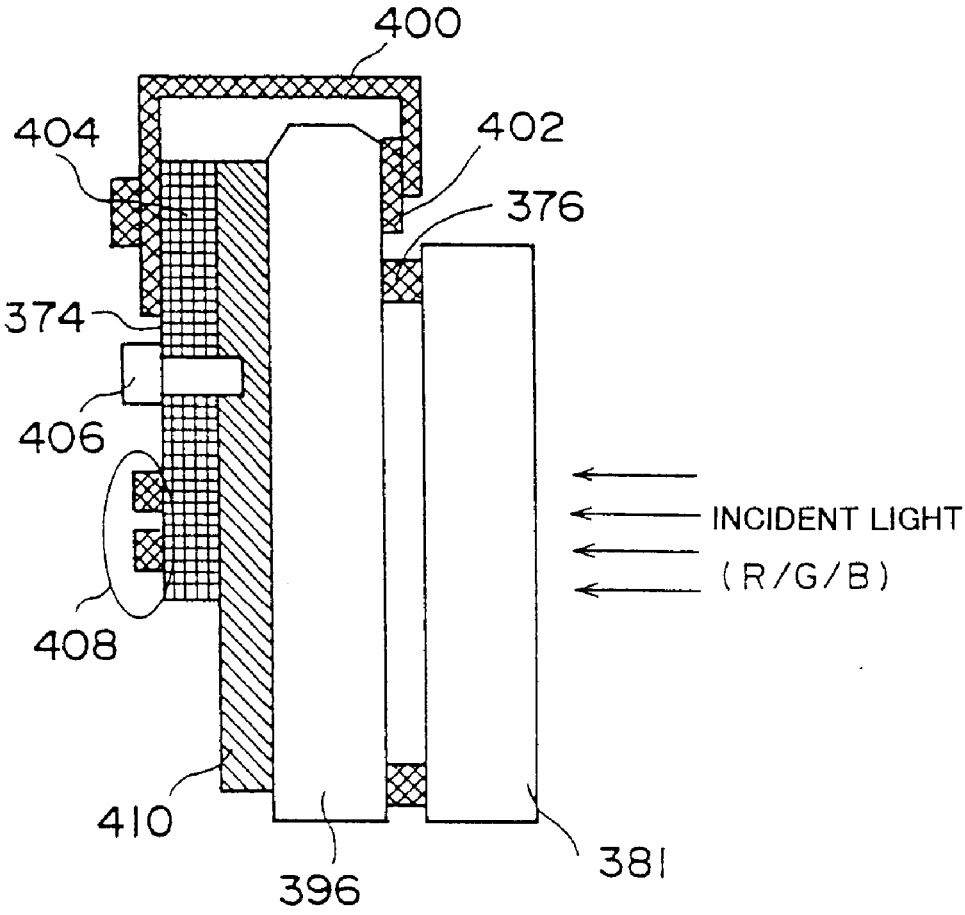
FIG. 25 is a cross-sectional view of yet another mounting arrangement of the device according to the second embodiment of the present invention.

FIG. 25 is a cross-sectional view of the periphery of the printed-circuit board 374 shown in FIG. 22. As shown in FIG. 25, in the periphery of the printed-circuit board 374, there are provided a TAB tape 400, an IC chip 404, a fixing screw 406, electronic components 408, and a heat sink 410. The TAB tape 400 is bent and input terminals thereof are attached to the printed-circuit board 374 in the crimp fashion. The printed-circuit board 374 and the TFT substrate 396 are fixed to the heat sink 410.

A description will now be given of a third embodiment of the present invention, which has improvements in the first embodiment of the present invention.

The above-mentioned liquid crystal display device according to the first and second embodiments of the present invention has a wiring pattern of the block control lines BL1–BL8 where n=8. As shown in FIG. 26, all the block control lines BL1–BL8 of the different blocks have an identical width, but have different lengths. Hence, the resistance values of the block control lines BL1–BL8 from the start points thereof to the end points are greatly different from each other on the block basis. It is assumed that the block control lines BL1–BL8 are arranged in a rectangular area having length L and width W0 and the rectangular area is segmented into eight areas respectively corresponding to the first block B1 to the eighth block B8.

Table 3 shows data obtained by calculating the resistance value of the block control lines BL1 (first block control line)–BL8 (eighth block control line) having a constant width in each of the segmented areas from the start points to the end points.

TABLE 3

| block | 1st area | 2nd area | 3rd area | 4th area | 5th area | 6th area | 7th area | 8th area | resistance Ω |
|---|---|---|---|---|---|---|---|---|---|
| 1st | 16.7 | | | | | | | | 127.5 |
| 2nd | 16.7 | 16.7 | | | | | | | 382.6 |
| 3rd | 16.7 | 16.7 | 16.7 | | | | | | 637.7 |
| 4th | 16.7 | 16.7 | 16.7 | 16.7 | | | | | 892.8 |
| 5th | 16.7 | 16.7 | 16.7 | 16.7 | 16.7 | | | | 1147.9 |
| 6th | 16.7 | 16.7 | 16.7 | 16.7 | 16.7 | 16.7 | | | 1403.0 |
| 7th | 16.7 | 16.7 | 16.7 | 16.7 | 16.7 | 16.7 | 16.7 | | 1658.1 |
| 8th | 16.7 | 16.7 | 16.7 | 16.7 | 16.7 | 16.7 | 16.7 | 16.7 | 1913.2 |

In the simulation, the width W0 of the rectangular area in which the block control lines BL1–BL8 are arranged is 387.2 μm, and the interval between the adjacent block control lines is equal to 8 μm. The first block control lines BL1 are supplied with the block control signal BL, namely, BC1 and /BC1. Similarly, the second through eighth block control lines 16 are supplied with the block control signals BC2 and /BC2 and BC8 and /BC8. In Table 3, the unit of the numeral values other than the resistance values is micron (μm).

FIG. 27 is a graph showing the resistance values of the first to eighth block control lines. As shown in Table 3 and FIG. 27, the block control lines in the different blocks have much different resistance values. The block control lines have a load which corresponds to the sum of the gate capacitance values of the 384 analog switches 514 of one block. The capacitance value of one analog switch 514 is approximately equal to 1 pF and the load per block is approximately equal to 384 pF. Hence, the signals transferred over the comparatively long block control lines BL1–BL8 are rounded. This causes a failure of display.

Further, the liquid crystal display devices according to the first and second embodiments of the present invention has an arrangement in which the analog switches 514 are required to have a comparatively wide channel width in order to complete write data into the pixels for a short time. Thus, it is required to provide a large area on the glass substrate for forming the analog switches 514.

Furthermore, a display failure may be caused to factors introduced during the fabrication process of the polysilicon TFTs and those related to driving of the TFTs.

In the following description, it is assumed, for the sake of simplicity, that the number of pixels of the panel arranged along the horizontal direction is 800×3 (R, G, B) and the number of pixels arranged in the vertical direction is 600.

Figure 28:
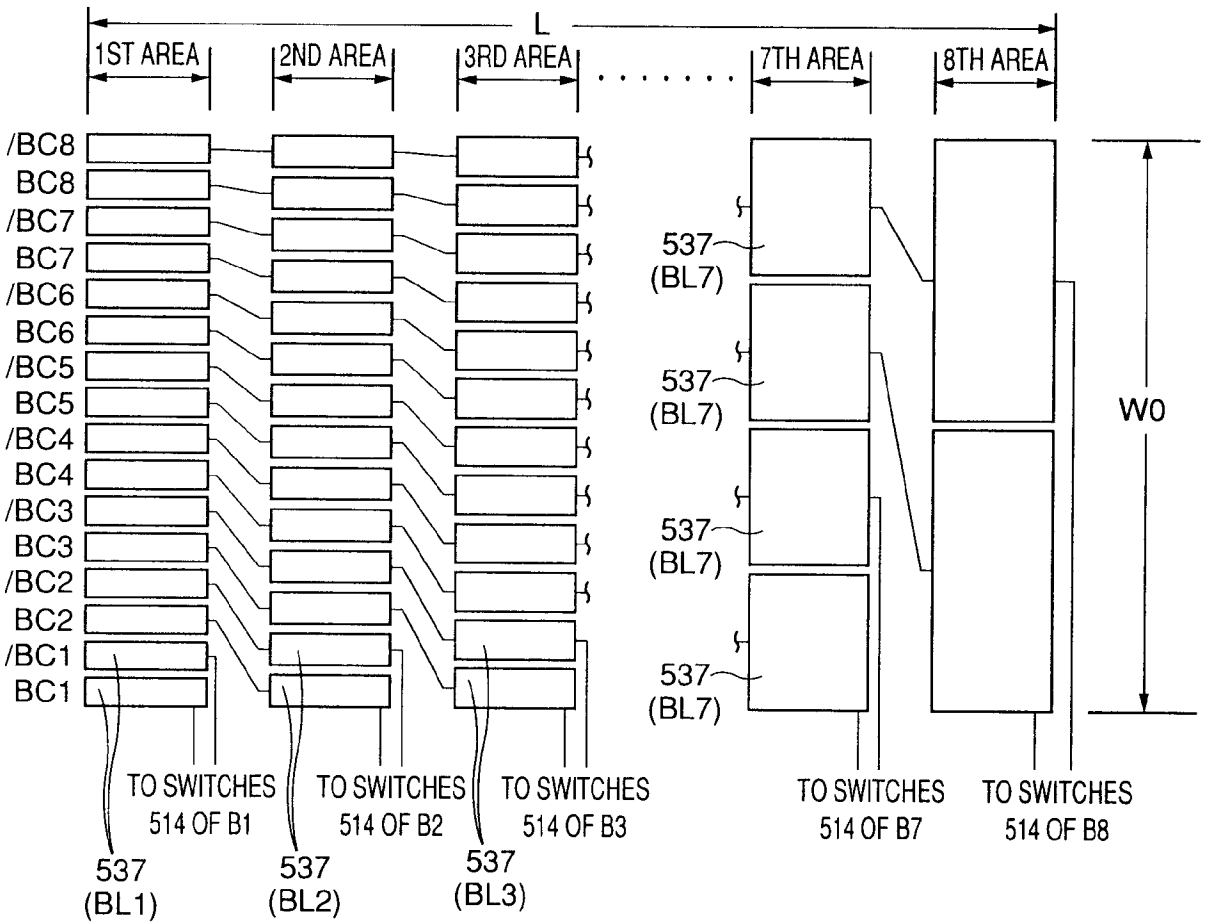
FIG. 28 is a plan view of a layout pattern of block control lines used in the third embodiment of the present invention.

As shown in FIG. 28, the block control lines 567 in each of the segmented areas corresponding to the blocks B1–B8 have a respective different width. More particularly, 16 block control lines 567 are arranged in the first block control line arranging area of the rectangular area (width W0 and length L) corresponding to the block B1. 14 block control lines are arranged in the second area corresponding to the block B2, and 12 block control lines are arranged in the third area corresponding to the third block B3. As described above, a reduced number of block control lines having an increased width is provided as the position of the block is closer to the right-hand side of the rectangular area.

In general, an expression described below is satisfied according to the third embodiment of the present invention:

$$w=(Wo-(n-1)S)/n$$

where Wo denotes a width of each of the segmented areas, w denotes a width of the block control lines, n denotes a number of block control lines, and S denotes an interval between adjacent ones of the block control lines.

In the third embodiment of the present invention, the adjacent areas are connected by lines having a comparatively narrow width. Such lines are extremely short, as compared to the whole lengths of the block control lines 567 (approximately 1/200). Hence, the narrow lines do not increase the resistance values of the block control lines. The lines interposed between the adjacent areas may be formed into a taper shape in which the widths of the lines decrease gradually.

Table 4 show examples of the widths of the block control lines in the first through eighth segmented areas and the respective resistance values. In Table 4, the first block control lines 567 are supplied with the block control signals BC1 and /BC1. Similarly, the second through eighth block control lines 567 are supplied with the block control signals BC2 and /BC2 through BC8 and /BC8. In Table 4, the unit of the numeral values other than the resistance values is micron (μm). The widths of the block control lines are calculated under the condition that the width WO of the rectangular area in which the block control lines 567 are arranged is approximately 380 μm and the interval between the adjacent block control lines is equal to 8 μm.

TABLE 4

| block | 1st area | 2nd area | 3rd area | 4th area | 5th area | 6th area | 7th area | 8th area | resistance Ω |
|---|---|---|---|---|---|---|---|---|---|
| 1st | 16.8 | | | | | | | | 63.4 |
| 2nd | 16.8 | 20.3 | | | | | | | 168.3 |
| 3rd | 16.8 | 20.3 | 25 | | | | | | 253.5 |
| 4th | 16.8 | 20.3 | 25 | 31.6 | | | | | 320.9 |
| 5th | 16.8 | 20.3 | 25 | 31.6 | 41.5 | | | | 372.2 |
| 6th | 16.8 | 20.3 | 25 | 31.6 | 41.5 | 58 | | | 409.0 |
| 7th | 16.8 | 20.3 | 25 | 31.6 | 41.5 | 58 | 91 | | 432.4 |
| 8th | 16.8 | 20.3 | 25 | 31.6 | 41.5 | 58 | 91 | 190 | 443.6 |

Figure 29:
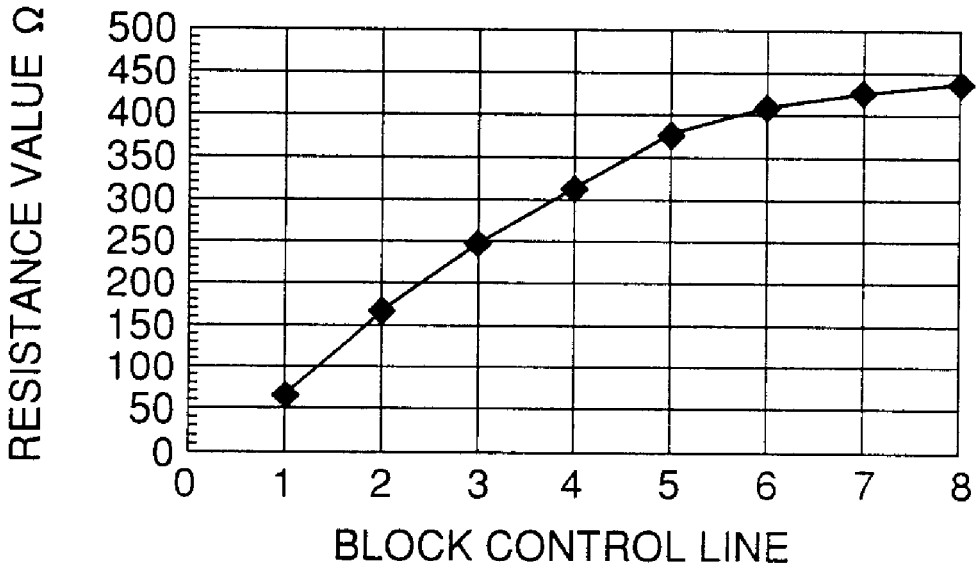
FIG. 29 is a diagram showing resistance values of the block control lines used in the third embodiment of the present invention.

FIG. 29 is a graph showing the resistance values of the block control lines of the first through eighth block control lines. As shown in Table 4 and FIG. 29, the difference between the minimum resistance value (the resistance value of the first block control line) and the maximum resistance value (the resistance value of the second block control line) is equal to or less than 400Ω. Hence, according to the third embodiment of the present invention, it is possible to reduce the differences between the resistance values of the different blocks, as compared to that in the prior art (see FIG. 27). Further, the maximum resistance value is greatly reduced according to the third embodiment of the present invention, so that rounding of the waveforms of the block control signals can be suppressed and an improved display quality can be obtained.

A description will be given of a fourth embodiment of the present invention.

Figure 30:
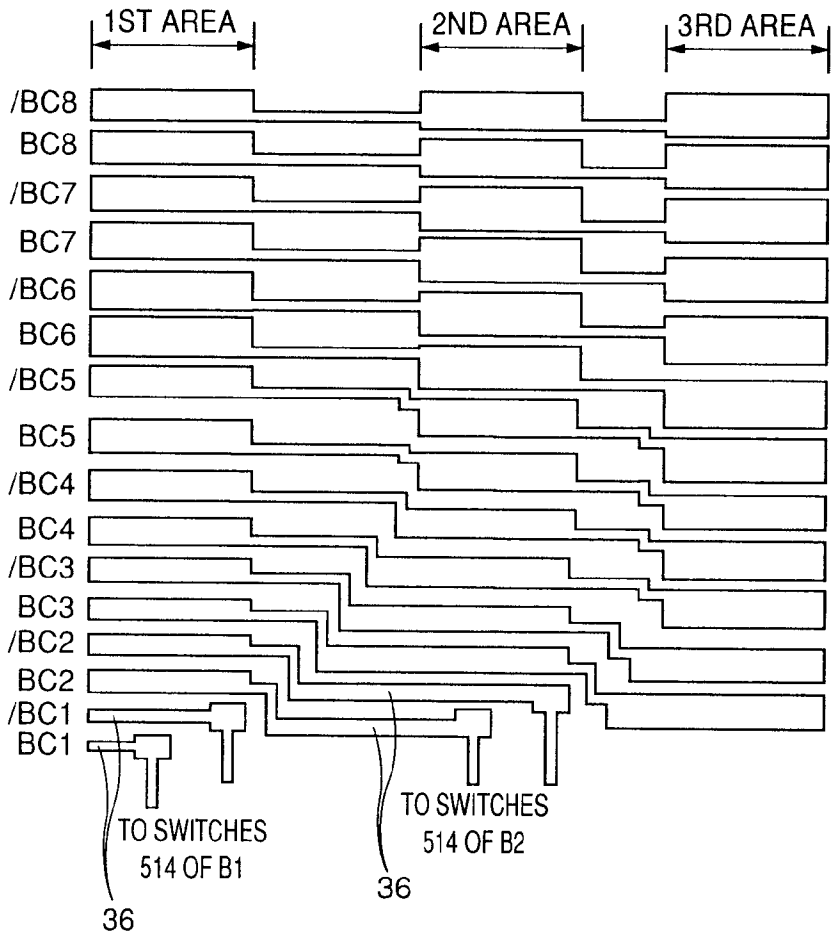
FIG. 30 is a schematic view of a wiring pattern of block control lines used in a liquid crystal display panel of a liquid crystal display device according to a fourth embodiment of the present invention.

FIG. 30 is a schematic diagram illustrating a wiring pattern of block control lines formed on the liquid crystal display panel according to the fourth embodiment of the present invention. In FIG. 30, parts that are the same as those shown in the previously described figures are given the same reference numbers, and a detailed description thereof will be omitted here.

The wiring pattern of the block control lines shown in FIG. 30 is intended to select the widths of the block control lines so that the resistance values of the lines 567 measured from the start points thereof to the end points are approximately equal to each other. More particularly, the widths of the block control lines 567 in the first through eighth blocks are selected as shown in Table 5 in order to realize the approximately equal resistance values. In Table 5, the unit of the numeral values other than the resistance values is micron ($\mu$m), and the interval between the adjacent block control lines is equal to 8 $\mu$m.

TABLE 5

| block | 1st area | 2nd area | 3rd area | 4th area | 5th area | 6th area | 7th area | 8th area | resistance Ω |
|---|---|---|---|---|---|---|---|---|---|
| 1st | 8 | | | | | | | | 266.3 |
| 2nd | 12 | 10 | | | | | | | 301.8 |
| 3rd | 12 | 16 | 20 | | | | | | 328.4 |
| 4th | 18 | 20 | 22 | 26 | | | | | 344.4 |
| 5th | 20 | 24 | 24 | 28 | 38 | | | | 362.9 |
| 6th | 24 | 25 | 31 | 32 | 38 | 50 | | | 363.5 |
| 7th | 24 | 26 | 30 | 35 | 45 | 57 | 94 | | 365.5 |
| 8th | 21 | 26 | 28 | 42 | 50 | 72 | 93 | 195 | 365.4 |

Figure 31:
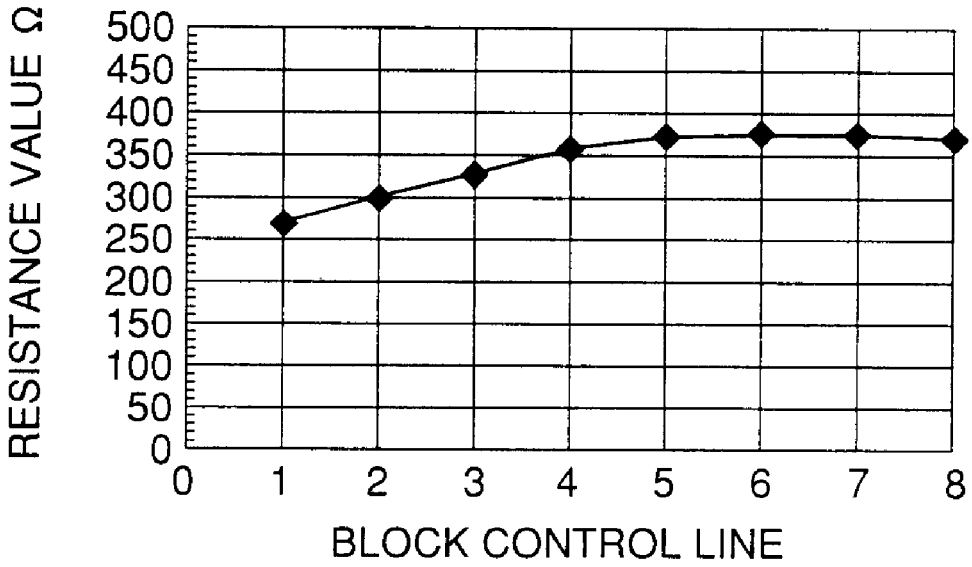
FIG. 31 is a diagram showing resistance values of the block control lines used in the fourth embodiment of the present invention.

FIG. 31 is a graph showing the resistance values of the first through eighth block control lines. As shown in Table 5 and FIG. 31, the difference between the minimum resistance value (the resistance value of the first block control lines) and the maximum resistance value (the resistance value of the eighth block control lines) is approximately equal to 100Ω. It will be noted that the above difference obtained according to the fourth embodiment of the present invention is quite smaller than that obtained according to the third embodiment of the present invention. Hence, rounding of the waveforms of the control signals can further be suppressed and a further improved display quality can be obtained.

Figure 32:
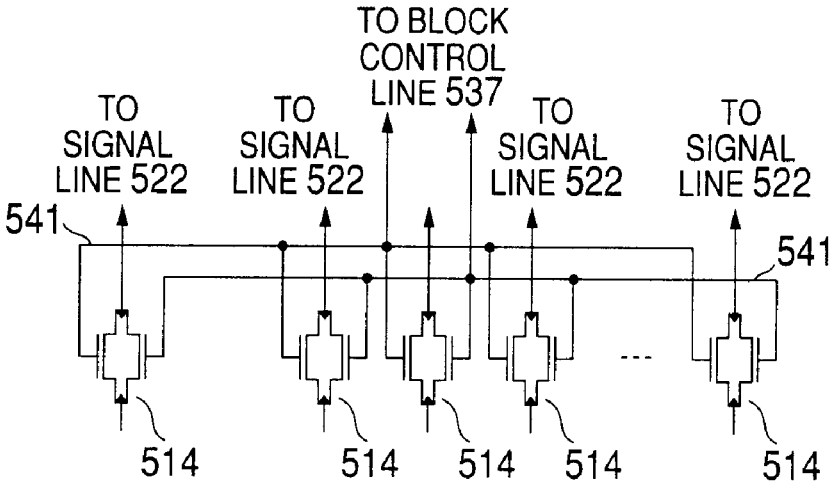
FIG. 32 is a plan view of connections between block control lines and analog switches of one block according to a variation of the third and fourth embodiments of the present invention.

FIG. 32 is a diagram of a variation of the third and fourth embodiments of the present invention. More particularly, FIG. 32 illustrates connections between the block control lines and the analog switches in a block.

When the block control lines 567 and the analog switches 514 are connected in ends of the blocks B1–B8, the block control line associated with the analog switch 514 located at one end of the block and the block line associated with the analog switch 514 located at the other end of the same block have a large difference in resistance. This may degrade the display quality.

With the above in mind, as shown in FIG. 32, the block control line 537 is connected, at the center of the block, to a line 541 which connects the analog switches located at both ends of the block. Hence, it is possible to reduce the difference between the resistance values in the same block and to prevent degradation of the display quality.

Figure 33:
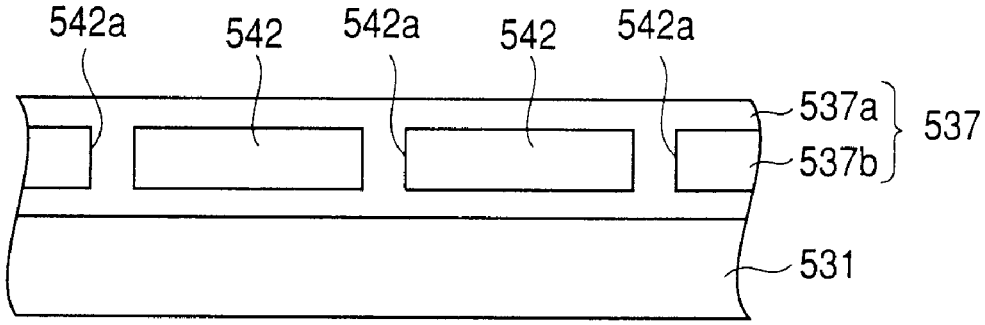
FIG. 33 is a schematic cross-sectional view of a structure of block control lines.

FIG. 33 is a schematic cross-sectional view showing a structure of the block control lines 567. The structure shown in FIG. 33 has a multi-layer structure in which an lower-layer block control line 537*a* and an upper-layer block control line 537*b* are electrically connected together through a contact hole 542*a* formed in an insulating film 542 interposed therebetween. With the above structure, the resistance value of the block control lines 567 can further be reduced.

As described above, the third and fourth embodiments of the present invention employs the control signal lines having different widths in the different areas or the same area in order to reduce the resistance difference between the control signal lines. The same advantages as described above can be obtained by changing the resistivity values (resistance value per unit length) of the block control lines and/or the layer structure (a single-layer structure or a multi-layer structure).

For example, in the case where the block control lines BL1–BL8 shown in FIG. 26 have the same width, if the block control lines BL1–BL8 are designed to have different resistivity values, it is possible to reduce the difference values of the block control lines measured from the start points thereof to the end points. For example, the lines having comparatively short lengths such as BL1 are made of a substance having a comparatively large resistivity, and the lines having comparatively long lengths such as BL8 are made of a substance having a comparatively small resistivity. Alternatively, the comparatively short lines are formed by a single-layer structure, and the comparatively long lines are formed by a multi-layer structure. In the above cases, almost the same advantages as described above can be obtained.

The third and fourth embodiments of the present invention are directed to improvements in the block control lines connecting the TAB terminal and the analog switches. Alternatively, the concept of the third and fourth embodiments of the present invention can be applied to block control lines connecting a semiconductor chip with the COG connections on the glass substrate and the analog switches.

A description will be described of a liquid crystal display device according to a fifth embodiment of the present invention, which is directed to improving the display quality by controlling the potentials of the signal lines. In order to facilitate understanding the fifth embodiment of the present invention, a description will be given of a conventional control of the signal lines.

Figure 34:
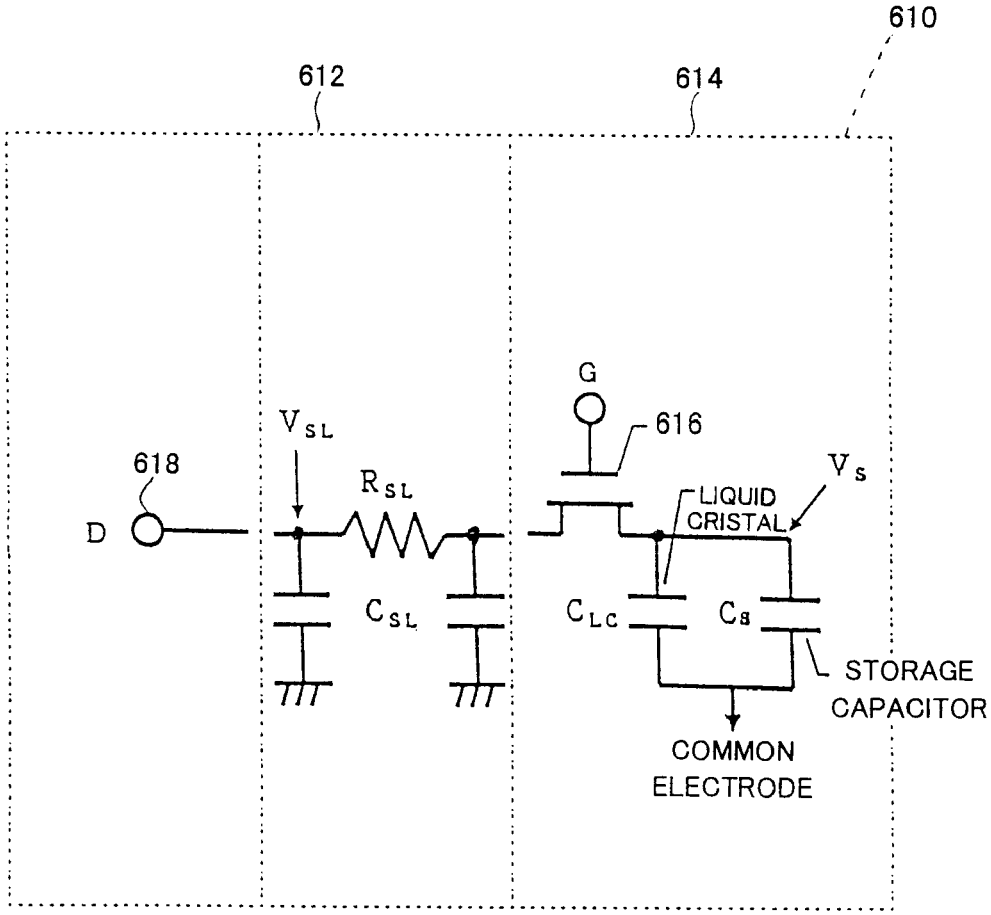
FIG. 34 is an equivalent circuit diagram of a basic structure of the liquid crystal display device.

FIG. 34 shows a basic structure of a liquid crystal display device 610, which includes a signal line part 612 and a pixel cell part 614. The pixel cell part 614 includes a pixel TFT 616, a liquid crystal CLC and a storage capacitance CS.

The scan signal G is applied to the gate of the pixel TFT 616 via the scan line from the gate driver circuit (not shown in FIG. 34). Hence, the pixel TFT 616 is turned on. The display signal D is applied to the signal line part 612 via an input part 618. The display signal D passes through the pixel TFT 616, and is written into the liquid crystal CLC and the storage capacitor CS. A resultant pixel potential Vs and the potential of an opposed electrode (not shown) has a difference, which makes a display. The display signal D is maintained until the scan signal G is supplied to the pixel TFT 616 again. The period in which the display signal D is maintained in the pixel TFT 616 is a signal hold period. In FIG. 34, a symbol RSL is the resistance of the line signal part 612, and the CLS is the capacitance thereof.

If a dc voltage is continuously applied to the liquid crystal CLC for a long time, the nature of the liquid crystal CLC will be changed and degraded. Hence, the liquid crystal display device 610 is driven by an ac voltage in which the polarities are inverted with a given period.

Figure 35:
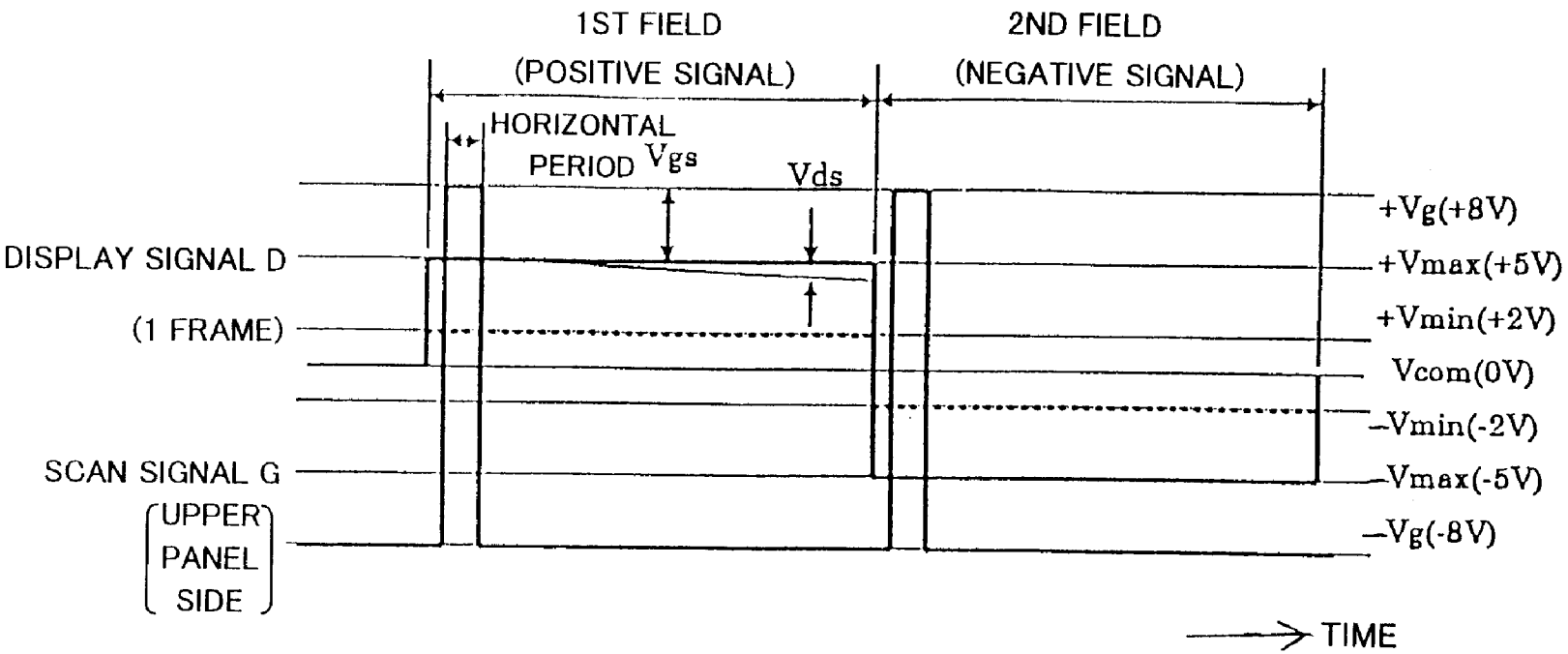
FIG. 35 shows waveforms of a scan signal and a display signal.
Figure 36:
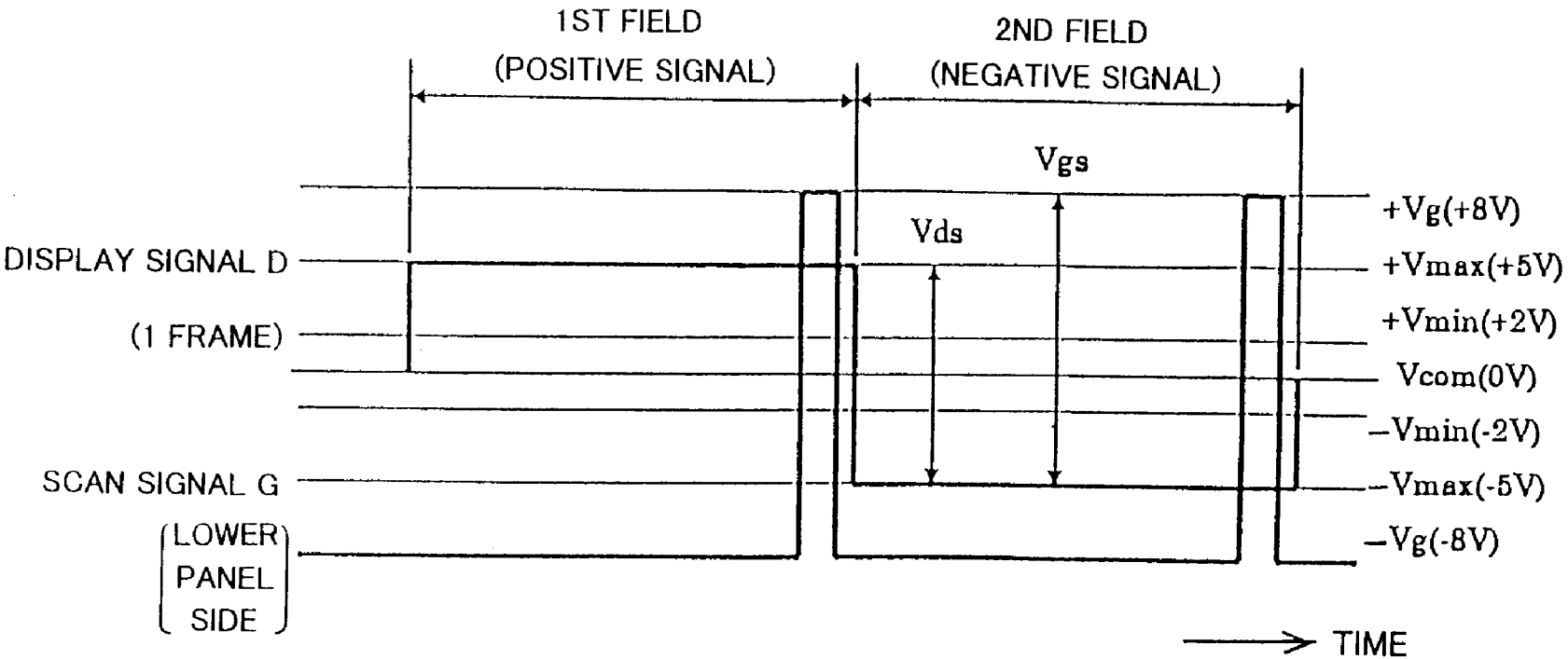
FIG. 36 shows waveforms of the scan signal and the display signal.

FIGS. 35 and 36 are waveform diagrams of the scan signal G and the display signal D applied to the pixel cell part 614 of the liquid crystal display device 610. More particularly, FIG. 35 shows waveforms of the scan signal G and the display signal D supplied to a pixel cell part 614 arranged in an upper portion of the display panel, and FIG. 36 shows waveforms of the scan signal G and the display signal D supplied to a pixel cell part 614 arranged in a lower portion of the display panel.

As shown in FIGS. 35 and 36, one frame is divided into first and second fields. Each of the pixel cell parts 614 is supplied, in the first field, with the display signal D having a potential within the range defined by +Vmax (for example, +5 V) and +Vmin (for example, +2 V), and is supplied, in the second field, with the display signal D having a potential within the range defined by −Vmax (for example, −5 V) and −Vmin (for example, −2 V). The central value of the amplitude of the display signal D is Vcom (for example, 0 V).

As shown in FIG. 35, the potential of the scan signal G supplied to the pixel TFT 616 located in the upper portion of the display panel changes from −Vg (for example, −8 V) to +Vg (for example, +8 V) immediately after the first and second fields start. At that time, the pixel TFT 616 arranged in the upper panel portion is turned on, and the display signal D is written therein.

In contrast, as shown in FIG. 36, the potential of the scan signal G supplied to the pixel TFT 616 located in the lower panel portion changes from −Vg to +Vg immediately before the first and second fields end. At that time, the pixel TFT 616 arranged in the lower panel portion is turned on, and the display signal D is written therein.

In FIGS. 35 and 36, Vgs denotes the gate-source voltage of the pixel TFT 616, and Vds denotes the source-drain voltage thereof. For example, when Vmax=5 V, Vmin=2 V and Vg=8 V, the voltages Vgs and Vds of the pixel TFT 616 arranged in the upper panel portion are respectively 3 V and 0.5 V. Also, as shown in FIG. 36, the voltages Vgs and Vds of the pixel TFT 616 arranged in the lower panel portion are respectively 13 V and 10 V. As described above, the voltages Vgs and Vds of the pixel TFTs 616 depend on the locations thereof.

Figure 37:
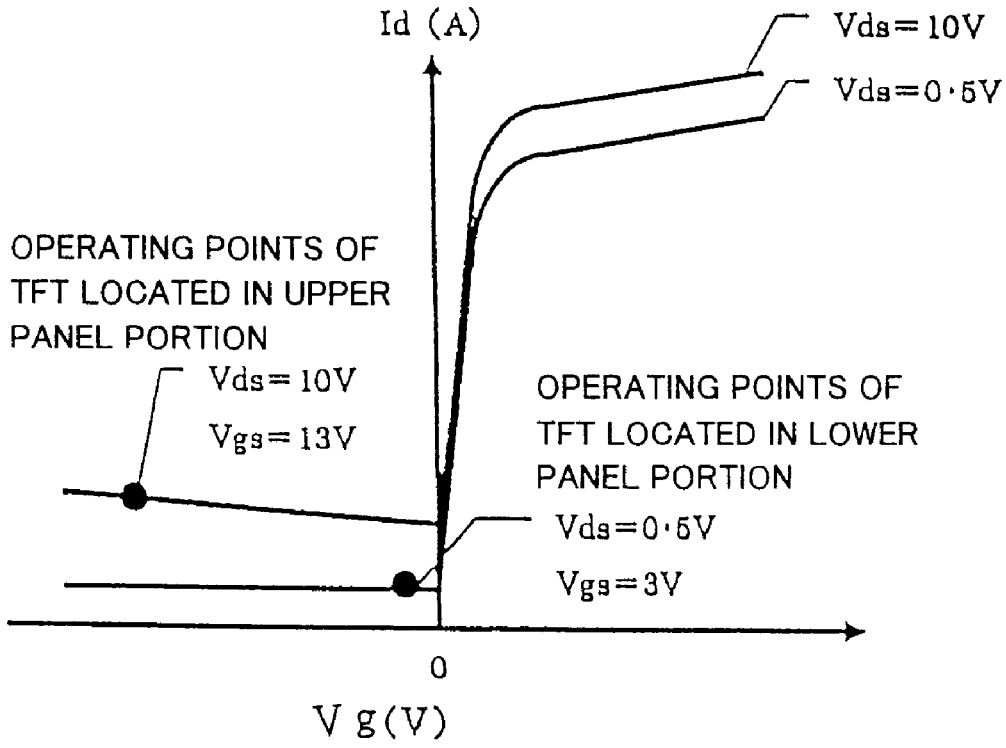
FIG. 37 is a graph of a relationship between a drain current flowing in a pixel TFT and a gate voltage thereof.

FIG. 37 is a graph of a relationship between the drain current Id and gate voltage Vg of the pixel TFT 616. As shown in FIG. 37, an on current which is a charge current flowing at the time of writing the display signal D into the pixel TFT 616 and off current which is a leakage current flowing at the time of holding the display signal D have respective magnitudes which depend on the voltages Vds and Vgs applied to the pixel TFT 616. As described above, the voltages Vgs and Vds of the pixel TFTs 616 depend on the locations thereof. That is, the magnitudes of the on and off currents flowing in the upper panel portion differ from those of the on and off currents flowing in the lower panel portion.

Figure 38:
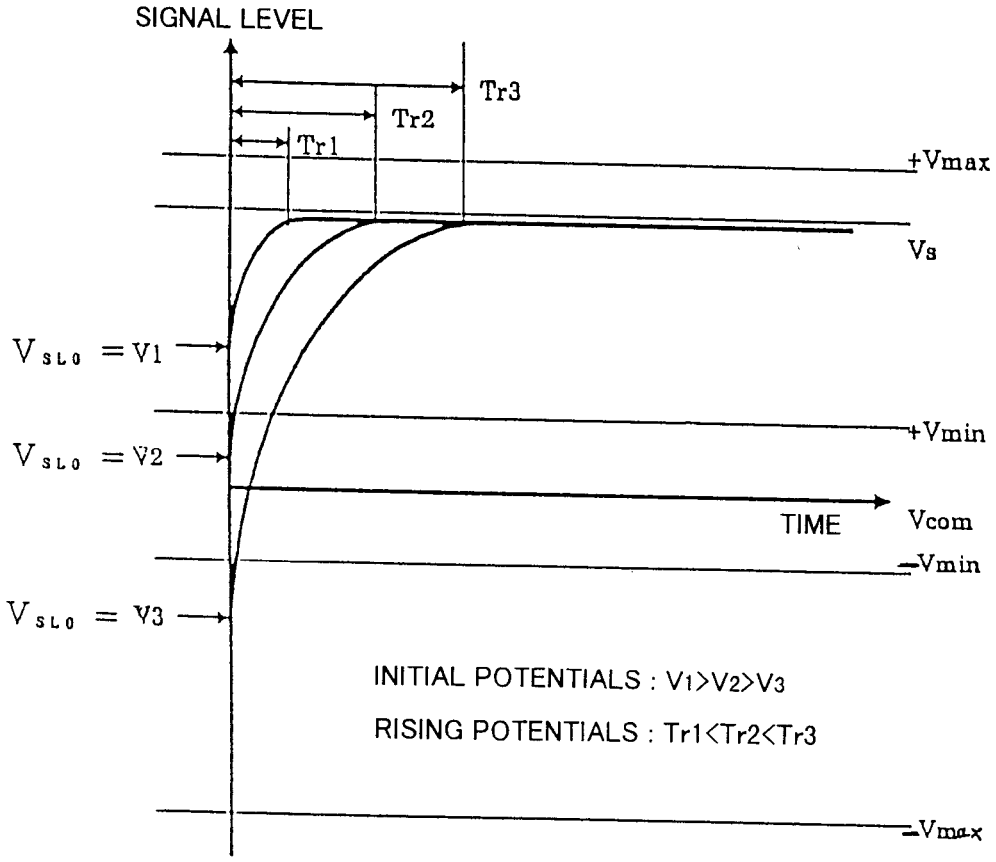
FIG. 38 is a waveform diagram showing a relationship between an initial potential of a signal line part and a rising time.

FIG. 38 is a waveform diagram showing a relationship between an initial potential VSL0 of the potential VSL of the signal line part 612 and a rising time Tr necessary for the pixel potential to reach a potential Vs when the display signal D is applied thereto.

As shown in FIG. 38, when the initial potential VSL0 is equal to V1, it takes a time Tr1 the pixel potential to rise up to the potential Vs. When the initial potential VSL0 is equal to V2, it takes a time Tr2 the pixel potential to reach the potential Vs. When the initial potential VSL0 is equal to V3, it takes a time Tr3 the pixel potential to reach the potential Vs. The potentials V1, V2 and V3 have a relationship such that V1>V2>V3, while the rising times Tr1, Tr2 and Tr3 have a relationship such that Tr1<Tr2<Tr3. As described above, the time Tr necessary for the pixel potential to reach the potential Vs depends on the initial potential VSL0 of the signal line part 612.

In the conventional liquid crystal display device 610, the signal lines have respective initial potentials VSL0 different from each other before the scan signal G is applied thereto. Hence, the rising times Tr necessary for the pixel potentials to rise up to the given potential Vs are different from each other in accordance with the respective initial potentials VSL0. The write times necessary to write the display signals D into the pixels are not equal to each other. Hence, the device 610 has a uniform display of images.

As has been described with reference to FIGS. 35–37, the off current flowing in the pixel TFT 616 arranged in the lower panel portion is much greater than the off current flowing in the pixel TFT 616 arranged in the upper panel portion. Hence, a rate of decrease in the pixel potential of the pixel TFT 616 arranged in the upper panel portion is greater than a rate of decrease in the pixel potential of the pixel TFT 616 arranged in the lower panel portion. Hence, the luminance is not uniform on the panel and an up-to-down oblique display takes place. More particularly, the display of black is comparatively light when black is displayed on the whole panel.

The fifth embodiment of the present invention is intended to eliminate the above disadvantages and to cause the rise time of the pixel potential to be constant and cause the off currents to uniformly flow in the pixel TFTs by resetting a reference potential of the signal line periodically.

Figure 39:
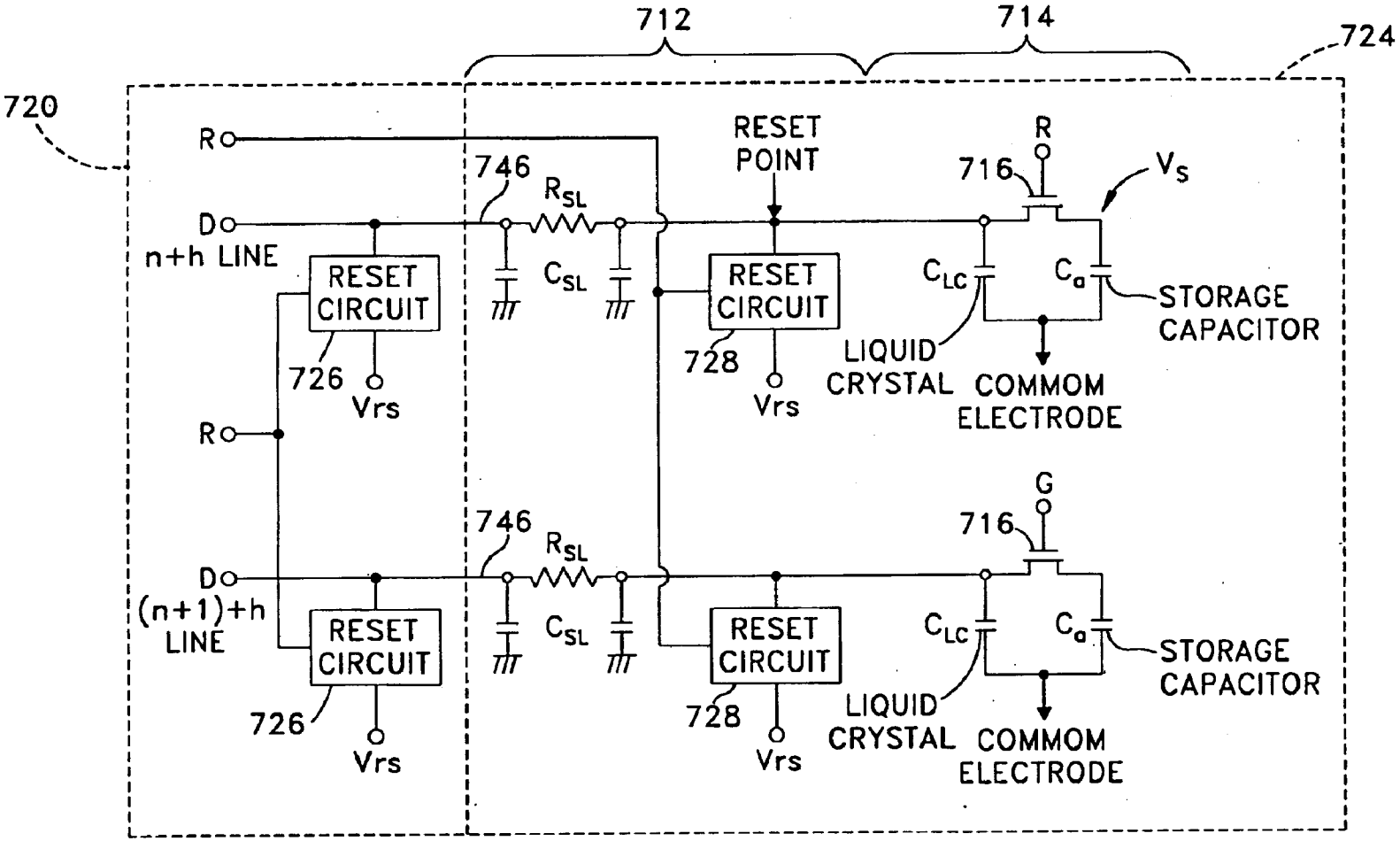
FIG. 39 shows a fundamental structure of the liquid crystal display device according to the fifth embodiment of the present invention.

FIG. 39 shows a fundamental structure of a liquid crystal display device according to the fifth embodiment of the present invention.

Referring to FIG. 39, a liquid crystal display device 720 includes a display panel 724, which has the signal line part 612 and the pixel cell part 614.

The signal line part 612 includes a plurality of signal lines 746, to which reset circuits 726 and 728 are connected. The reset circuit 726 is connected to the signal lines 746 outside of the display panel 724. The reset circuits 728 are connected to the signal lines 746 in the display panel 724.

The reset circuits 726 and 728 are supplied with a reset signal R from a timing generating circuit (not shown) during the signal hold period with a given period, and is turned on. When the reset circuits 726 and 728 are turned on, a reset voltage generating source (not shown) provided outside of the display panel 724 and the signal lines 746 conduct, and the potentials of the signal lines 746 are set to the reset potential (reference potential) Vrs.

The reset circuits 726 and 728 function to set the initial potentials VSL0 of the signal lines 746 to the identical reset potentials Vrs before the display signals D are written in the cells. Hence, the rising times Tr of the potentials in the pixel TFTs 616 can be made uniform. Hence, the write times necessary to write data into the pixel TFTs 616 become constant and equal to each other. Further, the reset circuits 726 and 728 function to set the potentials of the signal lines 746 to the reset potential Vrs, so that the off currents flowing in the pixel TFTs 616 can be equal to each other. Hence, the liquid crystal display device 720 is capable of realizing luminance-constant high quality display. In FIG. 39, a symbol RSL denotes the resistances of the signal lines 746, and CSL denotes the capacitances thereof.

Figure 40:
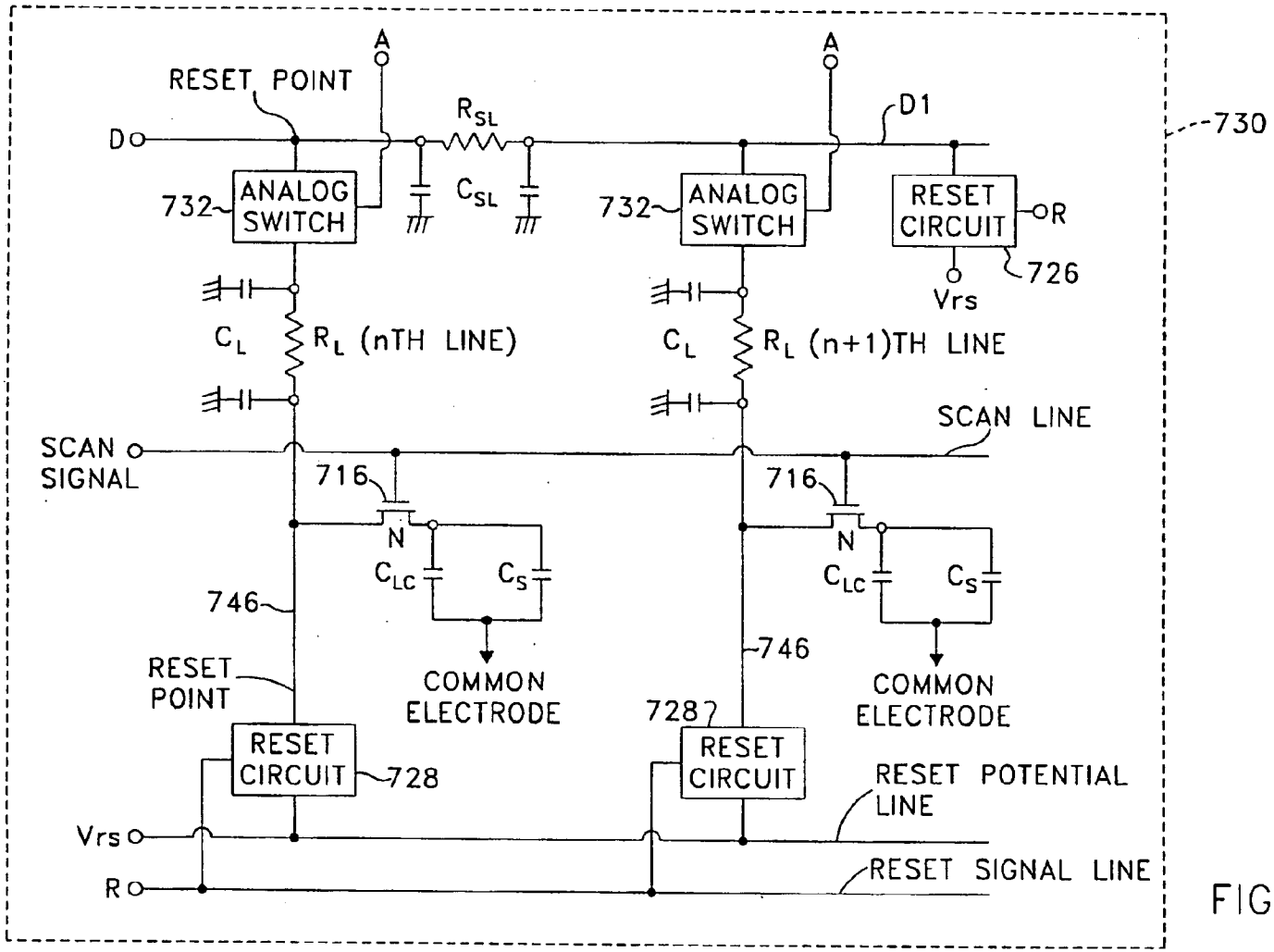
FIG. 40 is a circuit diagram of a structure of the liquid crystal display device according to the fifth embodiment of the present invention.

FIG. 40 is a circuit diagram of a liquid crystal display device 730 equipped with analog switches according to the fifth embodiment of the present invention. In FIG. 40, parts that are the same as those shown in FIG. 39 are given the same reference numbers.

The liquid crystal display device 730 is equipped with analog switches 732. Analog switch control signals A can be separately supplied to the analog switches 732, which are thus turned on. Hence, the common signal line D1 and the pixel TFTs 616 can be electrically connected. At this time, the display signal D transferred over the common signal line D1 from a driver IC device (not shown in FIG. 40) is supplied to the pixel TFTs 616 via the analog switches 732. Hence, the pixel TFTs 616 to be supplied with the display signal D can be selected by controlling the analog switches 732.

The reset circuits 726 are respectively connected to the common signal lines D1–Dn. The reset circuits 728 are connected to the signal lines 746. The reset circuits 726 receives the reset signal R from the timing generating circuit (not shown) for the signal hold period and then set the potentials of the common signal lines D1–Dn to the reset potential Vrs. The reset circuits 728 receive the reset signal R from the timing generating circuit for the signal hold period and then set the potentials of the signal lines 746 to the reset potential Vrs.

The reset circuits 726 and 728 function to set the initial potentials VSL0 of the common signal lines D1–Dn and the signal lines 746 to the identical reset potentials Vrs before the display signals D are written in the cells. Hence, the rising times Tr of the potentials in the pixel TFTs 616 can be made uniform. Hence, the write times necessary to write data into the pixel TFTs 616 become constant and equal to each other. Further, the reset circuits 726 and 728 function to set the potentials of the common signal lines D1–Dn and the signal lines 746 to the reset potentials Vrs, so that the off currents flowing in the pixel TFTs 616 can be equal to each other. Hence, the liquid crystal display device 720 is capable of realizing luminance-constant high quality display. In FIG. 40, a symbol RSL denotes the resistance of one (D1) of the common signal lines D1–Dn, and CSL denotes the capacitances thereof. Further, symbols RL and CL respectively denote the resistances and capacitances of the signal lines 746.

Figure 41:
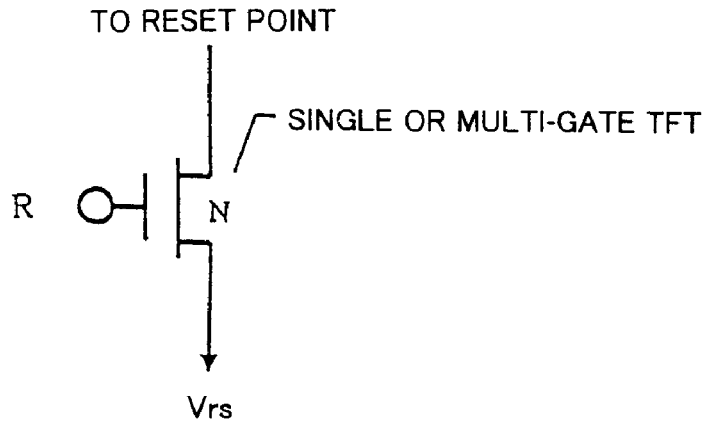
FIG. 41 is a circuit diagram of a reset circuit of an n-channel MOS type.
Figure 42:
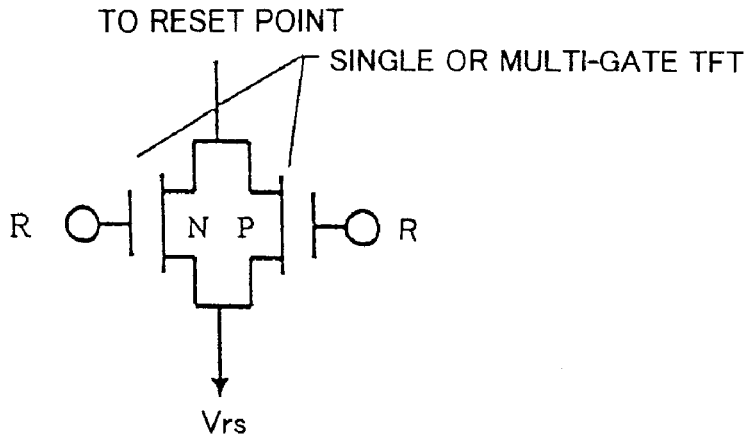
FIG. 42 is a circuit diagram of a reset circuit of a CMOS type.

FIG. 41 is a circuit diagram of a configuration of the reset circuits 726 and 728, and FIG. 42 is a circuit diagram of another configuration thereof. FIG. 41 shows an n-channel MOS type reset circuit, and FIG. 42 shows a CMOS type reset circuit.

The reset circuit shown in FIG. 41 has a simple structure, and the reset circuit shown in FIG. 42 has a high driving ability and reduces the reset time. The n-channel MOS transistor shown in FIG. 45 may be replaced by a p-channel MOS transistor. The transistor used in the configuration shown in FIG. 41 has dual gates. Similarly, the CMOS circuit may have dual gates. When the dual-gate transistors are used, the leakage currents flowing in the pixel TFTs 616 can be reduced for the signal hold period.

Figure 43:
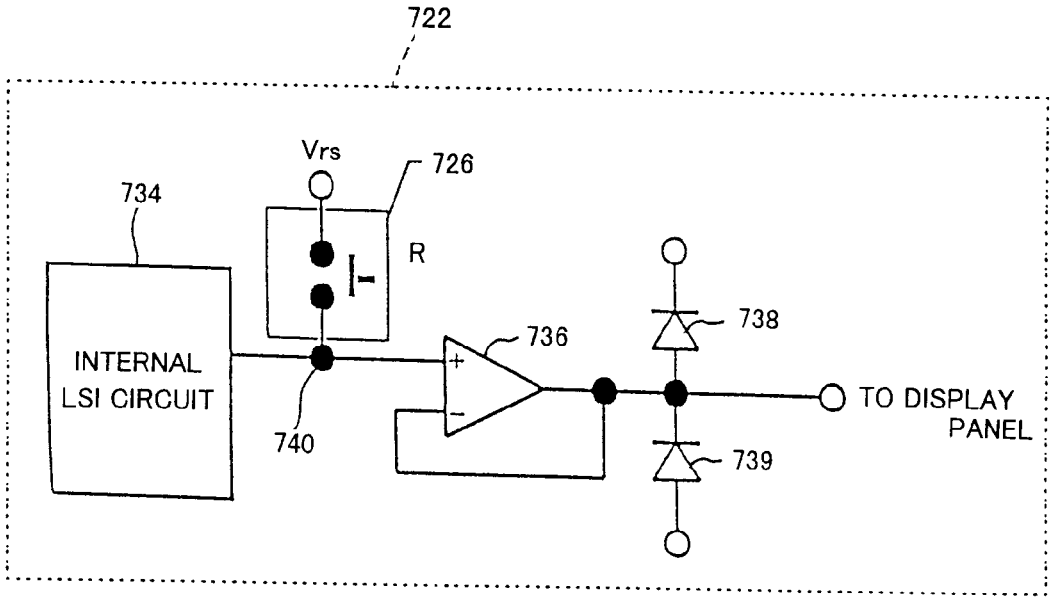
FIG. 43 is an equivalent circuit diagram of a driver IC device having a built-in reset circuit.

The reset circuits 726 may be provided in the driver IC device (which is not shown in FIG. 40 but is the same as the driver IC device 512 shown in FIG. 1). FIG. 43 is an equivalent circuit of the driver IC device in which the reset circuits 726 are built.

As shown in FIG. 43, the driver IC device now assigned a reference number 722 includes an internal IC circuit 734, the reset circuit 726, an operational amplifier 736, and protection elements 738 and 739. The display signal D output by the internal IC circuit 734 is supplied to the display panel 724 via the operational amplifier 734. At the time of resetting the potentials of the signal lines 746, the reset signal R is supplied to the reset circuit 726 from the timing generating circuit (not shown). Hence, a cross point at which the internal IC circuit 734 and the operational amplifier 736 are connected is set to the reset potential Vrs.

Figure 44:
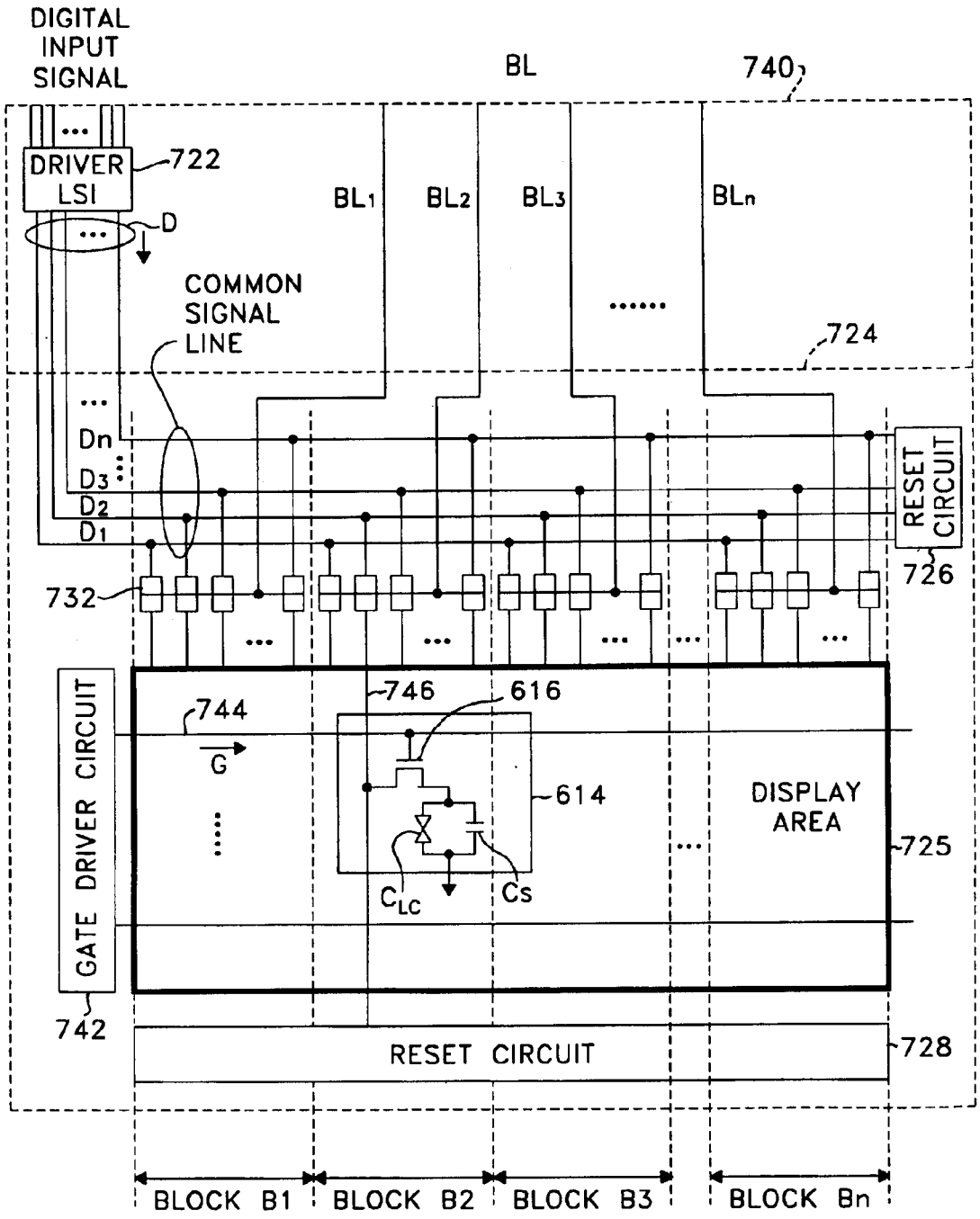
FIG. 44 is a diagram showing a detailed structure of the liquid crystal display device according to the fifth embodiment of the present invention.

FIG. 44 is a diagram showing the detailed structure of the liquid crystal display device 740 according to the fifth embodiment of the present invention. As shown in FIG. 44, the liquid crystal display device 740 includes the driver IC device 722, the block control lines BL1–BLn, and the display panel 724. In the display panel 724, there are provided a display area 725, the common signal lines D1–Dn, the analog switches 732, a gate driver circuit 742, and the reset circuits 726 and 728. Peripheral circuits including the display area 725 and the gate driver circuit 742 are formed integrally with the display panel 724, so that down sizing of the liquid crystal display device 740 can be facilitated.

The display area 725 is divided into n blocks B1–Bn, in each of which blocks the scan lines 744 and the signal lines 746 are arranged. The pixel cell parts 714 are respectively provided at the cross points at which the scan lines 744 and the signal lines 746 cross each other. Each of the pixel cell parts 714 is made up of the pixel TFT 616, the liquid crystal CLC and the storage capacitor Cs. The gate of the pixel TFTs 616 are connected to the corresponding scan lines 744, and the sources thereof are connected to the signal lines 746. Further, the drains of the pixel TFTs 616 are connected to the corresponding liquid crystal layers CLC and the storage capacitors Cs.

In each of the blocks B1–Bn, n analog switches 732 are arranged. The common signal lines D1–Dn are connected to the corresponding signal lines 746 in the display panel 724 via the analog switches 732.

In the display panel 724, the reset circuit 726 is connected to the common signal lines D1–Dn, and the reset circuit 728 is connected to the signal lines 746. The positions of the reset circuits 726 and 728 are not limited to those shown in FIG. 44. For example, the reset circuit 726 is connected to the display signal output part of the driver IC device 722 provided outside of the display panel 724.

As shown in FIG. 44, the driver IC device 722 is connected to the common signal lines D1–Dn. The driver IC device 722 receives the digital display signal from an external data driver (not shown in FIG. 44) in the same manner as has been described previously, and outputs the analog output signals D. The display signals D from the driver IC device 722 are transferred to the display panel 724 on the block basis via the common signal lines D1–Dn in the time-division formation. The driver IC device 722 may be provided in the display panel 724.

The analog switches 732 are supplied with the block control signals BL which turn on the analog switches 732 via the block control lines BL1–BLn.

At the time of driving the liquid crystal display device 740, the gate signal G is applied to one (first) of the scan lines 744 from the gate driver circuit 742, and are applied to the gates of the pixel TFTs 616, which are thus turned on. The signal lines 746 are supplied, via the analog switches 732, with the display signals D transferred over the common signal lines D1–Dn. Then, the display signals D are input to the pixel TFTs 616 which are on.

The potentials of the common signal lines D1–Dn are reset to the reference potential Vrs with the given period by the reset circuit 726. Further, the potentials of the signal lines 746 are reset to the reference potential Vrs with the given period by the reset circuit 728.

Figure 45:
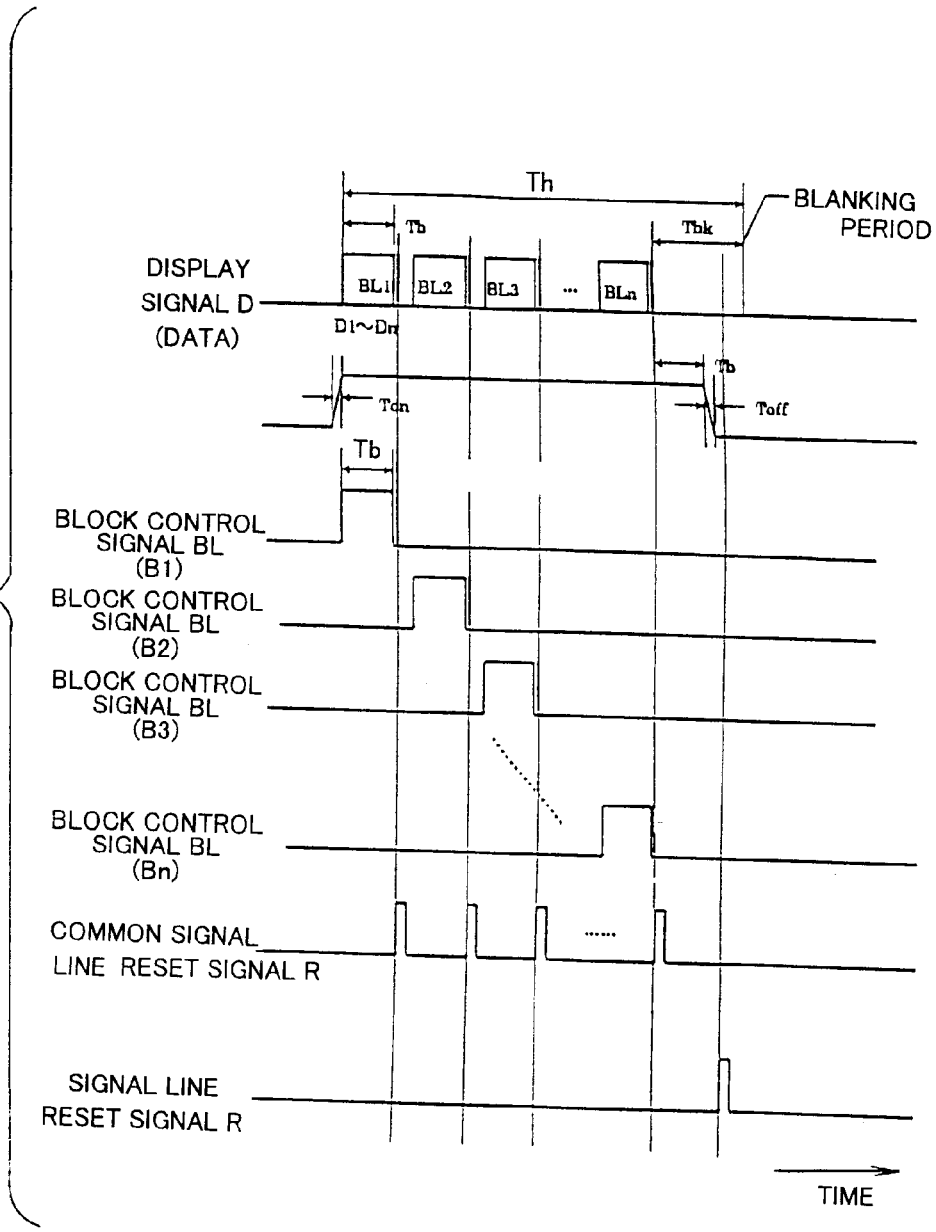
FIG. 45 is a timing chart of an operation of the liquid crystal display device shown in FIG. 44.

A description will now be given of an operation of the liquid crystal display device 740 with reference to FIGS. 44 and 45. FIG. 45 is a timing chart of the display signals D, the scan signal G, the block control signals BL and the reset signal R.

Referring to FIG. 45, the high-level scan signal G is applied to the display area 725 from the gate driver circuit 742. Then, the block control signal BL which is maintained at the high level for the block control period Tb is applied to the analog switches 732 of the block B1, which switches are thus turned on. At that time, the display signals D are applied to the block B1 from the driver IC device 722 via the common signal lines D1–Dn.

After the display signals D are applied to the block B1, the reset signal R is supplied to the reset circuit 726 from the timing generating circuit (not shown) provided outside of the display panel 724. Hence, the reset circuit 726 is activated, and sets the potentials of the common signal lines D1–Dn to the reset potential Vrs (for example, Vcom).

Then, the block control signal BL of the high level is applied to the analog switches 732 of the block B2 for the block control period Tb. Thus, the above analog switches 732 are turned on. At that time, the display signals D from the driver IC device 722 are supplied to the block B2 via the common signal lines D1–Dn for the block control period Tb. After the display signals D are applied to the block B2, the reset circuit R is supplied to the reset circuit 726 from the timing generating circuit. Hence, the reset circuit 726 is activated so that the potentials of the common signal lines D1–Dn are set to the reset potential Vrs.

The above operation is repeated, and the display signals D are applied to the block Bn. Then, the potentials of the common signal lines D1–Dn are set to the reset potential Vrs by the reset circuit 726. Then, the operation enters the blanking period Tbk. When the time Tb elapses after the blanking period Tbk starts, the scan signal G input to the display area 725 changes to the low level. At the time of the end of the blanking period Tbk, the reset signal R is supplied to the reset circuit 728 from the timing generating circuit. Hence, the reset signal 728 is activated so that the potentials of the signal lines 746 are set to the reset potential Vrs. Then, the horizontal scan period Th ends. Then, the next scan line 744 is driven and the display signals D are sequentially supplied to the blocks B1–Bn.

The blanking period Tbk is sufficiently longer than the block control period Tb and satisfies a condition such that Tbk>Tb+Ton+Toff where Ton and Toff respectively denote the rising and falling times of the scan signal G.

In the liquid crystal display device 740, the block control signals BL may be applied to the analog switches 732 so that all the analog switches 732 of the blocks B1–Bn are simultaneously turned on for one horizontal scan period Th.

As described above, the blocks B1–Bn are sequentially selected and activated one by one. A data write time Tb per block in the liquid crystal display device 740 which performs the above-mentioned block-sequential drive operation is equal to (Th−Tbk)/n. Hence, as a smaller number n of blocks is provided in the liquid crystal display device 740, the data write data Tb can be set to be longer. As the data write time Tb per block becomes longer, the data write time Tb is less affected by variations in the rising time Ton and the falling time Toff of the gate scan signal G due to dispersion of the characteristics of the pixel TFTs 526. Hence, it is possible to sufficiently ensure the data write time Tb for each block and to prevent occurrence of a display failure such as a laser scan stripe or a warp streak.

The reset circuit 726 resets the potentials of the common signal lines D1–Dn to the reset potential Vrs each time the block scan ends, and the reset circuit 728 resets the potentials of the signal lines 746 to the reset potential Vrs each time the horizontal scan ends. Hence, the rising times of the pixel TFTs 616 can be made constant, and the constant time of writing the display signals D can be obtained. Further, the potentials of the signal lines 746 are reset to the reset potential Vrs with the given period, so that the constant off currents can flow in the pixel TFTs 616 located in the upper and lower panel portions. Hence, the liquid crystal display device 740 is capable of realizing luminance-constant high quality display.

The liquid crystal display device 740 may be modified so as to have either the reset circuit 726 or the reset circuit 728. The timing at which the reset signal R is applied to the reset circuits 726 and 728 is not limited to that shown in FIG. 45 but may be set to another timing as long as the concept of the present invention is satisfied.

Figure 46:
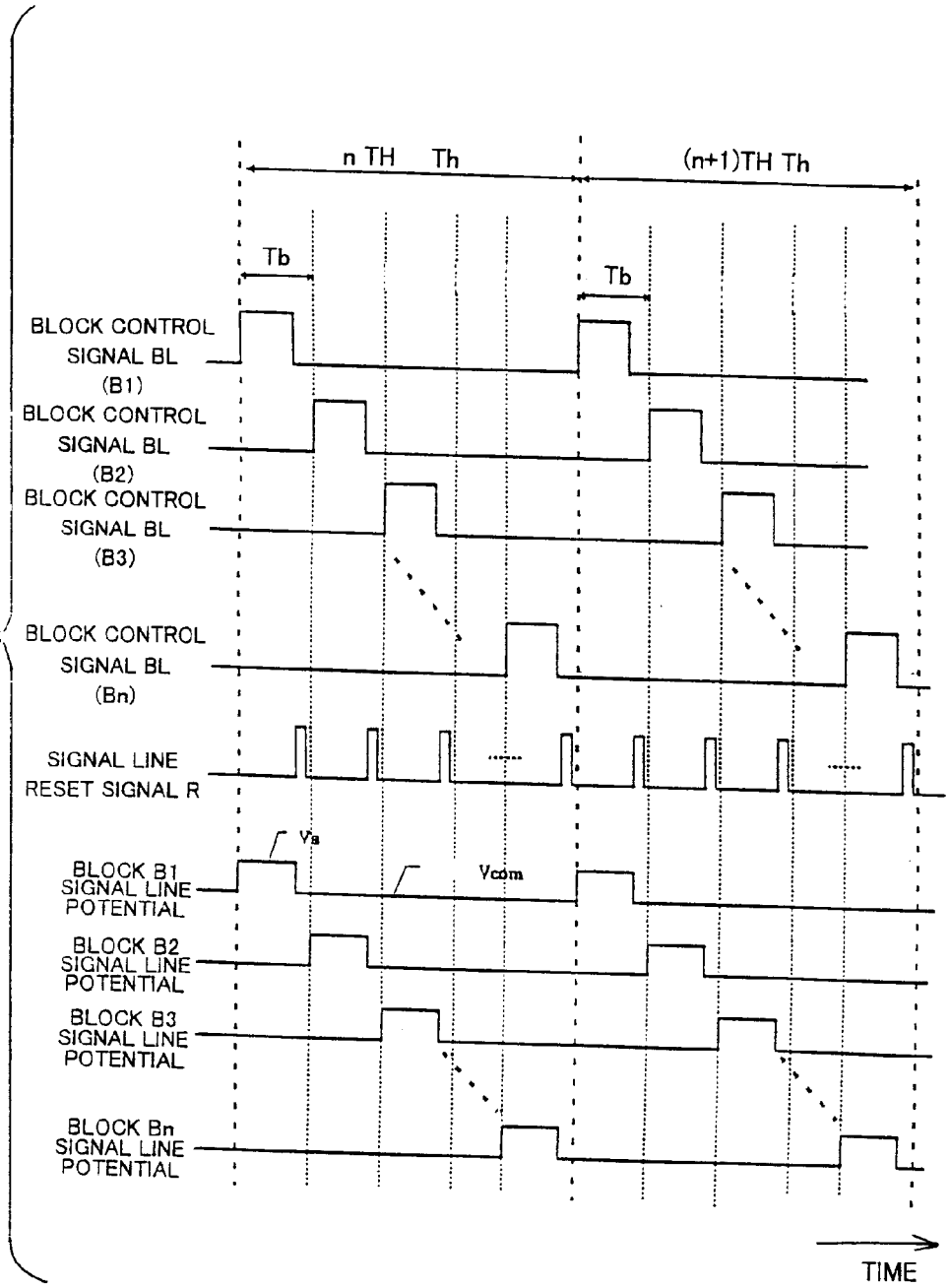
FIG. 46 is a timing chart of another operation of the liquid crystal display device shown in FIG. 44.

FIG. 46 is a timing chart showing a relationship among the block control signals BL, the reset signal R and the potentials of the signal lines 746. As shown in FIG. 46, the potentials of the signal lines 746 related to the block B1 are at Vs for the control period for the block B1. The reset signal R is supplied to the reset circuit 726 immediately after the end of the control period for the block B1. Further, the potentials of the signal lines 746 related to the block B1 are set to Vcom which is the reset potential (reference potential). Similarly, the reset signal R is supplied to the reset circuit 726 immediately after the end of the control period for the block B2, and the potentials of the signal lines 746 related to the block B2 are set to the Vcom. Further, the reset signal R is supplied to the reset circuit 726 immediately after the end of the control period for the block Bn, and the potentials of the signal lines 746 are set to the Vcom. The reset potential Vrs is not limited to Vcom but may be another potential level.

In the case where the reset potential Vrs is Vcom, the potentials of the sources of the pixel TFTs 616 located in the upper and lower portions of the display panel 724 are set to Vcom in times other than the write period for the display signals D. At that time, the approximately equal off currents flow in the pixel TFTs 616 located in the upper and lower panel portions. Hence, the effective voltages of the pixel TFTs 616 located in the upper and lower panel portions are almost the same as each other, so that an up-to-down oblique display can be prevented.

Figure 47:
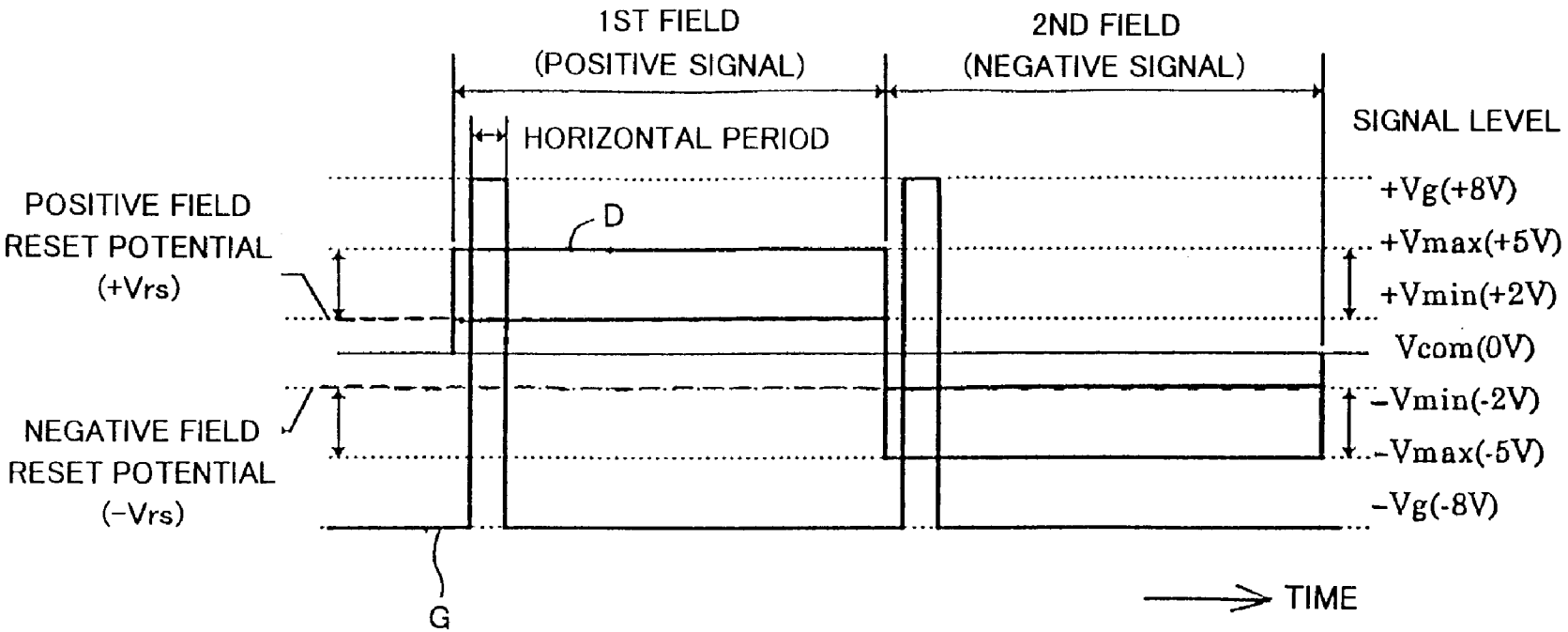
FIG. 47 is a waveform diagram showing a change of the polarity of the reset potential.

As shown in FIG. 47, the polarity of the reset potential Vrs may be changed in accordance with the polarity of the display signals D. In FIG. 47, the polarity of the display signals D is the same as that of the reset potential Vrs. For example, when the display signals D have a potential range between ±Vmin–±Vmax, the reset potential Vrs is defined so that Vrs=±Vmin.

Figure 48:
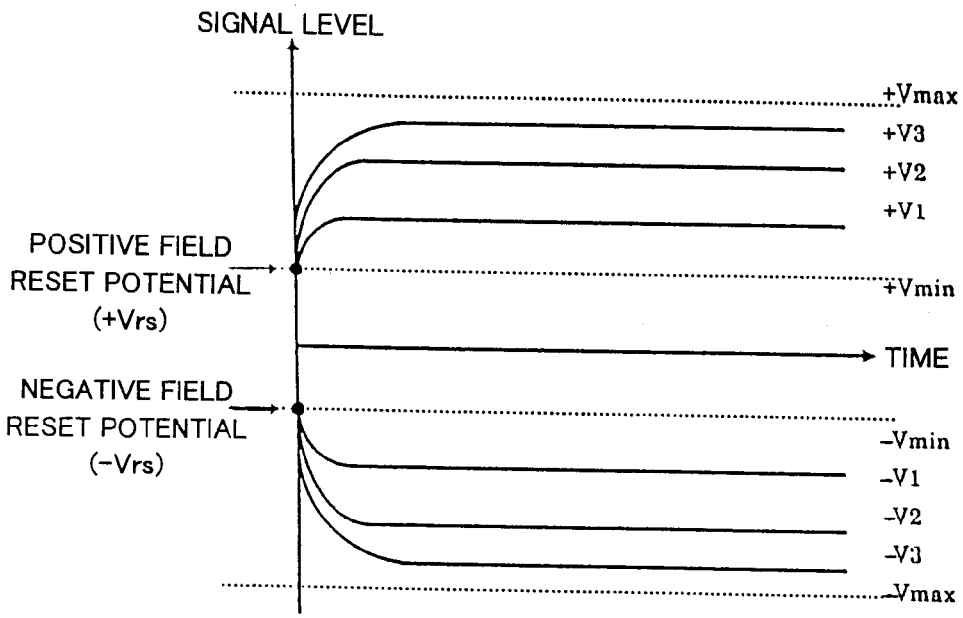
FIG. 48 is a waveform diagram showing a change of the polarity of a display signal.
Figure 49:
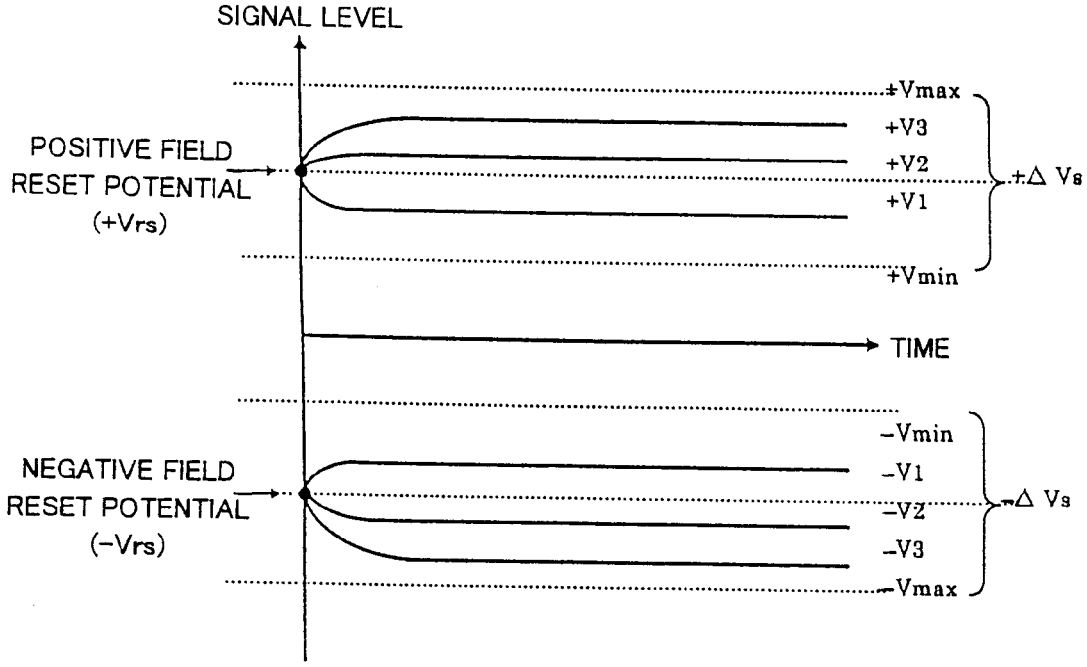
FIG. 49 is a waveform diagram showing a change of the polarity of the display signal with the reset potential set to a given condition.

FIGS. 48 and 49 are respectively waveform diagrams showing changes in the potential of the display signals D caused when the polarity of the reset potential Vrs changes. More particularly, FIG. 48 shows a potential change of the display signals D observed when Vrs=±Vm. FIG. 49 shows a potential change of the display signals D observed when Vrs=±−½Δvs.

As shown in FIGS. 48 and 49, by setting the reset potential Vrs to ±Vmin or ±½ΔVS, it is possible to reduce the write time for the display signals D by the time necessary to rise from the potential Vcom. Further, since the common signal lines D1–Dn and the signal lines 746 are reset with the given period, it is possible to greatly reduce the differences between the rising times Tr of the display signals D due to dispersion of the characteristics of the analog switches 732. Furthermore, by setting the reset potential Vrs to ±Vmin or ±½ΔVS, a priming bias is applied to the analog switches 732. Hence, an increased initial charging current flows in the signal lines 746 at the time of writing the display signals D, so that the display signals D can be written into the pixel TFTs 616 at a higher speed. As shown in FIG. 49, when Vrs=±½ΔVS, then the rising times of the display signals D can be made approximately constant irrespective of the levels of the display signals D.

Figure 50A:
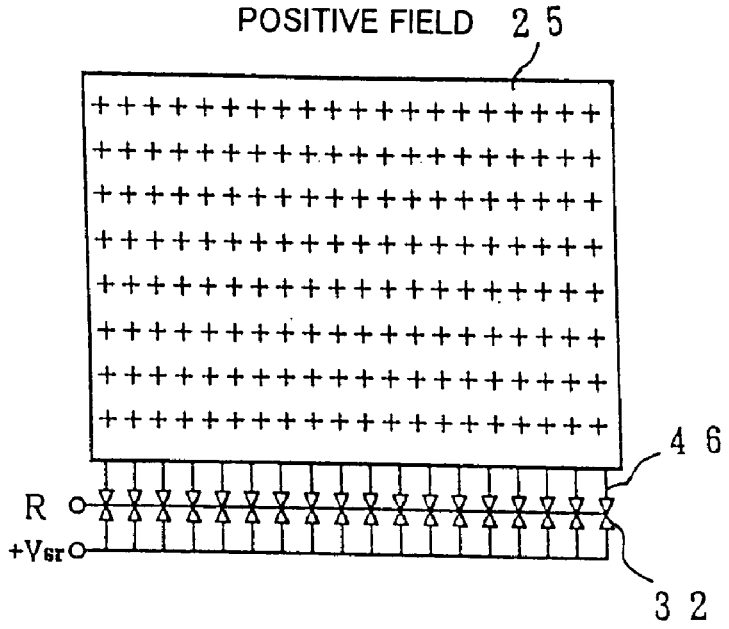
FIGS. 50A and 50B respectively show the polarities of the reset potential in a liquid crystal display device in which a field inversion is employed.
Figure 50B:
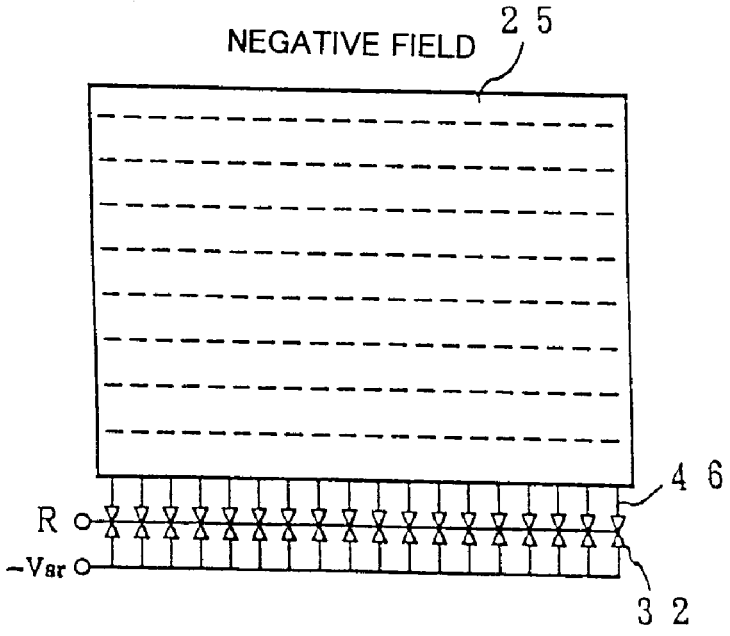
Figure 51:
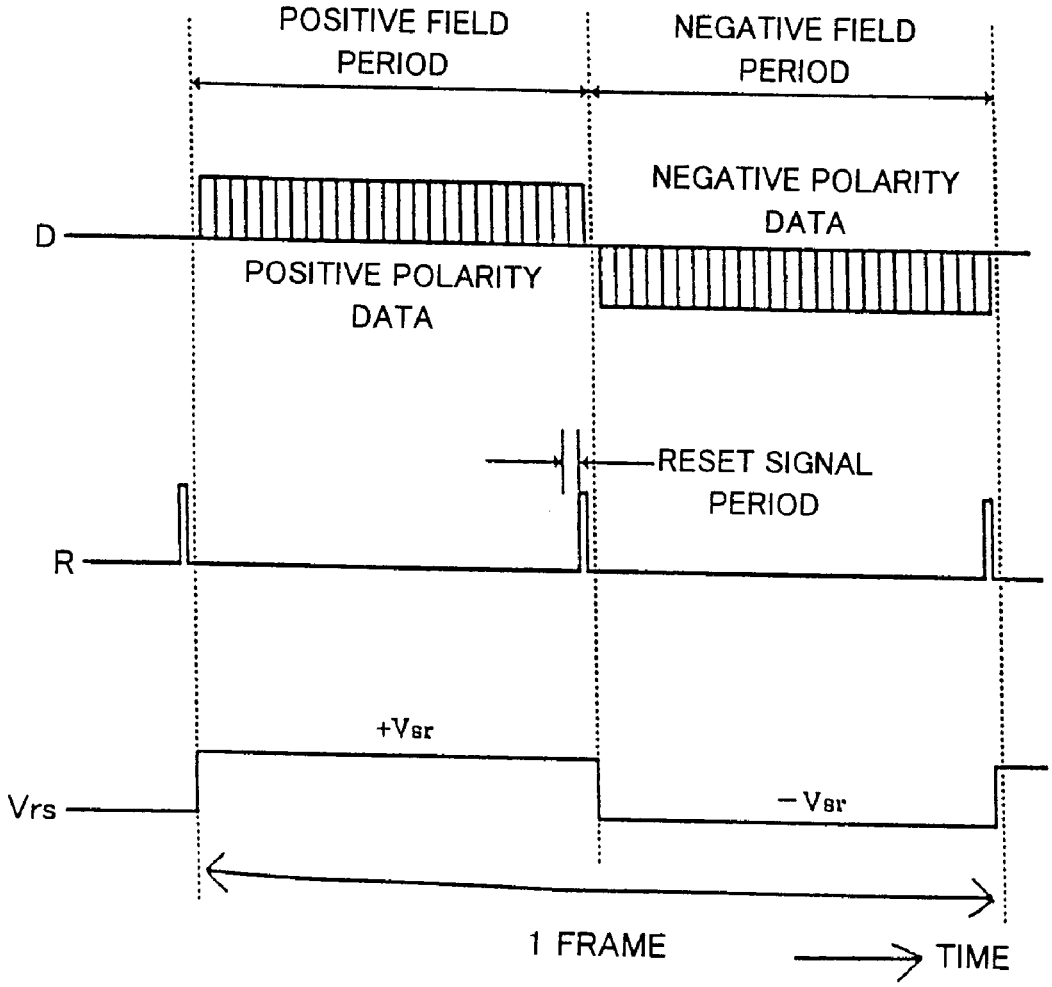
FIG. 51 is a timing chart of an operation of the liquid crystal display device employing the field inversion.

FIGS. 50A and 50B show the polarity of the reset potential Vrs in the liquid crystal display device 740 in which the reset potential is field-inverted. As shown in FIG. 50A, at the time of the positive field, all the signal lines 746 in the display area 725 are set to a positive reset potential +Vrs. As shown in FIG. 50B, at the time of the negative field, all the signal lines 746 in the display area 725 are set to a negative potential −Vrs. FIG. 51 is a timing chart of the display signals D, the reset signal R and the reset potential Vrs.

Figure 52A:
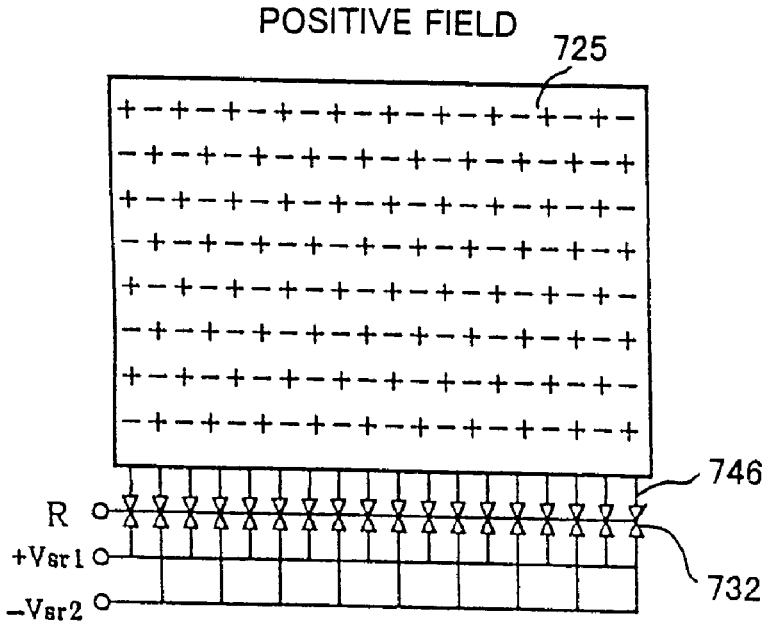
FIGS. 52A and 52B respectively show the polarities of the reset potential in a liquid crystal display device in which an H/V-line inversion is employed.
Figure 52B:
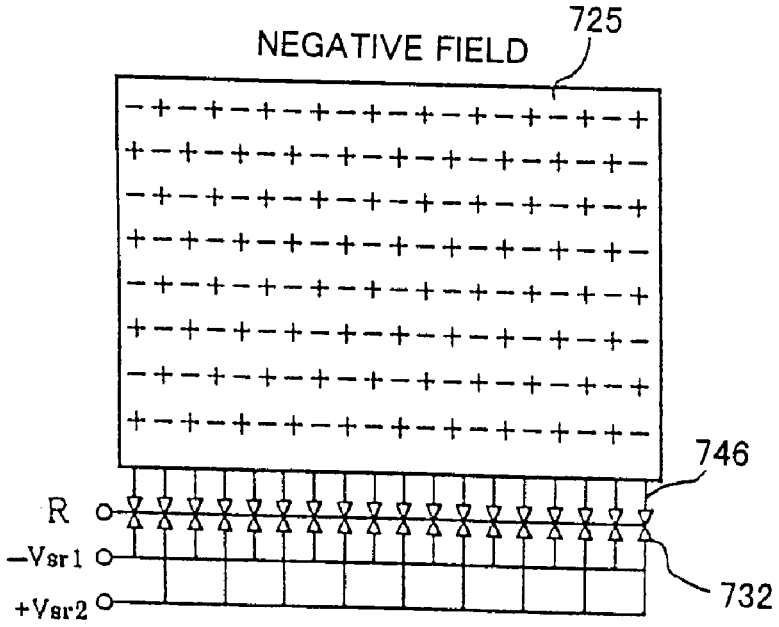

FIGS. 52A and 52B show the polarity of the reset potential Vrs in the liquid crystal display device 740 in which the reset potential Vrs is dot-inverted (H/V-line-inverted). As shown in FIG. 52A, at the time of the positive field, a reset potential Vrs1 of the even-numbered signal lines 746 is the positive reset potential +Vrs, and a reset potential Vrs2 of the odd-numbered signal lines 746 is the negative reset potential −Vrs. As shown in FIG. 52B, at the time of the negative field, a reset potential −Vrs1 of the even-numbered signal lines 746 is the negative reset potential −Vrs, and a reset potential +Vrs2 of the odd-numbered signal lines 746 is the positive reset potential +Vrs. The polarities of the reset potentials Vrs1 and Vrs2 are changed every line on the field basis.

Figure 53:
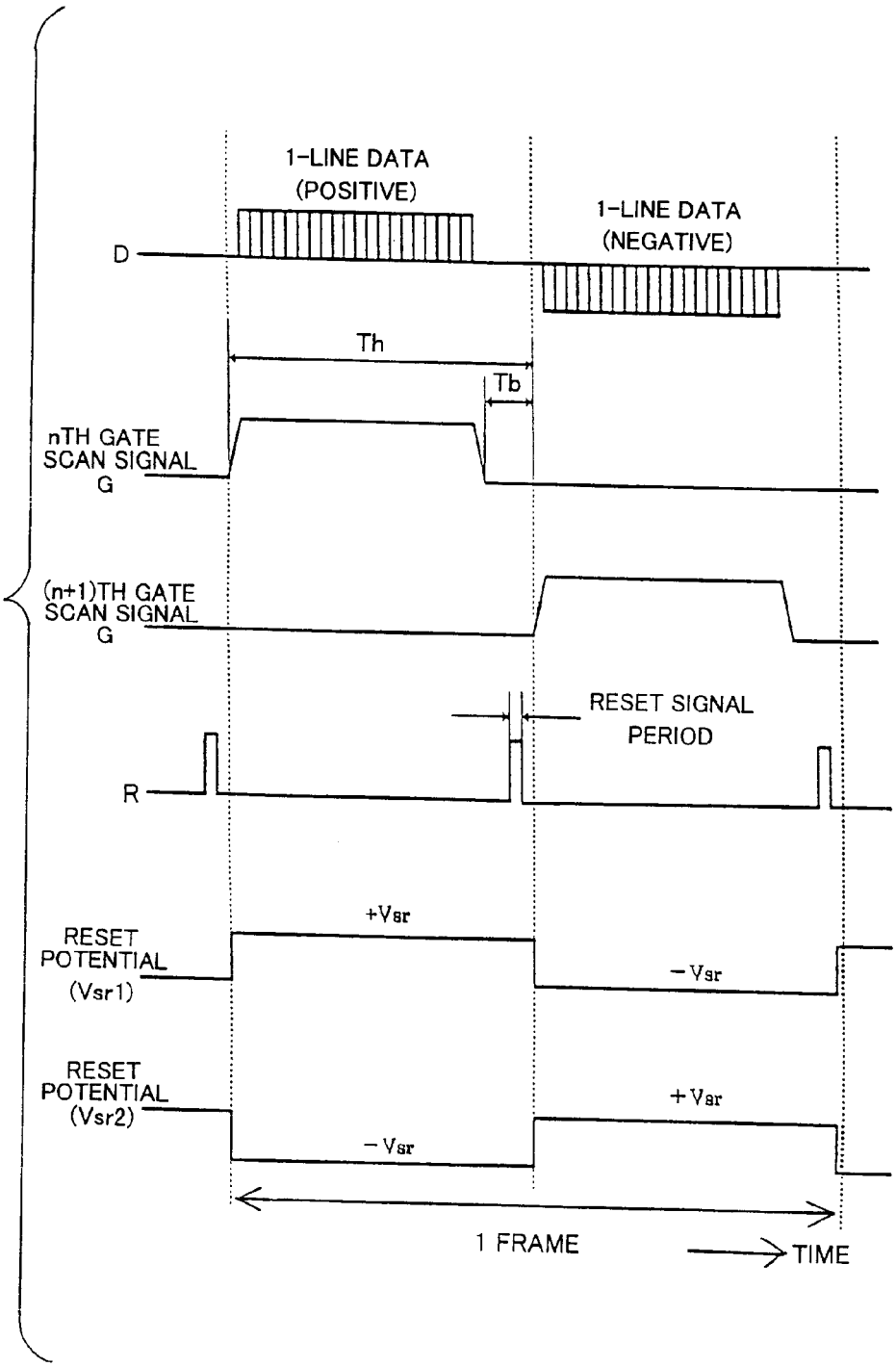
FIG. 53 is a timing chart of an operation of the liquid crystal display device employing the H/V-line inversion.

FIG. 53 shows the display signals D, the scan signal G, the reset signal R and the reset potentials Vrs1 and Vrs2 in the liquid crystal display device 740 in which the reset potentials Vrs1 and Vrs2 are inverted in the H/V line formation.

The concept of the fifth embodiment of the present invention is not limited to the block-sequential drive type liquid crystal display device 740, but may be applied to a dot-sequential drive type liquid crystal display device or a line-sequential drive type liquid crystal display device.

Figure 54:
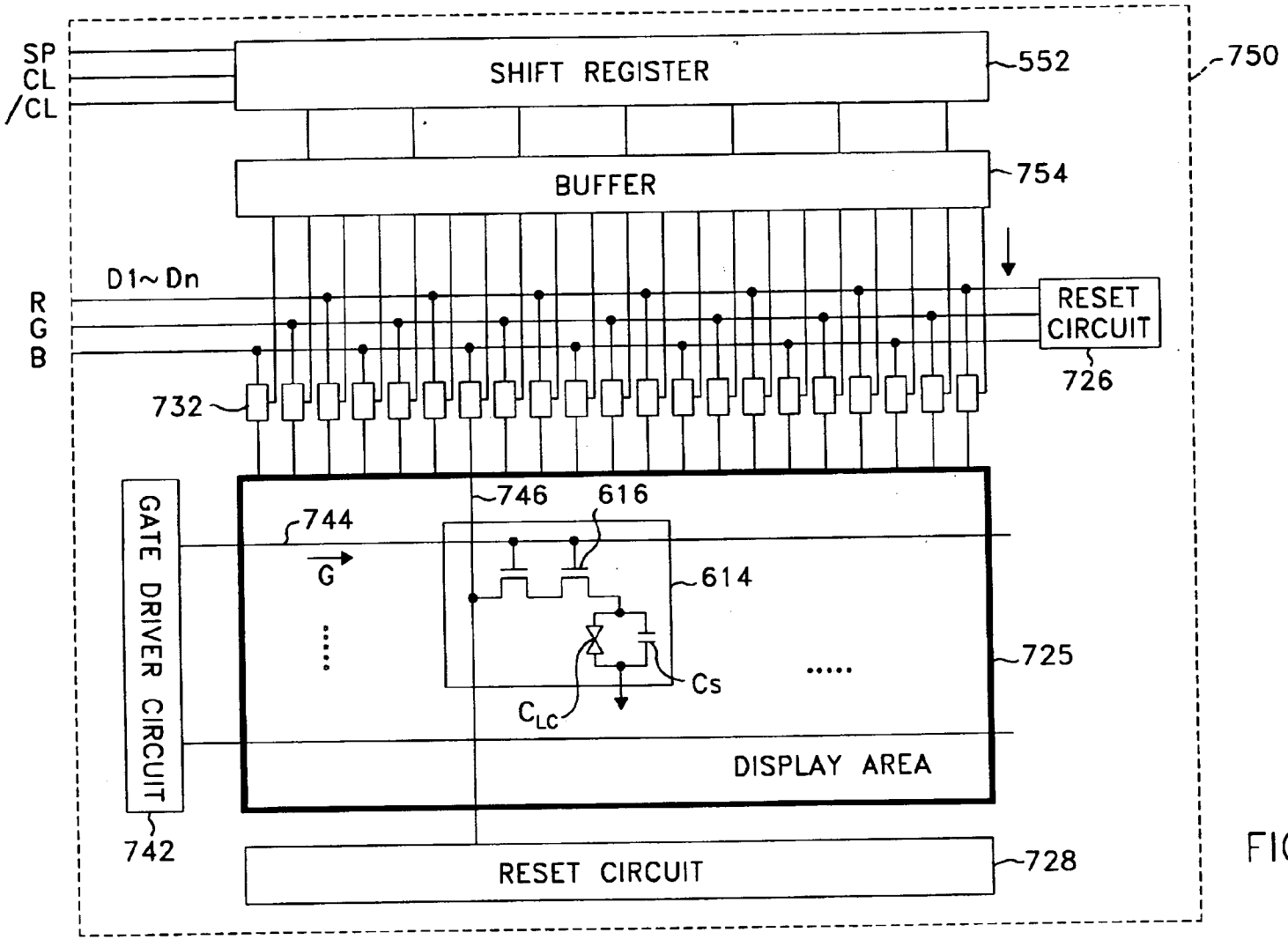
FIG. 54 shows a dot-sequential drive type liquid crystal display device according to the fifth embodiment of the present invention.

FIG. 54 shows a dot-sequential drive type liquid crystal display device 750 with the concept of the fifth embodiment applied thereto. As shown in FIG. 54, the device 750 includes the common signal lines D1–Dn, the analog switches 732 of p-channel polysilicon TFTs, the gate driver circuit 742, the display area 725, a shift register circuit 752, and a buffer circuit 754. In FIG. 54, parts that are the same as those of the aforementioned devices 710, 720, 730 and 740 are given the same reference numbers.

The shift register circuit 742 and the buffer circuit 754 form the timing generating circuit which generates an analog switch control signal A for controlling the analog switches 732. The shift register circuit 752 is supplied with the start pulse SP and the clock signals CL and /CL. The operation frequency of the shift register circuit 752 is, for example, 0.5 MHz.

The scan lines 744 and the signal lines 746 are arranged in the matrix formation in the display area 725. The pixel TFTs 714 are respectively provided at the cross points at which the scan lines 744 and the signal lines 746 cross each other.

The analog switch control signal A is applied to the analog switches 732 by the combination of the shift register 752 and the buffer circuit 754.

At the time of driving the liquid crystal display device 750, the gate signal G is applied to one (first) of the scan lines 744 from the gate driver circuit 742, and are applied to the gates of the pixel TFTs 616, which are thus turned on. The signal lines 746 are supplied, via the analog switches 732, with the display signals D transferred over the common signal lines D1–Dn. Then, the display signals D are input to the pixel TFTs 616 which are on.

The potentials of the common signal lines D1–Dn are reset to the reference potential Vrs (for example, Vcom)with the given period by the reset circuit 726. Further, the potentials of the signal lines 746 are reset to the reference potential Vrs with the given period by the reset circuit 728.

The reset circuit 726 resets the potentials of the common signal lines D1–Dn to the reset potential Vrs each time the block scan ends, and the reset circuit 728 resets the potentials of the signal lines 746 to the reset potential Vrs each time the horizontal scan ends. Hence, the rising times of the pixel TFTs 616 can be made constant, and the constant time it takes to write the display signals D can be obtained. Further, the potentials of the signal lines 746 are reset to the reset potential Vrs with the given period, so that the constant off currents can flow in the pixel TFTs 616 located in the upper and lower panel portions. Hence, the liquid crystal display device 750 is capable of realizing luminance-constant high quality display.

Figure 55:
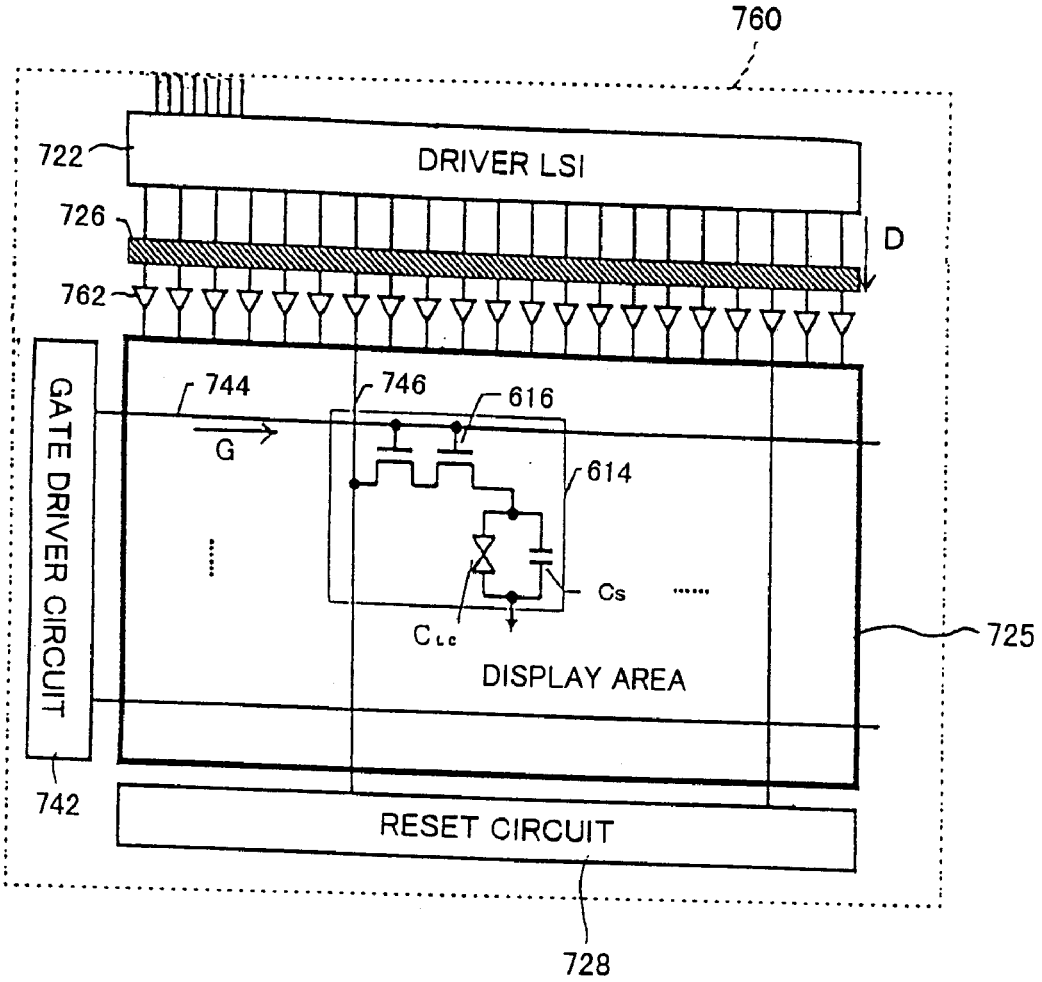
FIG. 55 shows another dot-sequential drive type liquid crystal display device.

FIG. 55 shows a liquid crystal display device 760 of the dot-sequential drive type. As shown in FIG. 55, the liquid crystal display device 760 includes the driver IC device 722, the display area 725, the reset circuits 726 and 728, the gate driver circuit 742, and operational amplifiers 762. In FIG. 55, parts that are the same as those used in the liquid crystal display devices 710, 720, 730, 740 and 750 are given the same reference numbers.

The reset circuit 726 is provided between the driver IC device 722 an the operational amplifiers 762 and are connected to the signal lines 746.

At the time of driving the liquid crystal display device 760, the gate signal G is applied to one (first) of the scan lines 744 from the gate driver circuit 742, and are applied to the gates of the pixel TFTs 616, which are thus turned on. The signal lines 746 are supplied, via the analog switches 732, with the display signals D transferred over the common signal lines D1–Dn. Then, the display signals D are input to the pixel TFTs 616 which are on.

The reset circuit 726 is supplied with the reset signal R from the timing generating circuit (not shown in FIG. 55) with the given period, and resets the potentials of the signal lines 746 between the driver IC device 722 and the operational amplifiers 762 to the reset potential Vrs (for example, Vcom). The reset circuit 728 is supplied with the reset signal R and resets the signal lines 746 to the reset potential Vrs.

The reset circuits 726 and 728 reset the potentials of the signal lines 746 to the reset potential Vrs. Hence, the rising times Tr of the potentials of the pixel TFTs 616 are made uniform and constant. As a result, the constant time it takes to write the display signals D can be obtained. Further, the potentials of the signal lines 746 are reset to the reset potential Vrs with the given period, so that the constant off currents can flow in the pixel TFTs 616 located in the upper and lower panel portions. Hence, the liquid crystal display device 760 is capable of realizing luminance-constant high quality display.

The operational amplifiers 762 may be replaced by the analog switches 732.

Figure 56:
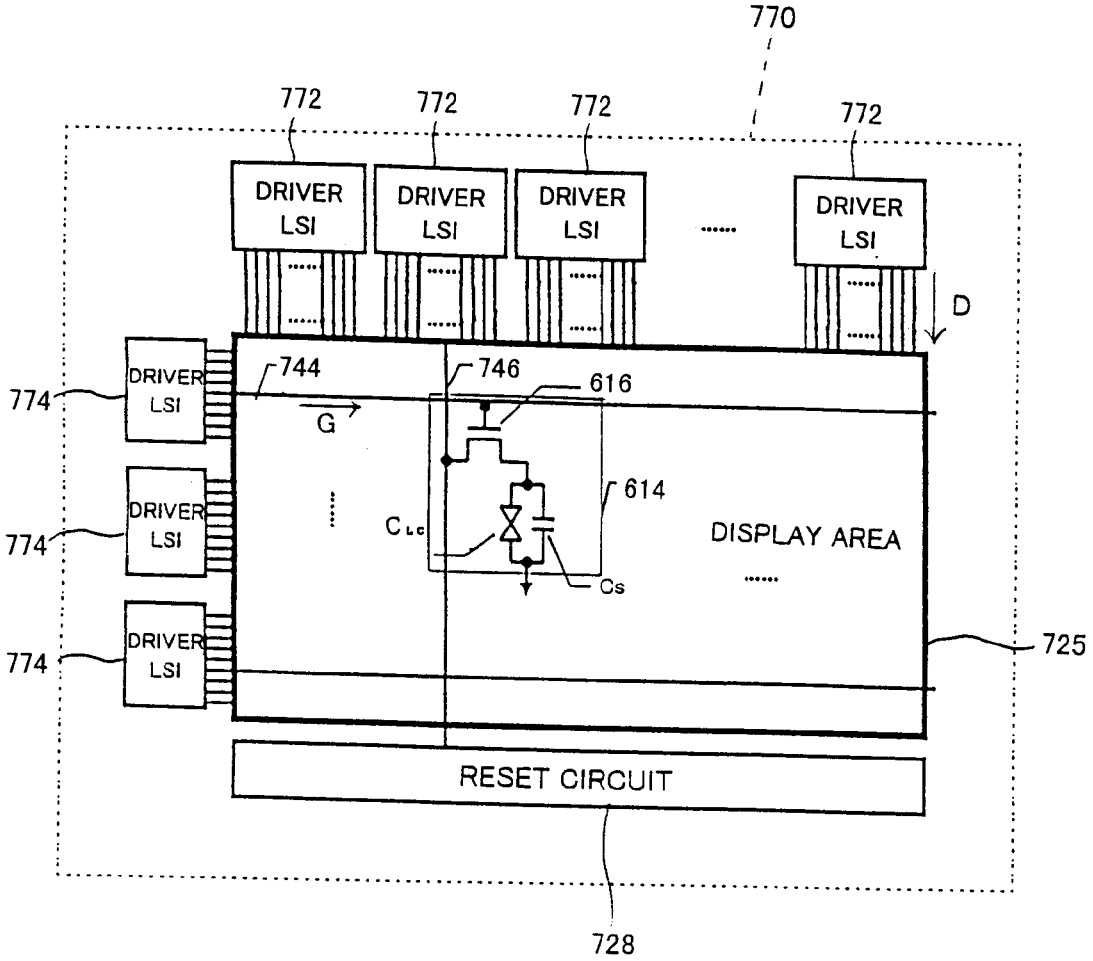
FIG. 56 shows a line-sequential drive type liquid crystal display device.

FIG. 56 shows a line-sequential drive type liquid crystal display device 770. As shown in FIG. 56, the liquid crystal display device 770 includes a driver IC device 772, the display area 725, the reset circuit 728, and a gate-side driver IC device 774. In FIG. 56, parts that are the same as those used in the aforementioned liquid crystal display devices 710, 720, 730, 740, 750 and 760 are given the same reference numbers.

At the time of driving the liquid crystal display device 770, the gate signal G is applied to one (first) of the scan lines 744 from the gate driver IC device 774, and are applied to the gates of the pixel TFTs 616, which are thus turned on. The signal lines 746 are supplied, via the analog switches 732, with the display signals D transferred over the common signal lines D1–Dn from the driver IC device 772. Then, the display signals D are input to the pixel TFTs 616 which are on.

The reset circuit 728 is supplied with the reset signal R from the timing generating circuit (not shown in FIG. 55)

with the given period, and resets the potentials of the signal lines 746 between the driver IC device 722 and the operational amplifiers 762 to the reset potential Vrs (for example, Vcom).

The reset circuit 728 is supplied with the reset signal R and resets the signal lines 746 to the reset potential Vrs.

The reset circuit 728 resets the potentials of the signal lines 746 to the reset potential Vrs. Hence, the rising times Tr of the potentials of the pixel TFTs 616 can be made uniform and constant. As a result, the constant time it takes to write the display signals D can be obtained. Further, the potentials of the signal lines 746 are reset to the reset potential Vrs with the given period, so that the constant off currents can flow in the pixel TFTs 616 located in the upper and lower panel portions. Hence, the liquid crystal display device 770 is capable of realizing luminance-constant high quality display.

The liquid crystal display device 770 may be modified so that the reset circuit 726 is connected to the driver IC device 772 and the potentials of the signal lines 746 are reset to the reset potential Vrs with the given period. The number of driver IC devices 172 and the number of driver IC devices 174 may be selected taking into consideration the numbers of scan lines 744 and signal lines 746 and the driving abilities of the driver IC devices 172 and 174.

The present invention is not limited to the specifically disclosed embodiments, and variations and modifications may be made without departing from the scope of the invention. For example, the concepts of the aforementioned embodiments can arbitrarily be combined.

The present application is based on Japanese priority application nos. 10-305890, 10-306151 and 11-013431, the entire contents of which are hereby incorporated.

What is claimed is:

1. A liquid crystal display device comprising:

a display part having pixels arranged in a matrix formation;

signal lines and scan lines connected to the pixels;

a data driver which supplies display signals to the signal lines; and a reset circuit which resets the potentials of the signal lines to a predetermined potential with a given period;

wherein the reset circuit comprises a first reset circuit connected to the signal lines, and a second reset circuit connected to an output part of the driver.

2. The liquid crystal display device as claimed in claim 42, wherein the reset circuit receives a reset signal externally applied thereto during a blanking period included in a horizontal period and resets the potentials of the signal lines to the predetermined potential during the blanking period.

3. The liquid crystal display device as claimed in claim 1, wherein a polarity of the predetermined potential is inverted in synchronism with the polarity of the display signals.

4. The data driver as claimed in claim 1, wherein said data driver is provided at a first side of the display part, and said second reset circuit is provided at a second side of the display part.

5. The data driver as claimed in claim 1, wherein said first driver is provided at a first side of the display part, and said second reset circuit is provided at a second side of the display part opposite to the first side.

6. A liquid crystal display device comprising:

a display part having pixels arranged in a matrix formation;

signal lines and scan lines connected to the pixels;

analog switches respectively connected to the signal lines;

a data driver which is connected to the analog switches via common signal lines and supplies display signals to the signal lines via the analog switches; and a reset circuit which resets the potentials of the signal lines and/or the common signal lines to a predetermined potential with a given period;

wherein the reset circuit comprises a first reset circuit connected to the signal lines, and a second reset circuit connected to an output part of the driver.

7. A liquid crystal display device comprising:

a display part having pixels arranged in a matrix formation;

signal lines and scan lines connected to the pixels;

analog switches respectively connected to the signal lines;

a data driver which is connected to the analog switches via common signal lines and supplies display signals to the signal lines via the analog switches; and a reset circuit which resets the potentials of the signal lines and/or the common signal lines to a predetermined potential with a given period;

wherein the reset circuit comprises a first reset circuit connected to the signal lines, and a second reset circuit connected to either an output part of the driver or the common signal lines.

8. A liquid crystal display device comprising:

a display part which has pixels arranged in a matrix formation and is divided into blocks;

signal lines and scan lines coupled to the pixels;

analog switches respectively coupled to the signal lines and provided in the blocks;

a data driver which is coupled to the analog switches via common signal lines and supplies display signals to the signal lines via the analog switches provided in one of the blocks which are sequentially selected in accordance with a block control signal, whereby a plurality of blocks receive display signals from said data driver; and a reset circuit which resets the potentials of the signal lines to a predetermined potential with a given period.

9. The liquid crystal display device as claimed in claim 8, wherein the reset circuit receives a reset signal externally applied thereto during a blanking period included in a horizontal scan period and resets the potentials of the signal lines to the predetermined potential during the blanking period.

* * * * *

UNITED STATES PATENT AND TRADEMARK OFFICE

CERTIFICATE OF CORRECTION

PATENT NO. : 6,806,862 B1
DATED : October 19, 2004
INVENTOR(S) : Hongyong Zhang et al.

It is certified that error appears in the above-identified patent and that said Letters Patent is hereby corrected as shown below:

Column 29,
Line 2, delete "42" and insert -- 1 -- therefor.

Signed and Sealed this

Nineteenth Day of April, 2005

JON W. DUDAS
*Director of the United States Patent and Trademark Office*